US012013157B2

(12) United States Patent
Alexander et al.

(10) Patent No.: US 12,013,157 B2
(45) **Date of Patent: *Jun. 18, 2024**

(54) PORTABLE COOLER WITH ACTIVE TEMPERATURE CONTROL

(71) Applicant: Ember LifeSciences, Inc., Westlake Village, CA (US)

(72) Inventors: Clayton Alexander, Westlake Village, CA (US); Daren John Leith, Agoura Hills, CA (US); Mikko Juhani Timperi, San Marcos, CA (US); Christopher Thomas Wakeham, Solana Beach, CA (US); Joseph Lyle Koch, Anaheim, CA (US); Jacob William Emmert, Westchester, CA (US); Rahul Mulinti, Westlake Village, CA (US); James Shum Lau, Westlake Village, CA (US)

(73) Assignee: Ember LifeSciences, Inc., Westlake Village, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/936,253

(22) Filed: Sep. 28, 2022

(65) Prior Publication Data

US 2023/0017326 A1 Jan. 19, 2023

Related U.S. Application Data

(63) Continuation of application No. PCT/US2021/023498, filed on Mar. 22, 2021.
(Continued)

(51) Int. Cl.
*F25B 21/04* (2006.01)

(52) U.S. Cl.
CPC ..... *F25B 21/04* (2013.01)

(58) Field of Classification Search
CPC .... F25D 11/003; F25D 2400/36; F25B 21/02; F25B 21/04; F25B 2321/0211;
(Continued)

(56) References Cited

U.S. PATENT DOCUMENTS 1,649,067 A 11/1927 Karlson
1,721,311 A 7/1929 Muenchen
(Continued)

FOREIGN PATENT DOCUMENTS

CH 631614 8/1982
CN 1338240 A 3/2002
(Continued)

OTHER PUBLICATIONS

International Search Report and Written Opinion, regarding International Application No. PCT/US2021/1023498, dated Jun. 22, 2021, 14 pages.
(Continued)

*Primary Examiner* — Filip Zec
(74) *Attorney, Agent, or Firm* — Knobbe, Martens, Olson & Bear LLP

(57) ABSTRACT

A portable cooler container with active temperature control, comprising: a container body having a chamber configured to receive and hold one or more containers of medicine; a lid operable to access the chamber; and a temperature control system comprising one or more thermoelectric elements configured to actively heat or cool at least a portion of the chamber, circuitry configured to control an operation of the one or more thermoelectric elements to heat or cool at least a portion of the chamber to a predetermined temperature or temperature range; and a display screen disposed on one of the container body and the lid, the display screen configured to selectively display one or more of information associated with the operation of the portable cooler, information asso-
(Continued)

ciated with the containers of medicine in the portable cooler, information associated with scheduled taking of the containers of medicine, and advertisements.

19 Claims, 48 Drawing Sheets

Related U.S. Application Data

(60) Provisional application No. 63/004,737, filed on Apr. 3, 2020.

(58) Field of Classification Search
CPC ..... F25B 2321/0212; F25B 2700/15; F25B 2700/2104; F25B 2700/2106; F25B 2700/2107
See application file for complete search history.

(56) References Cited

U.S. PATENT DOCUMENTS 1,727,913 A 9/1929 Svenn
2,046,125 A 6/1936 Lacy
2,483,979 A 10/1949 Morrill
2,548,076 A 4/1951 Strezoff
2,746,265 A 5/1956 Mills
3,064,113 A 11/1962 Pitrone
3,129,116 A 4/1964 Corry
3,155,260 A 11/1964 Widener
3,238,944 A 3/1966 Hirschhorn
3,345,934 A 10/1967 Steiner
3,435,622 A 4/1969 Barton et al.
3,463,140 A 8/1969 Rollor, Jr.
3,536,893 A 10/1970 Cran Ley
3,539,399 A 11/1970 Harvey
3,543,842 A 12/1970 Veit Merges
3,603,106 A 9/1971 Ryan et al.
3,607,444 A 9/1971 DeBucs
3,622,753 A 11/1971 Lax
3,678,248 A 7/1972 Tricault et al.
3,739,148 A 6/1973 Ryckman, Jr.
3,757,085 A 9/1973 Balaguer
3,766,975 A 10/1973 Todd
3,797,563 A 3/1974 Hoffmann et al.
3,823,567 A 7/1974 Corini
3,892,945 A 7/1975 Lerner
3,931,494 A 1/1976 Fisher et al.
4,038,831 A 8/1977 Gaudel et al.
4,068,115 A 1/1978 Mack
4,095,090 A 6/1978 Pianezza
4,134,004 A 1/1979 Anderson et al.
4,240,272 A 12/1980 Tiede et al.
4,442,343 A 4/1984 Genuit et al.
4,470,999 A 9/1984 Carpiac
4,531,046 A 7/1985 Stover
4,537,044 A 8/1985 Putnam
D296,509 S 7/1988 Fuke
4,785,637 A 11/1988 Giebeler
4,801,782 A 1/1989 Ineson
4,827,107 A 5/1989 Peery
4,865,986 A 9/1989 Coy et al.
4,978,833 A 12/1990 Knepler
4,980,539 A 12/1990 Walton
4,982,722 A 1/1991 Wyatt
4,983,798 A 1/1991 Eckler
5,042,258 A 8/1991 Sundhar
5,090,209 A 2/1992 Martin
5,163,290 A 11/1992 Kinnear
5,199,275 A 4/1993 Martin
5,208,896 A 5/1993 Katayev
5,217,064 A 6/1993 Kellow
5,243,684 A 9/1993 Edwards
5,274,215 A 12/1993 Jackson
5,283,420 A 2/1994 Montalto
5,313,787 A 5/1994 Martin
5,343,368 A 8/1994 Miller
5,388,565 A 2/1995 Ou
5,448,809 A 9/1995 Kraus
5,497,883 A 3/1996 Monetti
5,508,494 A 4/1996 Sarris et al.
5,508,600 A 4/1996 Myslinski
5,535,815 A 7/1996 Hyman
5,549,035 A 8/1996 Wing-Chung
5,550,452 A 8/1996 Shirai et al.
5,603,220 A 2/1997 Seaman
5,603,858 A 2/1997 Wyatt et al.
5,605,047 A 2/1997 Park
5,616,139 A * 4/1997 Okamoto ..... A61F 9/008 606/4
5,638,896 A 6/1997 Nishino
5,643,485 A 7/1997 Potter et al.
5,678,925 A 10/1997 Garmaise et al.
5,731,568 A 3/1998 Malecek
5,737,923 A 4/1998 Gilley
5,771,788 A 6/1998 Lee
5,786,643 A 7/1998 Wyatt et al.
5,842,353 A 12/1998 Kuo-Liang
5,884,006 A 3/1999 Frohlich et al.
5,903,133 A 5/1999 Amero, Jr. et al.
5,945,651 A * 8/1999 Chorosinski ..... A61J 1/035 235/375
5,948,301 A 9/1999 Liebermann
5,954,984 A 9/1999 Ablah et al.
5,959,433 A 9/1999 Rohde
6,000,224 A 12/1999 Foye
6,000,225 A 12/1999 Ghoshal
6,003,319 A 12/1999 Gilley et al.
6,005,233 A 12/1999 Wyatt
6,013,901 A 1/2000 Lavoie
6,020,575 A 2/2000 Nagle et al.
6,032,481 A 3/2000 Mosby
6,042,720 A 3/2000 Reber
6,072,161 A 6/2000 Stein
6,075,229 A 6/2000 Vanselow
6,089,409 A 7/2000 Hart
6,106,784 A 8/2000 Lund et al.
6,108,489 A 8/2000 Frohlich et al.
6,110,159 A 8/2000 Tsujita
6,119,460 A 9/2000 Huang
6,123,065 A 9/2000 Teglbjarg
6,140,614 A 10/2000 Padamsee
6,141,975 A 11/2000 Tatsumi
6,144,016 A 11/2000 Garvin
6,158,227 A 12/2000 Seeley
6,178,753 B1 1/2001 Scudder
6,180,003 B1 1/2001 Reber et al.
6,209,343 B1 4/2001 Owen
6,212,959 B1 4/2001 Perkins
6,232,585 B1 5/2001 Clothier
RE37,213 E 6/2001 Staggs
6,260,360 B1 7/2001 Wheeler
6,274,856 B1 8/2001 Clothier
6,279,470 B2 8/2001 Simeray et al.
6,281,611 B1 8/2001 Chen et al.
6,308,518 B1 10/2001 Hunger
6,310,329 B1 10/2001 Carter
6,314,867 B1 11/2001 Russell
6,316,753 B2 11/2001 Clothier
6,320,169 B1 11/2001 Clothier
6,350,972 B1 2/2002 Wright
6,351,952 B1 3/2002 Baker, III
6,353,208 B1 3/2002 Bostic
6,376,803 B1 4/2002 Klinger
6,384,387 B1 5/2002 Owens
6,403,928 B1 6/2002 Ford
6,414,278 B1 7/2002 Frohlich et al.
6,415,624 B1 7/2002 Connors et al.
6,427,863 B1 8/2002 Nichols
6,433,313 B1 8/2002 Owens
6,434,000 B1 8/2002 Pandolfi
6,444,961 B2 9/2002 Clothier
6,539,725 B2 4/2003 Bell
6,543,335 B1 4/2003 Lassota
6,555,789 B2 4/2003 Owens

(56) References Cited

U.S. PATENT DOCUMENTS 6,558,947 B1 5/2003 Lund et al.
6,571,564 B2 6/2003 Upadhye et al.
6,584,374 B2 6/2003 Lee et al.
6,598,405 B2 7/2003 Bell
6,609,392 B1 8/2003 Brown
6,622,515 B2 9/2003 Baker, III
6,634,417 B1 10/2003 Kolowich
6,637,210 B2 10/2003 Bell
6,651,445 B1 11/2003 Clark
6,657,170 B2 12/2003 Clothier
6,662,978 B2 12/2003 Lin et al.
6,664,520 B2 12/2003 Clothier
6,668,577 B2 12/2003 Quenedey
6,672,076 B2 1/2004 Bell
6,674,052 B1 1/2004 Luo
6,702,138 B1 3/2004 Bielecki et al.
6,703,590 B1 3/2004 Holley, Jr.
6,751,963 B2 6/2004 Navedo
6,753,775 B2 6/2004 Auerbach et al.
6,771,183 B2 8/2004 Hunter
6,818,867 B2 11/2004 Kressmann
6,822,198 B2 11/2004 Rix
6,852,954 B1 2/2005 Liu et al.
6,864,462 B2 3/2005 Sanoner et al.
6,870,135 B2 3/2005 Hamm et al.
6,948,321 B2 9/2005 Bell
6,953,913 B1 10/2005 Hara et al.
6,968,888 B2 11/2005 Kolowich
7,002,111 B2 2/2006 Bauer
7,022,946 B2 4/2006 Sanoner et al.
7,034,256 B1 4/2006 Phillips
7,057,527 B2 6/2006 Hunter
7,059,387 B2 6/2006 Kolowich
7,069,739 B2 7/2006 Porter
7,073,678 B1 7/2006 Dibdin et al.
7,091,455 B2 8/2006 Fung
7,109,445 B2 9/2006 Patterson et al.
7,111,465 B2 9/2006 Bell
7,117,684 B2 10/2006 Scudder
7,140,508 B2 11/2006 Kuhn et al.
7,140,768 B2 11/2006 Prabhakar
7,174,720 B2 2/2007 Kennedy
7,193,190 B2 3/2007 Kissel, Jr.
7,208,707 B2 4/2007 Clothier
7,212,955 B2 5/2007 Kirshenbau et al.
7,225,632 B2 6/2007 Derifield
7,227,108 B2 6/2007 Clothier
7,231,771 B2 * 6/2007 McMurry ..... F25B 21/02 62/3.6
7,260,438 B2 8/2007 Caldwell
7,263,283 B2 8/2007 Knepler
7,263,855 B2 9/2007 Meyer et al.
7,276,676 B1 10/2007 Thompson
7,278,270 B2 10/2007 Culp
7,287,386 B2 10/2007 Upadhye et al.
7,294,374 B2 11/2007 Romero
7,411,792 B2 8/2008 Richards et al.
7,414,380 B2 8/2008 Tang et al.
7,419,073 B2 9/2008 Crisp, III
7,421,845 B2 9/2008 Bell
7,431,174 B2 10/2008 Thissen
7,511,617 B2 3/2009 Burman et al.
7,571,830 B2 8/2009 Lin
7,592,084 B2 9/2009 Hoffjann
7,659,493 B2 2/2010 Reusche et al.
7,681,754 B1 3/2010 Ross
7,683,572 B2 3/2010 Toya
7,721,566 B1 5/2010 Wilken
7,728,711 B2 6/2010 Shoenfeld
7,748,223 B2 7/2010 Minoura
7,764,497 B2 7/2010 Becklin
7,784,301 B2 8/2010 Sasaki et al.
7,802,446 B2 9/2010 Overgaard
7,815,067 B2 10/2010 Matsumoto et al.
7,825,353 B2 11/2010 Shingler
7,836,722 B2 11/2010 Magill et al.
7,856,795 B2 * 12/2010 Grimard ..... A61M 5/3129 53/131.2
7,861,538 B2 1/2011 Welle et al.
7,872,214 B2 1/2011 Schandel
7,886,655 B1 2/2011 Lassota
7,908,870 B2 3/2011 Williams et al.
7,913,511 B2 3/2011 Meyer et al.
7,926,293 B2 4/2011 Bell
7,934,537 B2 5/2011 Kolowich
7,939,312 B2 5/2011 Roberts et al.
7,942,145 B2 5/2011 Palena et al.
7,948,209 B2 5/2011 Jung
7,966,927 B2 6/2011 Yoakim
7,997,786 B2 8/2011 Liu
8,055,310 B2 11/2011 Beart et al.
8,056,357 B2 11/2011 Bruce
8,061,149 B1 11/2011 Gowans
8,076,620 B2 12/2011 Maupin et al.
8,113,365 B2 2/2012 Brown
8,146,485 B2 4/2012 Ozanne
8,156,755 B2 4/2012 Murray
8,205,468 B2 6/2012 Hemminger et al.
8,215,835 B2 7/2012 Hyde et al.
8,272,530 B2 9/2012 Rebernik
8,272,532 B2 9/2012 Michaelian et al.
8,274,016 B2 9/2012 Montana
8,280,453 B2 10/2012 Beart et al.
8,319,154 B2 11/2012 Shaikh et al.
8,336,729 B2 12/2012 Kelly
8,362,351 B2 1/2013 Hagg et al.
8,375,728 B2 2/2013 Bell
8,391,103 B2 3/2013 De la Huerga
8,391,104 B2 3/2013 De la Huerga
8,398,602 B2 3/2013 Lio
8,400,104 B2 3/2013 Adamczyk et al.
8,424,316 B2 4/2013 Tuszkiewicz
8,448,457 B2 5/2013 Cutting et al.
8,448,809 B2 5/2013 Kelly
8,453,477 B2 6/2013 Crespo et al.
8,467,669 B2 6/2013 Widanagamage et al.
8,479,941 B2 7/2013 Matsumoto et al.
8,607,581 B2 12/2013 Williams et al.
8,618,448 B2 12/2013 Alexander
8,621,980 B2 1/2014 Bunn
8,646,282 B2 2/2014 Ilercil et al.
8,659,903 B2 2/2014 Schwartz
8,677,767 B2 3/2014 Ilercil et al.
8,759,721 B1 6/2014 Alexander
D715,143 S 10/2014 Hewitt
8,887,512 B2 11/2014 Olsen
8,887,944 B2 11/2014 Deane et al.
8,893,513 B2 11/2014 June
8,904,809 B2 12/2014 Yuan et al.
8,907,796 B2 12/2014 Sweeney et al.
8,919,138 B2 12/2014 Kobayashi
8,938,986 B2 1/2015 Matta et al.
8,991,194 B2 3/2015 Edwards et al.
9,021,825 B2 5/2015 Hewitt
9,022,249 B2 5/2015 Ranade
9,035,222 B2 5/2015 Alexander
9,057,568 B2 6/2015 Malik et al.
9,060,508 B2 6/2015 Anti et al.
9,103,572 B2 8/2015 Edwards et al.
9,115,919 B2 8/2015 Ilercil
9,134,055 B2 9/2015 Ilercil
9,138,295 B2 9/2015 Hyde et al.
9,139,319 B2 9/2015 Crespo et al.
9,139,351 B2 9/2015 Chou et al.
9,140,476 B2 9/2015 Eckhoff et al.
9,144,180 B2 9/2015 Olsson et al.
9,151,523 B2 10/2015 Ilercil
9,151,545 B2 10/2015 Soukhojak
9,182,155 B2 11/2015 Crumlin
9,184,427 B2 11/2015 Chuang
9,272,475 B2 3/2016 Ranade et al.
9,310,111 B2 4/2016 Edwards et al.
9,341,394 B2 5/2016 Edwards et al.
9,351,600 B2 5/2016 Rime

(56) References Cited

U.S. PATENT DOCUMENTS 9,366,469 B2 6/2016 Chapman, Jr.
9,372,016 B2 6/2016 Bloedow et al.
9,424,548 B1 8/2016 Siegel
9,429,350 B2 8/2016 Chapman, Jr.
9,435,578 B2 9/2016 Calderon et al.
9,447,995 B2 9/2016 Bloedow et al.
9,470,440 B2 10/2016 Ilercil
9,480,363 B2 11/2016 Delattre
9,513,067 B2 12/2016 Ahmed
9,573,754 B2 2/2017 Ahmed et al.
9,581,362 B2 2/2017 Stanley et al.
9,593,871 B2 3/2017 Stanley et al.
9,599,376 B2 3/2017 Ilercil
9,618,253 B2 4/2017 Tansley
9,685,598 B2 6/2017 Marc
9,688,454 B2 6/2017 Ranade
9,713,798 B2 7/2017 Hewitt
9,752,808 B2 9/2017 Nakamura
9,758,299 B2 9/2017 Ahmed et al.
9,775,779 B2 * 10/2017 Ali ..... A61J 1/1412
9,791,184 B2 10/2017 Novisoff et al.
9,791,185 B2 10/2017 Ilercil
9,795,979 B2 10/2017 Adler
9,802,806 B2 10/2017 Hewitt
9,814,331 B2 11/2017 Alexander
9,828,165 B2 11/2017 Ranade et al.
9,829,221 B2 11/2017 Ilercil
9,874,377 B1 1/2018 Ilercil
9,885,502 B2 2/2018 Yuan et al.
9,950,851 B2 4/2018 Ranade
9,958,187 B2 * 5/2018 Monroy ..... F25B 21/02
10,012,417 B2 7/2018 Edwards et al.
10,101,420 B2 10/2018 Wikus et al.
10,119,733 B1 11/2018 Ilercil
10,131,478 B2 11/2018 Maser
10,156,388 B2 12/2018 Ilercil
10,161,657 B2 * 12/2018 Ilercil ..... F25B 21/04
10,181,109 B2 1/2019 Joao
10,188,229 B2 1/2019 Alexander
10,245,214 B2 * 4/2019 Bochenko ..... A61J 1/2096
10,274,241 B2 * 4/2019 Ghiraldi ..... F25D 3/14
10,279,979 B2 5/2019 Ranade
10,287,085 B2 * 5/2019 Kuhn ..... B65D 43/02
10,328,074 B2 6/2019 Engelhardt et al.
10,372,922 B2 8/2019 Paterra
10,405,650 B2 9/2019 Turner et al.
10,458,684 B1 10/2019 Ilercil
10,472,158 B2 11/2019 Ranade
10,495,357 B2 12/2019 Ilercil
10,549,900 B2 * 2/2020 McCormick ..... F25D 3/08
10,562,695 B2 * 2/2020 Knight ..... B65D 43/0202
10,625,922 B2 4/2020 Epenetos et al.
10,743,708 B2 8/2020 Alexander et al.
10,823,478 B2 11/2020 Williams
10,850,047 B2 12/2020 McCormick
11,083,332 B2 8/2021 Alexander et al.
11,089,891 B2 8/2021 Alexander
11,090,225 B2 8/2021 Vlahinos et al.
2001/0009609 A1 7/2001 Bradenbaugh
2001/0022304 A1 9/2001 Roche
2001/0023866 A1 9/2001 Wang
2002/0023912 A1 2/2002 Mcgee
2002/0083840 A1 7/2002 Lassota
2002/0104318 A1 8/2002 Jaafar
2002/0001297 A1 9/2002 Westbrook
2002/0129712 A1 9/2002 Westbrook
2002/0162339 A1 11/2002 Harrison
2002/0175158 A1 11/2002 Sanoner et al.
2003/0024250 A1 2/2003 Haas
2003/0029862 A1 2/2003 Clothier
2003/0029876 A1 2/2003 Giraud
2003/0066638 A1 4/2003 Qu
2003/0074903 A1 4/2003 Upadhye
2003/0122455 A1 7/2003 Caldwell
2003/0145621 A1 8/2003 Kidwell
2004/0004072 A1 1/2004 Clothier
2004/0006996 A1 1/2004 Butcher
2004/0007553 A1 1/2004 Smolko
2004/0111179 A1 6/2004 Broadfield et al.
2004/0159240 A1 8/2004 Lyall, III
2004/0167592 A1 8/2004 Grove
2004/0194470 A1 10/2004 Upadhye et al.
2004/0212120 A1 10/2004 Giraud
2004/0226309 A1 11/2004 Broussard
2005/0045615 A1 3/2005 Sanoner et al.
2005/0045618 A1 3/2005 Ito
2005/0121431 A1 6/2005 Yuen
2005/0242804 A1 11/2005 Hintz
2006/0005873 A1 1/2006 Kambe et al.
2006/0021513 A1 2/2006 Ide
2006/0023480 A1 2/2006 Plummer
2006/0081599 A1 4/2006 Anderson
2006/0173259 A1 8/2006 Flaherty
2006/0207442 A1 9/2006 Pettersson
2006/0209628 A1 9/2006 Jones
2006/0261233 A1 11/2006 Williams et al.
2007/0024237 A1 2/2007 Cole et al.
2007/0051727 A1 3/2007 Holley
2007/0092773 A1 4/2007 Guo
2007/0144205 A1 6/2007 Moore
2007/0151457 A1 7/2007 Rabin et al.
2007/0182367 A1 8/2007 Partovi
2007/0186577 A1 8/2007 Goncharko
2007/0193297 A1 8/2007 Wilson
2007/0223895 A1 9/2007 Flemm
2007/0257766 A1 11/2007 Richards et al.
2007/0278207 A1 12/2007 Van Hoy
2007/0279002 A1 12/2007 Partovi
2008/0011077 A1 1/2008 Ramus et al.
2008/0019122 A1 1/2008 Kramer
2008/0022695 A1 1/2008 Welle
2008/0022696 A1 1/2008 Welle
2008/0041233 A1 2/2008 Bunn
2008/0041859 A1 2/2008 Teglbjarg
2008/0087270 A1 4/2008 Shaikh
2008/0121630 A1 5/2008 Simard
2008/0135564 A1 6/2008 Romero
2008/0141681 A1 6/2008 Arnold
2008/0149624 A1 6/2008 Tamura
2008/0179311 A1 7/2008 Koro et al.
2008/0190914 A1 8/2008 Gibson
2008/0213449 A1 9/2008 Wisner et al.
2008/0251063 A1 10/2008 Palena et al.
2008/0272134 A1 11/2008 Rohe
2009/0049845 A1 2/2009 McStravick et al.
2009/0058352 A1 3/2009 Lin
2009/0064687 A1 3/2009 Tuszkiewicz
2009/0071952 A1 3/2009 Kuwabara
2009/0078708 A1 3/2009 Williams
2009/0100843 A1 4/2009 Wilkinson
2009/0102296 A1 4/2009 Greene et al.
2009/0152276 A1 6/2009 Groll
2009/0158770 A1 6/2009 Cohrs et al.
2009/0166350 A1 7/2009 Ho
2009/0184102 A1 7/2009 Parker, Jr. et al.
2009/0200320 A1 8/2009 Saito
2009/0230117 A1 9/2009 Fernando
2009/0277187 A1 11/2009 McGann
2010/0000980 A1 1/2010 Popescu
2010/0028758 A1 2/2010 Eaves
2010/0064698 A1 3/2010 Schabron
2010/0089247 A1 4/2010 Yang
2010/0108694 A1 5/2010 Sedlbauer et al.
2010/0125417 A1 5/2010 Hyde et al.
2010/0147014 A1 6/2010 Kim
2010/0158489 A1 6/2010 Siu et al.
2010/0158660 A1 6/2010 Radhakrishnan
2010/0186499 A1 7/2010 Ramus et al.
2010/0251755 A1 10/2010 Lauchnor
2010/0299278 A1 11/2010 Kriss
2011/0041546 A1 2/2011 Linder
2011/0056215 A1 3/2011 Ham et al.
2011/0062149 A1 3/2011 Oriel et al.
2011/0070474 A1 3/2011 Lee et al.

(56) References Cited

U.S. PATENT DOCUMENTS

2011/0072978 A1 3/2011 Popescu
2011/0073603 A1 3/2011 Saho et al.
2011/0082437 A1 4/2011 Stacey
2011/0083445 A1 4/2011 Heyd
2011/0108506 A1 5/2011 Lindhorst-Ko
2011/0121660 A1 5/2011 Azancot et al.
2011/0143000 A1 6/2011 Fiset
2011/0152979 A1 6/2011 Driscoll et al.
2011/0155621 A1 6/2011 Lindquist et al.
2011/0174993 A1 7/2011 Blain
2011/0179807 A1 7/2011 Holloway
2011/0180527 A1 7/2011 Abbott
2011/0198255 A1 8/2011 Baumfalk et al.
2011/0247356 A1 10/2011 Krosse et al.
2011/0259871 A1 10/2011 Li
2011/0265562 A1 11/2011 Li
2012/0061050 A1 3/2012 Petrillo et al.
2012/0064470 A1 3/2012 Delattre et al.
2012/0082766 A1 4/2012 Maupin et al.
2012/0090333 A1 4/2012 DellaMorte et al.
2012/0103562 A1 5/2012 Alexander
2012/0118874 A1 5/2012 Williams et al.
2012/0132646 A1 5/2012 England et al.
2012/0138597 A1 6/2012 Quella et al.
2012/0152511 A1 6/2012 Chang et al.
2012/0193999 A1 8/2012 Zeine
2012/0235505 A1 9/2012 Schatz et al.
2012/0235636 A1 9/2012 Partovi
2012/0248095 A1 10/2012 Lee et al.
2012/0248096 A1 10/2012 Lee et al.
2012/0255946 A1 10/2012 Kim et al.
2012/0256585 A1 10/2012 Partovi et al.
2012/0258229 A1 10/2012 Mindrup
2012/0285180 A1* 11/2012 Wilkinson ..... F25B 21/02 62/3.62
2012/0312031 A1 12/2012 Olsen
2012/0319500 A1 12/2012 Beart et al.
2013/0059259 A1 3/2013 Oldani
2013/0103463 A1 4/2013 Briar et al.
2013/0128915 A1 5/2013 Aschauer et al.
2013/0167730 A1 7/2013 Behm
2013/0180563 A1 7/2013 Makansi
2013/0200064 A1 8/2013 Alexander
2013/0206015 A1 8/2013 Jacoby et al.
2013/0221013 A1 8/2013 Kolowich et al.
2013/0239607 A1 9/2013 Kelly
2013/0245991 A1 9/2013 Kriss
2013/0255306 A1 10/2013 Mayer
2013/0255824 A1 10/2013 Williams et al.
2013/0273752 A1 10/2013 Rudisill
2013/0275075 A1 10/2013 Johnson
2013/0287967 A1 11/2013 Alexander
2013/0306656 A1 11/2013 Eckhoff
2014/0137570 A1 5/2014 Hauck et al.
2014/0150464 A1 6/2014 Bloedow
2014/0165607 A1 6/2014 Alexander
2014/0230484 A1 8/2014 Yavitz
2014/0238985 A1 8/2014 Sweeney et al.
2014/0305927 A1 10/2014 Alexander
2014/0318153 A1* 10/2014 Llercil ..... F25D 11/00 62/3.3
2014/0338713 A1 11/2014 Nakanuma
2014/0352329 A1 12/2014 Bloedow et al.
2015/0024349 A1 1/2015 Bischoff
2015/0122688 A1 5/2015 Dias
2015/0205625 A1 7/2015 Pearson et al.
2015/0245723 A1 9/2015 Alexander
2015/0321195 A1 11/2015 Malik et al.
2015/0335184 A1 11/2015 Balachandran
2015/0349233 A1 12/2015 Span et al.
2016/0035957 A1 2/2016 Casey
2016/0111622 A1 4/2016 Lee et al.
2016/0183730 A1 6/2016 Bedi
2016/0214783 A1 7/2016 Xie
2016/0341455 A1 11/2016 Yamashita
2017/0056289 A1 3/2017 Tsuno
2017/0108261 A1 4/2017 Broussard
2017/0150840 A1 6/2017 Park
2017/0177883 A1 6/2017 Paterra et al.
2017/0180368 A1 6/2017 Paterra
2017/0206497 A1 7/2017 Kriss
2017/0259956 A1 9/2017 Hori
2017/0271570 A1 9/2017 Marc
2017/0290741 A1 10/2017 Chou et al.
2017/0336134 A1 11/2017 Williams
2017/0372260 A1 12/2017 Desmarais et al.
2018/0001015 A1 1/2018 Ziegner
2018/0023865 A1 1/2018 Ilercil
2018/0035625 A1 2/2018 Lindbo
2018/0036202 A1 2/2018 Wengreen
2018/0039940 A1 2/2018 Varga
2018/0061162 A1 3/2018 High et al.
2018/0075753 A1 3/2018 Joao
2018/0175272 A1 6/2018 Imai et al.
2018/0225464 A1 8/2018 Paterra
2018/0266739 A1 9/2018 Godbole
2018/0320947 A1 11/2018 Jain et al.
2018/0327165 A1 11/2018 Lee, Sr. et al.
2018/0352796 A1 12/2018 Chattman
2018/0353379 A1 12/2018 Chou et al.
2019/0003757 A1* 1/2019 Miros ..... G06Q 10/08
2019/0003781 A1 1/2019 Caniere et al.
2019/0039811 A1 2/2019 Kuhn et al.
2019/0145688 A1 5/2019 Tsuno
2019/0263219 A1 8/2019 Spath
2019/0277553 A1 9/2019 Vlahinos
2019/0303862 A1* 10/2019 Bollinger ..... G06F 3/04886
2019/0359411 A1 11/2019 Fallgren
2019/0373755 A1 12/2019 Paterra
2019/0390890 A1 12/2019 Alexander
2020/0041197 A1 2/2020 Kim
2020/0045959 A1 2/2020 Hoffmann et al.
2020/0224964 A1 7/2020 Alexander
2020/0309442 A1 10/2020 Scully, Jr. et al.
2020/0361690 A1 11/2020 Sanders et al.
2021/0169740 A1 6/2021 Janzen et al.
2023/0025634 A1 1/2023 Alexander

FOREIGN PATENT DOCUMENTS

CN 1502513 A 6/2004
CN 2708795 Y 7/2005
CN 1748112 A 3/2006
CN 1776992 A 5/2006
CN 2922666 Y 7/2007
CN 101069606 A 11/2007
CN 101109795 A 1/2008
CN 201042350 Y 4/2008
CN 201076180 6/2008
CN 201308643 10/2008
CN 101317048 A 12/2008
CN 201237271 5/2009
CN 101507261 A 8/2009
CN 201303850 Y 9/2009
CN 201445353 U 5/2010
CN 101820128 A 9/2010
CN 201612420 U 10/2010
CN 102 164 526 A 8/2011
CN 102802294 5/2012
CN 102620467 A 8/2012
CN 202681700 1/2013
CN 202919767 U 5/2013
CN 102266184 B 10/2013
CN 203468187 U 3/2014
CN 104723934 A 6/2015
CN 108291760 A 7/2018
CN 108 974 637 A 12/2018
CN 109103956 A 12/2018
DE 19744526 4/1999
DE 20108363 8/2001
DE 20314416 1/2004
EP 0332355 9/1989
EP 0722708 7/1996
EP 0895772 2/1999

(56) References Cited

FOREIGN PATENT DOCUMENTS

| | | | |
|---|---|---|---|
| EP | 1 034 407 | A1 | 9/2000 |
| EP | 1 701 313 | A2 | 9/2006 |
| EP | 2022727 | A1 | 2/2009 |
| EP | 2165243 | | 3/2010 |
| EP | 2 273 250 | A1 | 12/2011 |
| EP | 2001761 | | 1/2012 |
| EP | 2308771 | | 6/2012 |
| EP | 2852540 | B1 | 7/2016 |
| EP | 3 109 574 | A1 | 12/2016 |
| EP | 3295098 | A2 | 3/2018 |
| EP | 3189944 | B1 | 6/2018 |
| EP | 3 531 354 | A1 | 8/2019 |
| EP | 3491301 | B1 | 4/2020 |
| FR | 2737380 | | 1/1997 |
| FR | 2752377 | | 2/1998 |
| FR | 2763463 | | 11/1998 |
| FR | 2828082 | | 2/2003 |
| GB | 1311955 | A | 3/1973 |
| GB | 2 304 179 | A | 3/1997 |
| GB | 2390798 | A | 1/2004 |
| GB | 2414922 | A | 12/2005 |
| GB | 2441825 | | 3/2008 |
| IN | 02555CN2012 | A | 5/2013 |
| JP | S54-147575 | U | 4/1953 |
| JP | S63-249519 | A | 10/1988 |
| JP | H05-306472 | A | 11/1993 |
| JP | H06-021549 | U | 3/1994 |
| JP | H10-146276 | U | 6/1998 |
| JP | 11-268777 | | 10/1999 |
| JP | 2000-279302 | A | 10/2000 |
| JP | 2001-524657 | A | 12/2001 |
| JP | 2002-516228 | A | 6/2002 |
| JP | 3 302626 | B2 | 7/2002 |
| JP | 2003-106728 | A | 4/2003 |
| JP | 2003-299255 | A | 10/2003 |
| JP | 3102537 | U | 7/2004 |
| JP | 2004-261493 | A | 9/2004 |
| JP | 3594343 | B2 | 11/2004 |
| JP | H 8142543 | A | 11/2004 |
| JP | 2006-345957 | | 6/2005 |
| JP | 2005-308353 | A | 11/2005 |
| JP | 2006-068152 | | 3/2006 |
| JP | 2006-102234 | A | 4/2006 |
| JP | 2006-166522 | A | 6/2006 |
| JP | 2007-064557 | A | 3/2007 |
| JP | 2007139328 | A | 6/2007 |
| JP | 2007-312932 | | 12/2007 |
| JP | 2008-173464 | A | 7/2008 |
| JP | 3153007 | U | 7/2009 |
| JP | 2009-288234 | A | 12/2009 |
| JP | 2010-527226 | A | 8/2010 |
| JP | 2011-171205 | | 9/2011 |
| JP | 2012-523085 | A | 9/2012 |
| JP | 5127819 | | 1/2013 |
| JP | 5481388 | | 4/2014 |
| JP | 2017-122521 | A | 7/2017 |
| KR | 200 390 049 | Y1 | 7/2005 |
| KR | 10-2015-0051074 | A | 5/2015 |
| WO | WO 2003/073030 | A1 | 9/2003 |
| WO | WO 2004/055654 | A2 | 7/2004 |
| WO | WO 2008/028329 | | 3/2008 |
| WO | WO 2008/065175 | | 6/2008 |
| WO | WO 2008/137996 | | 11/2008 |
| WO | WO 2008/155538 | A2 | 12/2008 |
| WO | WO 2009/138930 | | 11/2009 |
| WO | WO 2010/132627 | A2 | 11/2010 |
| WO | WO 2011/131595 | A2 | 10/2011 |
| WO | WO 2012/104665 | | 8/2012 |
| WO | WO 2014/158655 | A2 | 10/2014 |
| WO | WO 2015/125790 | A1 | 8/2015 |
| WO | WO 2016/168523 | A1 | 10/2016 |
| WO | WO 2016/193480 | A1 | 12/2016 |
| WO | WO 2018/016238 | A1 | 1/2018 |
| WO | WO 2018 197049 | A1 | 11/2018 |
| WO | WO 2018/222645 | A1 | 12/2018 |
| WO | WO 2019/204660 | A1 | 10/2019 |

OTHER PUBLICATIONS

Canadian Office Action, regarding Application No. 3,178,289, PCT No. 2021023498, dated Apr. 8, 2024, 3 pages.

* cited by examiner

110M

110M

110M

110M

110M

Alert the user it is time to recharge the device

Alert the user the device's temperature is too hot and needs to be stored in a cooler environment

PORTABLE COOLER WITH ACTIVE TEMPERATURE CONTROL

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57 and should be considered a part of this specification.

BACKGROUND OF THE INVENTION

Field of the Invention

The invention is directed to a portable cooler (e.g., for medicine such as insulin, vaccines, epinephrine, etc.), and more particularly to a portable cooler with active temperature control.

Description of the Related Art

Certain medicine needs to be maintained at a certain temperature or temperature range to be effective (e.g., to maintain potency). Once potency of medicine (e.g., a vaccine, insulin, epinephrine) is lost, it cannot be restored, rendering the medicine ineffective and/or unusable. For example, injector pens are commonly used to deliver medication, such as epinephrine to counteract the effects of an allergic reaction (e.g., due to a peanut allergy, insect stings/bites, etc.). Users sometimes carry such medicine (e.g., medicine injector pens, cartridges for injector pens) with them (e.g., in a bag, purse, pocket, etc.) in the event they suffer an allergic reaction during the day. However, such medicine may be exposed to varying temperatures during the day (e.g., due to ambient temperature conditions, temperature conditions in the car, workplace, school, etc.), which can be outside the preferred temperature or temperature range for the medicine to be effective.

SUMMARY

Accordingly, there is a need for improved portable cooler designs (e.g., for storing and/or transporting medicine, such as epinephrine, vaccines, insulin, etc.) that can maintain the contents of the cooler at a desired temperature or temperature range. Additionally, there is a need for an improved portable cooler design with improved cold chain control and record keeping of the temperature history of the contents (e.g., medicine, such as epinephrine, vaccines, insulin, etc.) of the cooler (e.g., during storage and/or transport of the medicine, such as during a commute to work or school).

In accordance with one aspect, a portable cooler container (e.g., capsule) with active temperature control system is provided. The active temperature control system is operated to heat or cool a chamber of a vessel to approach a temperature set point suitable for a medication (e.g., epinephrine, insulin, vaccines, etc.) stored in the cooler container.

In accordance with another aspect, a portable cooler (or capsule) is provided that includes a temperature control system operable (e.g., automatically operable) to maintain the chamber of the cooler at a desired temperature or temperature range for a prolonged period of time. Optionally, the portable cooler is sized to house one or more containers (e.g., injector pens and/or cartridges for injector pens, vials, etc.). Optionally, the portable cooler automatically logs (e.g., stores on a memory of the cooler) and/or communicates data on one or more sensed parameters (e.g., of the temperature of the chamber, battery charge level, etc.) to a remote electronic device (e.g., remote computer, mobile electronic device such as a smartphone or tablet computer). Optionally, the portable cooler can automatically log and/or transmit the data to the remote electronic device (e.g., automatically in real time, periodically at set intervals, etc.).

In accordance with another aspect, a portable cooler container (e.g., capsule) with active temperature control is provided. The container comprises a container body having a chamber configured to receive and hold one or more containers (e.g., injector pens, cartridges for injector pens, vials, etc.), the chamber defined by a base and an inner peripheral wall of the container body. The container also comprises a temperature control system comprising one or more thermoelectric elements (e.g., Peltier elements) configured to actively heat or cool a heat sink component in thermal communication (e.g., in contact with) the one or more containers (e.g., medicine containers) in the chamber, and circuitry configured to control an operation of the one or more thermoelectric elements to heat or cool at least a portion of the heat sink component and/or chamber to a predetermined temperature or temperature range.

Optionally, the container can include one or more batteries configured to provide power to one or both of the circuitry and the one or more thermoelectric elements.

Optionally, the circuitry is further configured to wirelessly communicate with a cloud-based data storage system (e.g., remote server) or a remote electronic device (e.g., smartphone, tablet computer, laptop computer, desktop computer).

Optionally, the container includes a first heat sink in thermal communication with the chamber, the first sink being selectively thermally coupled to the one or more thermoelectric elements. Optionally, the first heat sink can removably extend into the chamber of the container and one or more containers (e.g., medicine containers, such as injector pens, cartridges for injector pens, vials, etc.) can releasably couple to the first heat sink (e.g., to one or more clip portions or slots of the first heat sink) so that the one or more containers are disposed in the chamber.

Optionally, the container includes a second heat sink in communication with the one or more thermoelectric elements (TECs), such that the one or more TECs are disposed between the first heat sink and the second heat sink.

Optionally, the second heat sink is in thermal communication with a fan operable to draw heat from the second heat sink.

In one implementation, such as where the ambient temperature is above the predetermined temperature or temperature range, the temperature control system is operable to draw heat from the first heat sink (and draw heat from the chamber), which transfers said heat to the one or more TECs, which transfer said heat to the second heat sink, where the optional fan dissipates heat from the second heat sink. The temperature control system can in this manner cool the first heat sink (and the chamber), thereby cooling the containers (e.g., medicine containers) in the chamber toward the predetermined temperature or temperature range.

In another implementation, such as where the ambient temperature is below the predetermined temperature or temperature range, the temperature control system is operable to add heat to the first heat sink (and add heat to the chamber), which transfers said heat from the one or more TECs. The temperature control system can in this matter heat the first heat sink (and the chamber), thereby heating the containers (e.g., medicine containers) in the chamber toward the predetermined temperature or temperature range.

DETAILED DESCRIPTION

Figure 1:
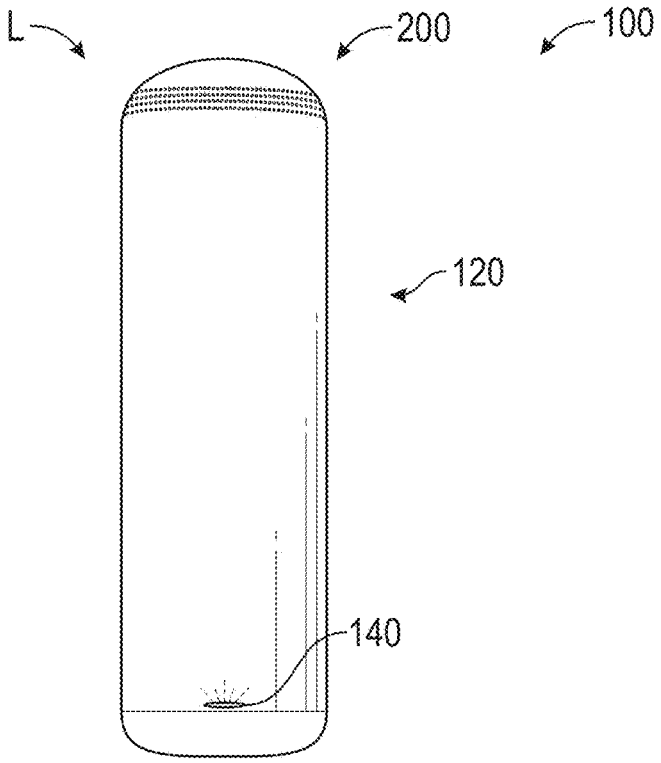
FIG. 1 is a schematic view of one embodiment of a cooler container.

FIGS. 1-8 show a container system 100 (e.g., capsule container) that includes a cooling system 200. Optionally, the container system 100 has a container vessel 120 that is optionally cylindrical and symmetrical about a longitudinal axis Z, and one of ordinary skill in the art will recognize that the features shown in cross-section in FIGS. 4, 7 and 8 defined by rotating them about the axis Z to define the features of the container 100 and cooling system 200.

The container vessel 120 is optionally a cooler with active temperature control provided by the cooling system 200 to cool the contents of the container vessel 120 and/or maintain the contents of the vessel 120 in a cooled or chilled state. Optionally, the vessel 120 can hold therein one or more (e.g., a plurality of) separate containers 150 (e.g., medicine containers, such as injector pens, vials, cartridges (such as for injector pens), etc.). Optionally, the one or more (e.g., plurality of) separate containers 150 that can be inserted into the container vessel 120 can contain a medication or medicine (e.g., epinephrine, insulin, vaccines, etc.).

Figure 4:
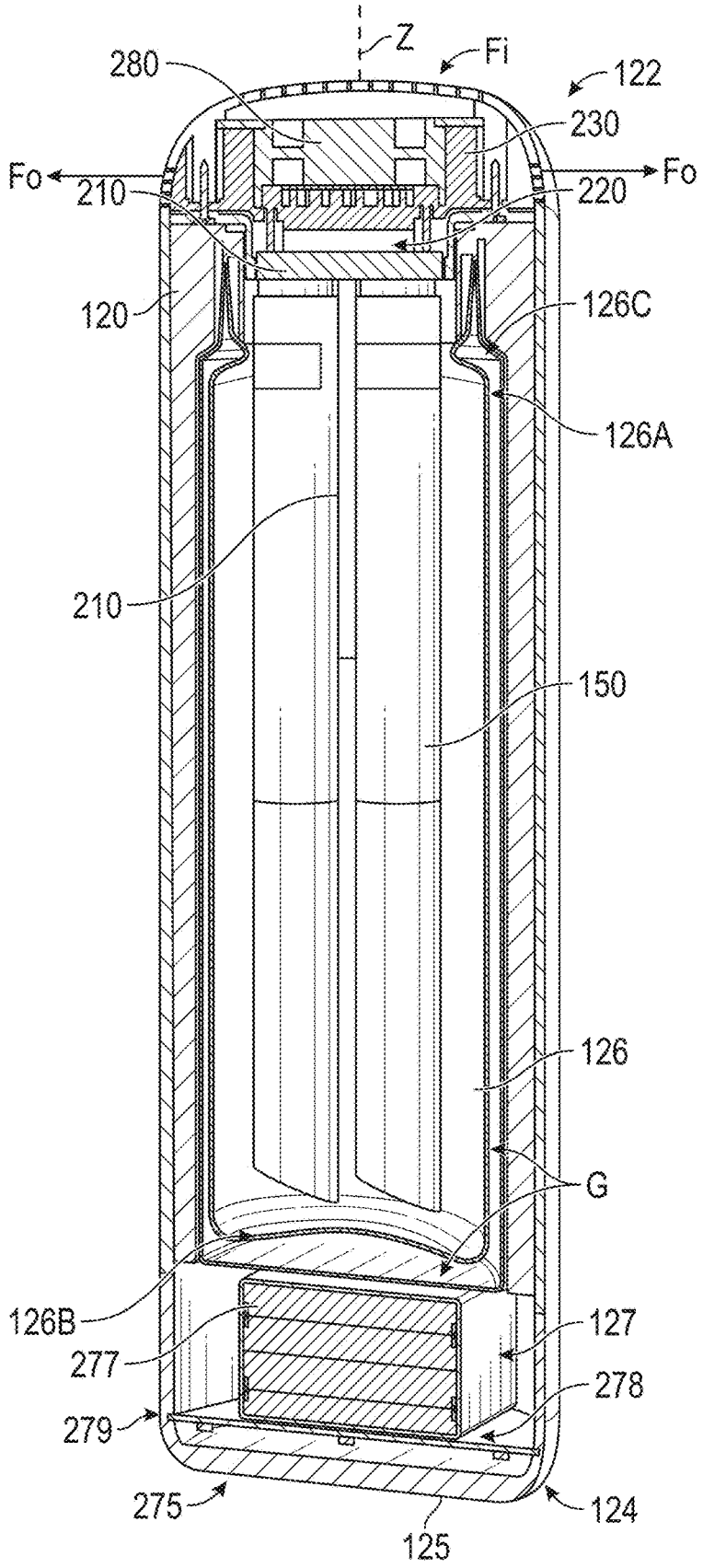
FIG. 4 is a schematic cross-sectional view of the cooler container of FIG. 1.
Figure 5:
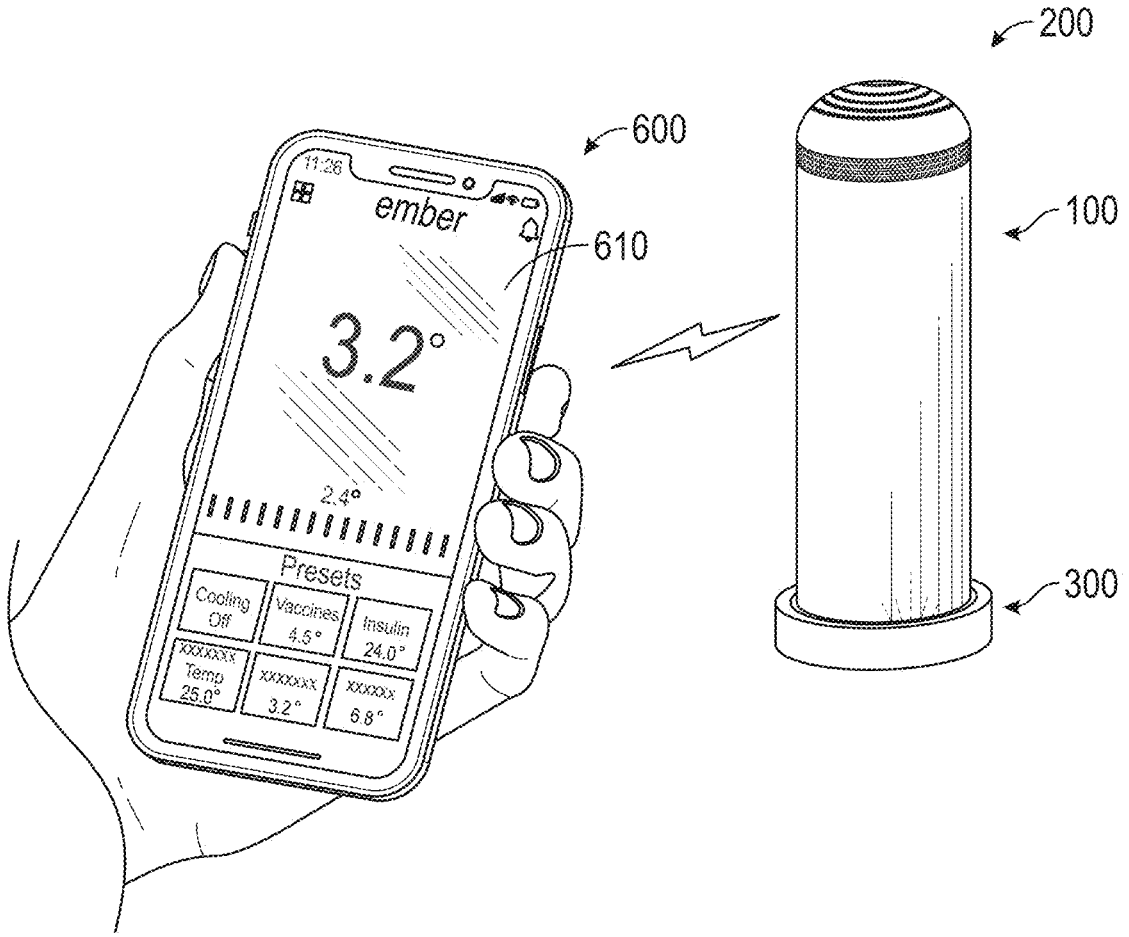
FIG. 5 is a schematic view of the cooler container of FIG. 1 in communication with a remote electronic device.

The container vessel 120 has an outer wall 121 that extends between a proximal end 122 that has an opening 123 and a distal end 124 having a base 125. The opening 123 is selectively closed by a lid L removably attached to the proximal end 122. As shown in FIG. 4, the vessel 120 has an inner wall 126A and a base wall 126B that together define an open chamber 126 that can receive and hold contents to be cooled therein (e.g., medicine containers, such as one or more vials, cartridges, injector pens, etc.). The vessel 120 can optionally have an intermediate wall 126C spaced about the inner wall 126A and base wall 126B, such that the intermediate wall 126C is at least partially disposed between the outer wall 121 and the inner wall 126A. The intermediate wall 126C is spaced apart from the inner wall 126A and base wall 126B so as to define a gap G between the intermediate wall 126C and the inner wall 126A and base wall 126B. The gap G can optionally be under vacuum so that the inner wall 126A and base 126B are vacuum insulated relative to the intermediate wall 126C and the outer wall 121 of the vessel 120.

Optionally, one or more of the inner wall 126A, intermediate wall 126C and outer wall 121 can be made of metal (e.g., stainless steel). In one implementation, the inner wall 126A, base wall 126B and intermediate wall 126C are made of metal (e.g., stainless steel). In another implementation, one or more portions (e.g., outer wall 121, intermediate wall 126C and/or inner wall 126A) of the vessel 120 can be made of plastic.

The vessel 120 has a cavity 127 between the base wall 126B and a bottom 275 of the vessel 120. The cavity 127 can optionally house one or more batteries 277, and one or more printed circuit boards (PCBA) 278 with circuitry that controls the cooling system 200. In one implementation, the cavity 127 can optionally house a power button or switch actuatable by a user through the bottom of the vessel 275, as further described below. Optionally, the bottom 275 defines at least a portion of an end cap 279 attached to the outer wall 121. Optionally, the end cap 279 is removable to access the electronics in the cavity 127 (e.g., to replace the one or more batteries 277, perform maintenance on the electronics, such as the PCBA 278, etc.). The power button or switch is accessible by a user (e.g., can be pressed to turn on the cooling system 200, pressed to turn off the cooling system 200, pressed to pair the cooling system 200 with a mobile electronic device, etc.). Optionally, the power switch can be located generally at the center of the end cap 279 (e.g., so that it aligns/extends along the longitudinal axis Z of the vessel 120).

With continued reference to FIGS. 1-8, the cooling system 200 is optionally at least partially housed in the lid L that releasably closes the opening 123 of the vessel 120. In one implementation, the lid L can releasably couple to the vessel 120 via one or more magnets in the lid L and/or in the vessel 120. In other implementations, the lid L can releasably couple to the vessel 120 via other suitable mechanisms (e.g., threaded connection, key-slot connection, press-fit connection, etc.)

In one implementation, the cooling system 200 can include a first heat sink (cold side heat sink) 210 in thermal communication with one or more thermoelectric elements (TECs) 220, such as Peltier element(s), and can be in thermal communication with the chamber 126 of the vessel 120 (e.g., via contact with the inner wall 126A, via conduction with air in the chamber 126, etc.). Optionally, cooling system 200 can include an insulator member (e.g., insulation material) disposed between the first heat sink 210 and a second heat sink 230.

With continued reference to FIGS. 1-8, the TEC 220 is selectively operated (e.g., by the circuitry 278) to draw heat from the first heat sink (e.g., cold-side heat sink) 210 and transfer it to the second heat sink (hot-side heat sink) 230. A fan 280 is selectively operable to draw air into the lid L to dissipate heat from the second heat sink 230, thereby allowing the TEC 220 to draw further heat from the first heat sink 210, and thereby draw heat from the chamber 126. During operation of the fan 280, intake air flow Fi is drawn through one or more intake vents 203 (having one or more openings 203A) in the lid L and over the second heat sink 230 (where the air flow removes heat from the second heat sink 230), after which the exhaust air flow Fo flows out of one or more exhaust vents 205 (having one or more openings 205A) in the lid L.

As shown in FIG. 4, the chamber 126 optionally receives and holds one or more (e.g., a plurality of) containers 150 (e.g., medicine containers, such as injector pens or cartridges for injector pens, vials, etc.). The first heat sink 210 can define one or more slots 211 that can receive and hold (e.g., resiliently receive and hold) one or more of the containers 150. Therefore, during operation of the cooling system 200, the first heat sink 210 is cooled, which thereby cools the one or more containers 150 coupled to the heat sink 210. In one implementation, the first heat sink 210 can be made of aluminum. However, the first heat sink 210 can be made of other suitable materials (e.g., metals with high thermal conductivity).

Figure 3:
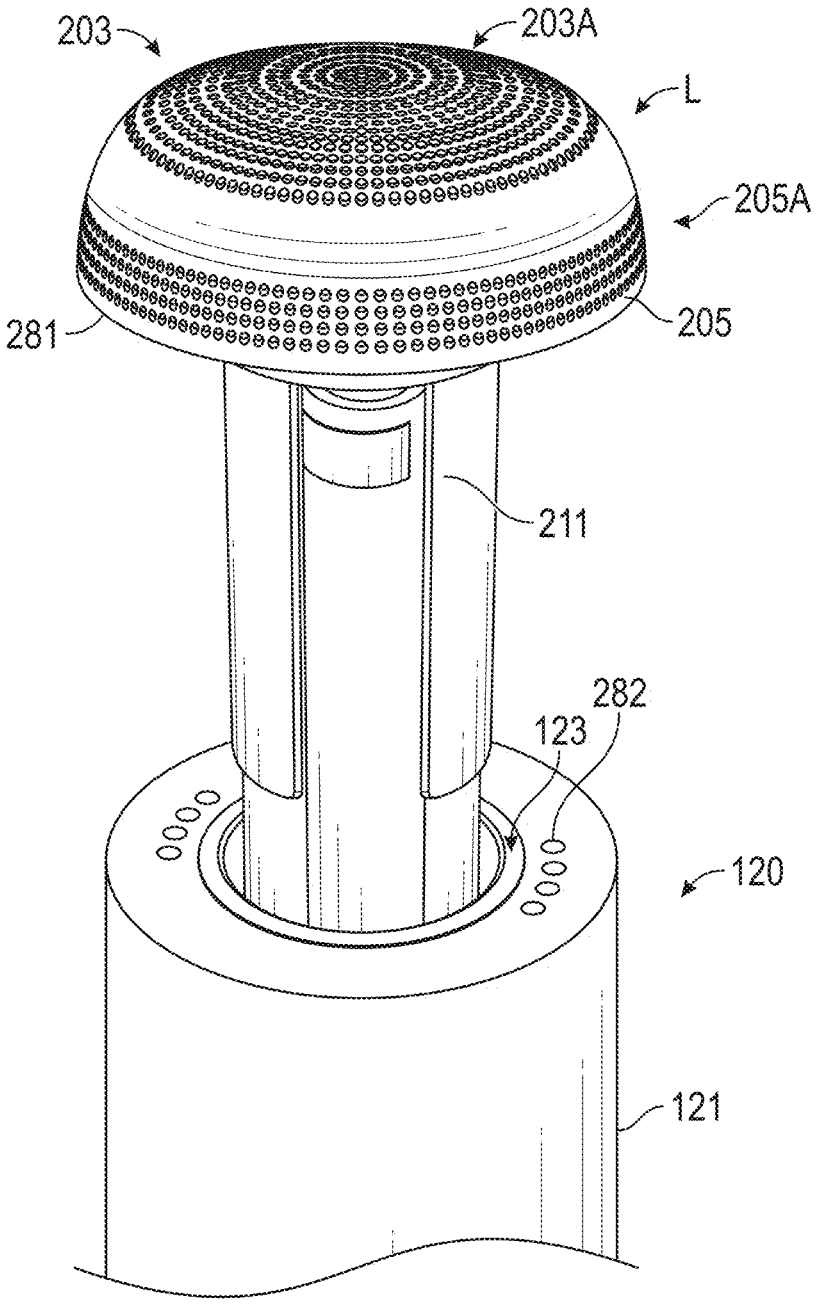
FIG. 3 is a partial view of the cooler container of FIG. 1, with a lid detached from the vessel of the cooler container, with three injector pens and/or cartridges coupled to the heat sink attached to the lid.

The electronics (e.g., PCBA 278, batteries 277) can electrically communicate with the fan 280 and TEC 220 in the lid L via one or more electrical contacts (e.g., electrical contact pads, Pogo pins) 281 in the lid L (e.g., downward facing electrical contacts, contact pads or Pogo pins) that contact one or more electrical contacts (e.g., Pogo pins, electrical contact pads) 282 in the portion of the vessel 120 (e.g., upward facing electrical contacts, contact pads or Pogo pins) that engages the lid L. Advantageously, the electrical contacts 281, 282 facilitate the coupling of the lid L to the vessel 120, 120' in the correct orientation (alignment) to allow the contact between the electrical contacts 282, 281 (e.g., provide a clocking feature). As shown in FIG. 3, the one or more electrical contacts 282 can be a set of eight contacts 282 that interface with an equal number of electrical contacts 281 in the lid L. However, different number of electrical contacts 282, 281 are possible. Electrical leads can extend from the PCBA 278 along the side of the vessel 120 (e.g., between the outer wall 121 and the intermediate wall 126C) to the electrical contacts 282. Accordingly, power can be provided from the batteries 277 to the TEC 220 and/or fan 280, and the circuitry (e.g., in or on the PCBA 278) can control the operation of the TEC 220 and/or fan 280, via one or more of the electrical contacts 281, 282 when the lid L is coupled to the vessel 120. As further discussed below, the lid L can have one or more sensors, and such sensors can communicate with the circuitry (e.g., in or on the PCBA 278) via one or more of the electrical contacts 281, 282.

Figure 6:
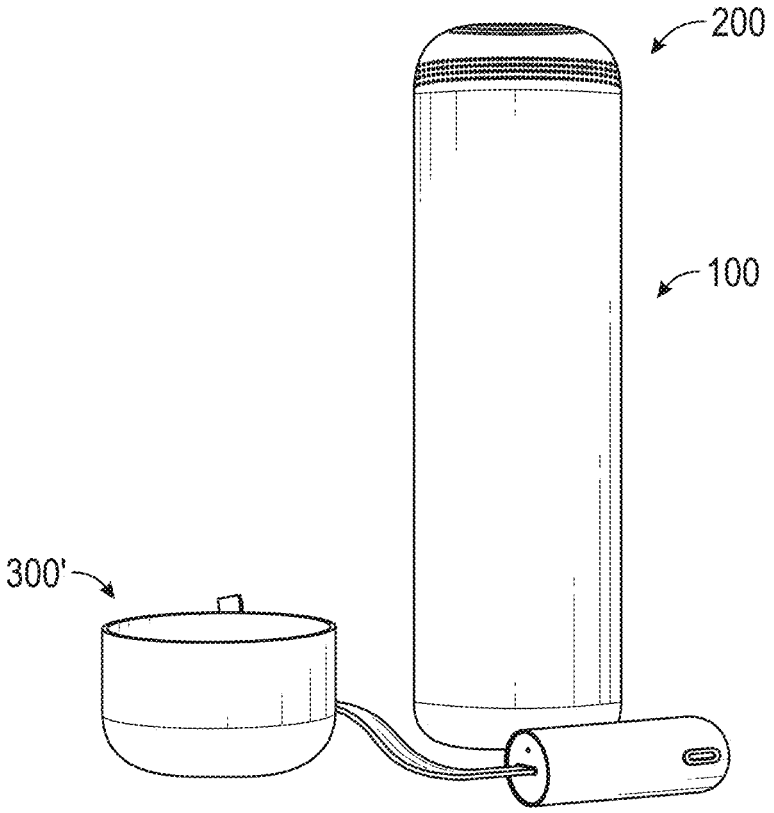
FIG. 6 is a schematic view of the cooler container of FIG. 1 and another embodiment of a charging base.
Figure 7:
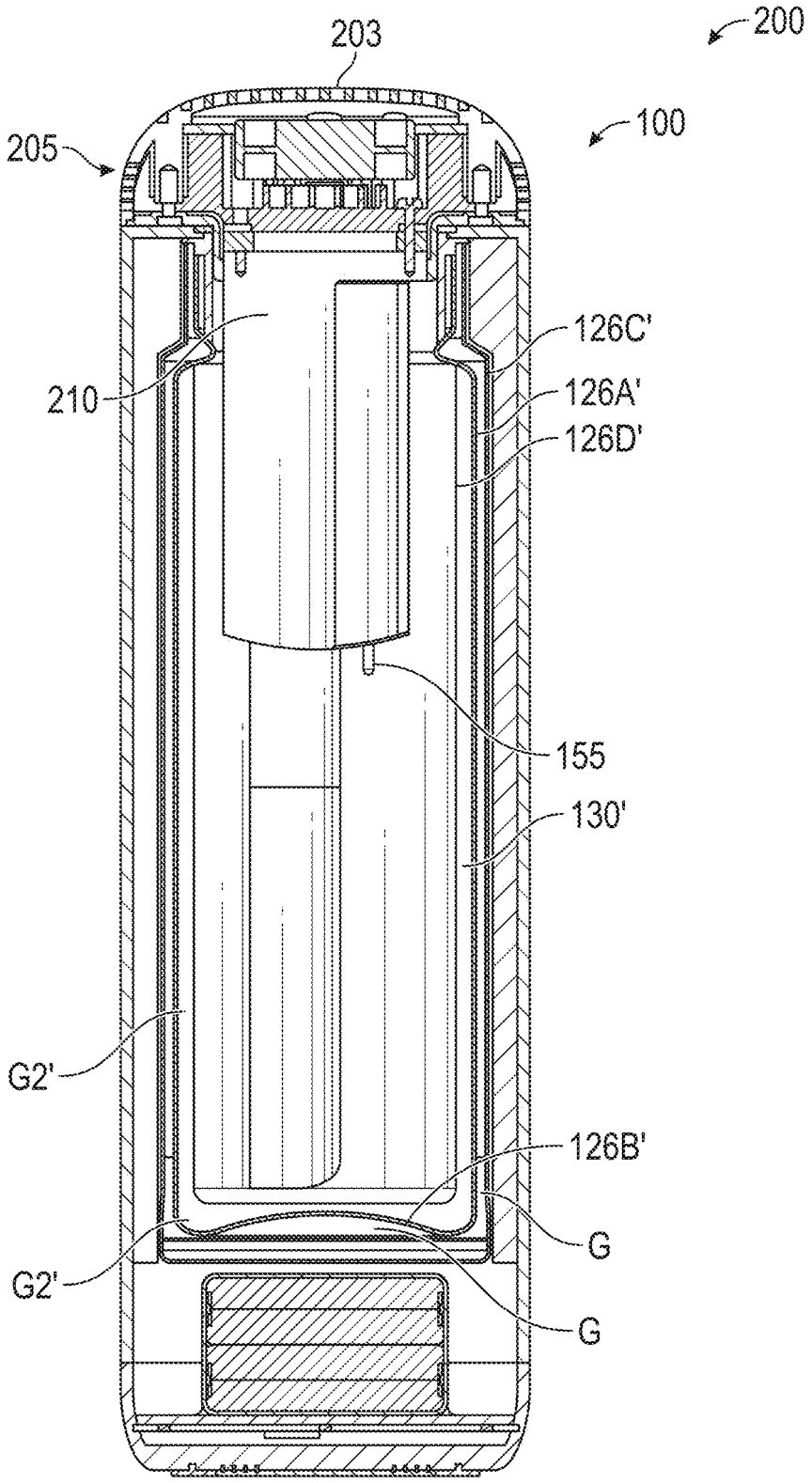
FIG. 7 is a schematic cross-sectional view of another embodiment of a cooler container.
Figure 8:
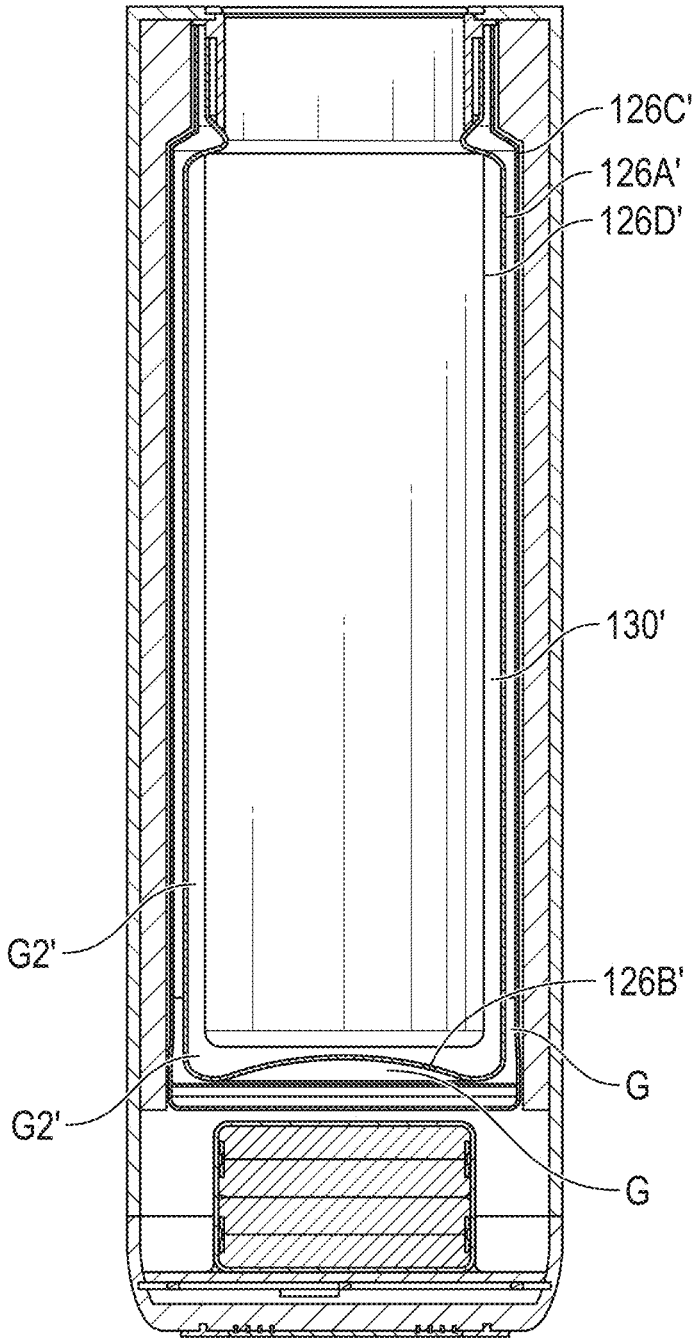
FIG. 8 is a schematic cross-sectional view of a vessel of the cooler container of FIG. 7 without the lid.

FIGS. 7-8 schematically illustrate the container system 100 with the cooling system 200 and a vessel 120'. The cooling system 200 is similar to the cooling system 200 in the container 100 of FIGS. 1-7. Some of the features of the vessel 120' are similar to features in the vessel 120 in FIGS. 1-7. Thus, references numerals used to designate the various components of the vessel 120' are identical to those used for identifying the corresponding components of the vessel 120 in FIGS. 1-7, except that a "'" is added to the numerical identifier. Therefore, the structure and description for the various components of the cooling system 200 and vessel 120 in FIGS. 1-7 are understood to also apply to the corresponding components of the cooling system 200 and vessel 120' in FIGS. 7-8, except as described below.

As shown in FIGS. 7-8, the vessel 120' includes a cylindrical chamber wall 126D' that defines the chamber 126' and is spaced inward (e.g., toward the center of the chamber 126) of the inner wall 126A' and the base wall 126B' so as to define a gap G2' between the chamber wall 126D' and the inner wall 126A' and base wall 126B'. optionally, the gap G2' is filled with a phase change material (PCM) 130'. In one implementation, the phase change material 130' can be a solid-fluid PCM. In another implementation, the phase change material 130' can be a solid-solid PCM. The PCM 130' advantageously can passively absorb and release energy. Examples of possible PCM materials are water (which can transition to ice when cooled below the freezing temperature), organic PCMs (e.g., bio based or Paraffin, or carbohydrate and lipid derived), inorganic PCMs (e.g., salt hydrates), and inorganic eutectics materials. However, the PCM 130' can be any thermal mass that can store and release energy.

In operation, the cooling system 200 can be operated to cool the heat sink 210 to cool the one or more containers 150 that are coupled to the heat sink 210, and to also cool the chamber 126'. The cooling system 200 can optionally also cool the PCM 130' (e.g., via the chamber wall 126D'). In one implementation, the cooling system 200 optionally cools the PCM 130' via conduction (e.g., contact) between at least a portion of the heat sink 210 and at least a portion of the chamber wall 126D' (e.g., near the opening 123' of the vessel 120'). In another implementation, the cooling system 200 optionally cools the PCM 130' via conduction through the air in the chamber 126' between the heat sink 210 and the chamber wall 126D'.

Advantageously, the PCM 130' operates as a secondary (e.g., backup) cooling source for the chamber 126' and/or the containers 150' (e.g., medicine containers, such as injector pens, cartridges for injector pens, vials, etc.) disposed in the chamber 126'. For example, if the one or more intake vents 203 are partially (or fully) blocked (e.g., because they are up against a surface of a handbag, backpack, suitcase, during travel; due to dust accumulation in the vent openings 203A) or if the cooling system 200 is not operating effectively due to low charge in the one or more batteries 277, the PCM 130' can maintain the one or more containers 150 (e.g., injector pens, cartridges for injector pens, vials, etc.) in a cooled state until the vents 203 are unblocked/unclogged, one or more batteries 277 are charged, etc. Though the phase change material 130' is described in connection with the chamber 126' and container system 100, 100E, 100F, 100G, 100H, 100I, 100J, 100K, 100L, 100M one of skill in the art will recognize that it can also be applied to all the other implementations discussed herein for the chamber 126, 126' 126E, 126F1, 126F2, 126G1, 126H, 126I, 126J, 126K and container system 100, 100E, 100F, 100G, 100H, 100I, 100J, 100K, 100L, 100M.

The container system 100, 100E, 100F, 100G, 100H, 100I, 100J, 100K, 100L, 100M disclosed herein can optionally communicate (e.g., one-way communication, two-way communication) with one or more remote electronic devices (e.g., mobile phone, tablet computer, desktop computer, remote server) 600, via one or both of a wired or wireless connection (e.g., 802.11b, 802.11a, 802.11g, 802.11n standards, etc.). Optionally, the container system 100, 100E, 100F, 100G, 100H, 100I, 100J, 100K, 100L, 100M can communicate with the remote electronic device 600 via an app (mobile application software) that is optionally downloaded (e.g., from the cloud) onto the remote electronic device 600. The app can provide one or more graphical user interface screens 610 via which the remote electronic device 600 can display one or more data received from the container system 100, 100E, 100F, 100G, 100H, 100I, 100J, 100K, 100L, 100L and/or information transmitted from the remote electronic device 600 to the container system 100, 100E, 100F, 100G, 100H, 100I, 100J, 100K, 100L, 100M. Optionally, a user can provide instructions to the container system 100, 100E, 100F, 100G, 100H, 100I, 100J, 100K, 100L, 100M via the one or more of the graphical user interface screens 610 on the remote electronic device 600.

In one variation, the graphical user interface (GUI) screen 610 can provide one or more temperature presets corresponding to one or more particular medications (e.g., epinephrine/adrenaline for allergic reactions, insulin, vaccines, etc.). The GUI screen 610 can optionally allow the turning on and off of the cooling system 200, 200E, 200F, 200G, 200H, 200I, 200J, 200K, 200L. The GUI screen 610 can optionally allow the setting of the control temperature to which one or both of the first heat sink 210 and the chamber 126, 126' 126E, 126F1, 126F2, 126G1, 126H, 126I, 126J, 126K, 126L in the container 100, 100E, 100F, 100G, 100H, 100I, 100J, 100K, 100L, 100M is cooled by the cooling system 200, 200E, 200F, 200G, 200H, 200I, 200J, 200K, 200L.

In another variation, the graphical user interface (GUI) screen 610 can provide a dashboard display of one or more parameters of the container 100, 100E, 100F, 100G, 100H, 100I, 100J, 100K, 100L, 100M (e.g., ambient temperature, internal temperature in the chamber 126, 126', 126' 126E, 126F1, 126F2, 126G1, 126H, 126I, 126J, 126K, 126L temperature of the first heat sink 210, temperature of the one or more batteries 277, etc.). The GUI screen 610 can optionally provide an indication (e.g., display) of power supply left in the one or more batteries 277 (e.g., % of life left, time remaining before battery power drains completely). Optionally, the GUI screen 610 can also include information (e.g., a display) of how many of the slots or receptacles 211 in the first heat sink 210 are occupied (e.g., by containers 150, 150J). Optionally, the GUI screen 610 can also include information on the contents of the container 100 (e.g., medication type, such as insulin, or disease medication is meant to treat, such as Hepatitis, etc.) and/or information (e.g., name, identification no., contact info) for the individual to whom the container 100, 100E, 100F, 100G, 100H, 100I, 100J, 100K, 100L, 100M belongs.

In another variation, the GUI screen 610 can include one or more notifications provided to the user of the container system 100, 100E, 100F, 100G, 100H, 100I, 100J, 100K, 100L, 100M disclosed herein, including alerts on battery power available, alerts on ambient temperature effect on operation of container system 100, 100E, 100F, 100G, 100H, 100I, 100J, 100K, 100L, 100M alert on temperature of the first heat sink 210, alert on temperature of the chamber 126, 126', 126E, 126F, 126G, 126H, 126I, 126J, 126K, 126L alert on low air flow through the intake vent 203 and/or exhaust vent 205 indicating they may be blocked/clogged, etc. One of skill in the art will recognize that the app can provide the plurality of GUI screens 610 to the user, allowing the user to swipe between the different screens. Optionally, as discussed further below, the container system 100, 100E, 100F, 100G, 100H, 100I, 100J, 100K, 100L, 100M can communicate information, such as temperature history of the chamber 126, 126', 126E, 126F, 126G, 126H, 126I, 126J, 126K, 126L temperature history of the first heat sink 210 and/or chamber 126, 126', 126E, 126F, 126G, 126H, 126I, 126J, 126K, 126L that generally corresponds to the temperature of the containers 150, 150J, temperature of the container 150, 150J from a temperature sensor on the container 150, 150J, power level history of the batteries 277, ambient temperature history, etc. to one or more of a) an RFID tag on the container system 100, 100E, 100F, 100G, 100H, 100I, 100J, 100K, 100L, 100M that can later be read (e.g., at the delivery location), b) to a remote electronic device (e.g., a mobile electronic device such as a smartphone or tablet computer or laptop computer or desktop computer), including wirelessly (e.g., via WiFi 802.11, BLUETOOTH®, cell radio, or other RF communication), and c) to the cloud (e.g., to a cloud-based data storage system or server) including wirelessly (e.g., via WiFi 802.11, BLUETOOTH®, or other RF communication). Such communication can occur on a periodic basis (e.g., every hour; on a continuous basis in real time, etc.). Once stored on the RFID tag or remote electronic device or cloud, such information can be accessed via one or more remote electronic devices (e.g., via a dashboard on a smart phone, tablet computer, laptop computer, desktop computer, etc.). Additionally, or alternatively, the container system 100, 100E, 100F, 100G, 100H, 100I, 100J, 100K, 100L, 100M can store in a memory (e.g., part of the electronics in the container system 100, 100E, 100F, 100G, 100H, 100I, 100J, 100K, 100L, 100M) information, such as temperature history of the chamber 126, 126', 126E, 126F, 126G, 126H, 126I, 126J, 126K, 126L temperature history of the first heat sink 210, power level history of the batteries 277, ambient temperature history, etc., which can be accessed from the container system 100, 100E, 100F, 100G, 100H, 100I, 100J, 100K, 100L, 100M by the user via a wired or wireless connection (e.g., via the remote electronic device 600).

With reference to FIGS. 1-9, the body 120 of the container 100 can optionally have a visual display on the outer surface 121 of the body 120. The visual display can optionally display one or more of the temperature in the chamber 126, 126', the temperature of the first heat sink 210, the ambient temperature, a charge level or percentage for the one or more batteries 277, and amount of time left before recharging of the batteries 277 is needed, etc. The visual display can optionally include a user interface (e.g., pressure sensitive buttons, capacitance touch buttons, etc.) to adjust (up or down) the temperature preset at which the cooling system 200 is to cool the chamber 126, 126'. Accordingly, the operation of the container 100 (e.g., of the cooling system 200) can be selected via the visual display and user interface on a surface of the container 100. Optionally, the visual display can include one or more hidden-til-lit LEDs. Optionally, the visual display can include an electronic ink (e-ink) display. In one variation, the container 100 can optionally include a hidden-til-lit LED 140 that can selectively illuminate (e.g., to indicate one or more operating functions of the container 100, such as to indicate that the cooling system 200 is in operation). The LED 140 can optionally be a multi-color LED selectively operable to indicate one or more operating conditions of the container 100 (e.g., green if normal operation, red if abnormal operation, such as low battery charge or inadequate cooling for sensed ambient temperature, etc.). Though the visual display is described in connection with the container system 100, one of skill in the art will recognize that it can also be applied to all the other implementations discussed herein for the container system 100E, 100F, 100G, 100H, 100I, 100J, 100K, 100L, 100M.

In operation, the cooling system 200 can optionally be actuated by pressing a power button. Optionally, the cooling system 200 can additionally (or alternatively) be actuated remotely (e.g., wirelessly) via a remote electronic device 600, such as a mobile phone, tablet computer, laptop computer, etc. that wirelessly communicates with the cooling system 200 (e.g., with a receiver or transceiver of the circuitry 278). In still another implementation, the cooling system 200 can automatically cool the chamber 126, 126' when the lid L is coupled to the vessel 120, 120' (e.g., upon receipt by the circuitry, for example in or on the PCBA 278, of a signal, such as from a pressure sensor, proximity sensor, load sensor, light sensor) that the lid L has been coupled with the vessel 120, 120'). The chamber 126, 126' can be cooled to a predetermined and/or a user selected temperature or temperature range, or automatically cooled to a temperature preset corresponding to the contents in the containers 150 (e.g., insulin, epinephrine, vaccines, etc.). The user selected temperature or temperature range can be selected via a user interface on the container 100 and/or via the remote electronic device 600.

The circuitry 278 optionally operates the one or more TECs 220 so that the side of the one or more TECs 220 adjacent the first heat sink 210 is cooled to thereby cool the one or more containers 150 in thermal communication with (e.g., coupled to) the first heat sink 210 and so that the side of the one or more TECs 220 adjacent the one or more second heat sinks 230 is heated. The TECs 220 thereby cool the first heat sink 210 and thereby cools the containers 150 and/or the chamber 126, 126'. The container 100 can include one or more sensors (e.g., temperature sensors) 155 operable to sense a temperature of the chamber 126, 126'. As best shown in FIG. 7, the one or more sensors 155 can include a temperature sensor that extends through one or more of the prongs of the first heat sink 210 and protrudes from the first heat sink 210 into the chamber 126, 126' when the lid L is coupled to the vessel 120, 120'. The one or more sensors 155 can communicate information to the circuitry 278 indicative of the sensed temperature(s) via the one or more electrical contacts 281, 282 when the lid L is coupled to the vessel 120, 120'. The circuitry (e.g., in or on the PCBA 278) operates one or more of the TECs 220 and one or more fans 280 based at least in part on the sensed temperature information (from the one or more sensors 155) to cool the first heat sink 210 and/or the chamber 126, 126' to the predetermined temperature (e.g., temperature preset) and/or user selected temperature. The circuitry operates the one or more fans 280 to flow air (e.g., received via the intake vents 203) over the one or more second heat sinks 230 to dissipate heat therefrom, thereby allowing the one or more second heat sinks 230 to draw more heat from the one or more TECs 220, which in turn allows the one or more TEC's 220 to draw more heat from (i.e., cool) the first heat sink 210 and optionally the chamber 126, 126'. Said air flow, once it passes over the one or more second heat sinks 230, is exhausted via the exhaust vents 205.

Figure 2:
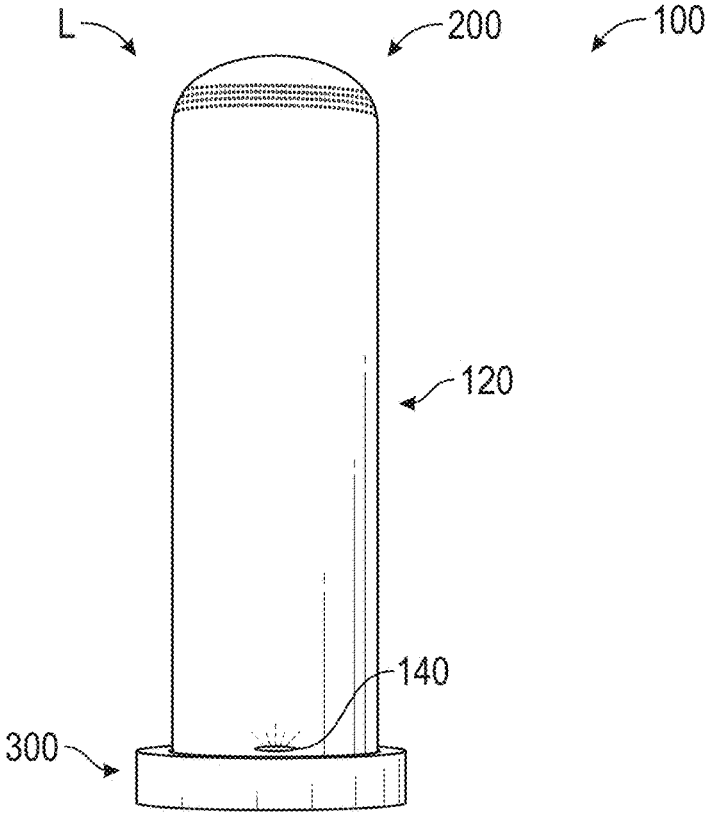
FIG. 2 is a schematic view of the cooler container of FIG. 1 on one embodiment of a charging base.

With reference to FIG. 2, a power base 300 can receive the container 100 thereon and can provide power to the electronics in the container 100 to, for example, charge the one or more batteries 277 or provide power directly to the TECs 220 and/or fan 280. In one implementation, the power base 300 has an electrical cord that ends in an electrical connector (wall plug, USB connector), which allows the power base 300 to connect to a power source (e.g., wall outlet, USB connector of power source, such as a laptop or desktop computer). In one implementation, the power base 300 transmits power to the container 100 via inductive coupling. In another implementation, the power base 300 transmits power to the container 100 via one or more electrical contacts (e.g., electrical contact pads, Pogo pins) that contact one or more electrical contacts (e.g., electrical contact pads, contact rings) on the container 100 (e.g., on the bottom 275 of the container 100).

FIG. 6 shows a power base 300' that can receive the container 100 thereon and can provide power to the electronics in the container 100 to, for example, charge the one or more batteries 277 or provide power directly to the TEC 220 and/or fan 280. The power base 300' is similar to the power base 300 except as described below. In one implementation, the power base 300' has an electrical cord that ends in an electrical connector (for a car charger), which allows the power base 300' to connect to a car charger. Advantageously, the power base 300' is sized to fit in a cup holder of an automobile, allowing the container 100 to be placed in the cupholder while on the power base 300', keeping the container 100 in a substantially stable upright orientation.

In one variation, the container system 100 is powered using 12 VDC power (e.g., from one or more batteries 277 or power base 300'). In another variation, the container system 100 is powered using 120 VAC or 240 VAC power, for example using the power base 300. The circuitry 278 in the container 100 can include a surge protector to inhibit damage to the electronics in the container 100 from a power surge.

Figure 9:
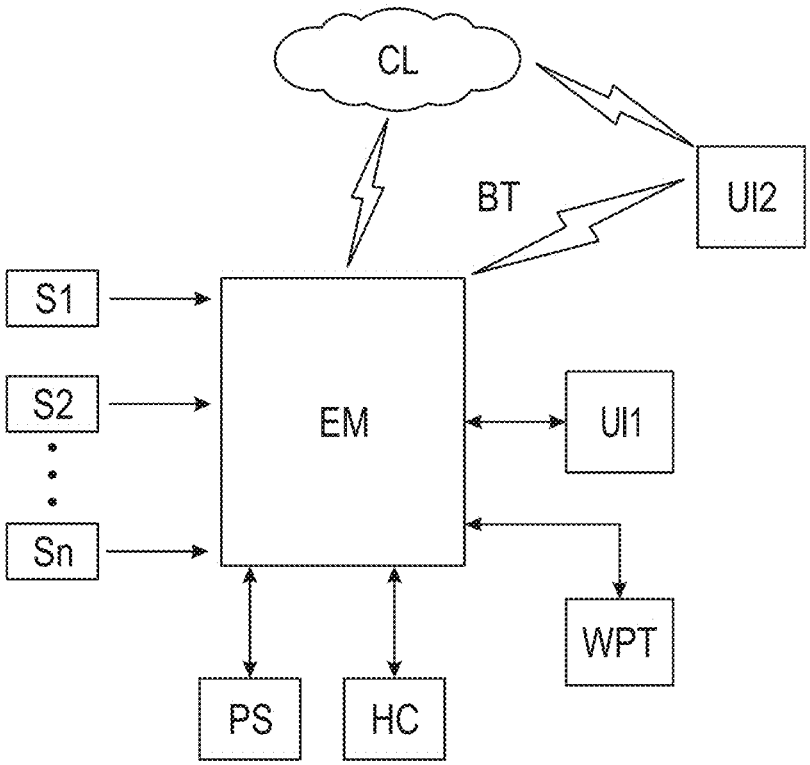
FIG. 9 is a schematic block diagram showing communication between the cooler container and a remote electronic device.

FIG. 9 shows a block diagram of a communication system for (e.g., incorporated into) the devices described herein (e.g., the one or more container systems 100, 100E, 100F, 100G, 100H, 100I, 100J, 100K, 100L, 100M). In the illustrated embodiment, circuitry EM (e.g., on the PCBA 278) can receive sensed information from one or more sensors S1-Sn (e.g., level sensors, volume sensors, temperature sensors, such as sensors 155, battery charge sensors, biometric sensors, load sensors, Global Positioning System or GPS sensors, radiofrequency identification or RFID reader, etc.). The circuitry EM can be housed in the container, such as in the vessel 120, 120', 120E, 120F, 120G, 120H, 120I, 120J, 120K (e.g., bottom of vessel 120, 120', 120E, 120F, 120G, 120H, 120I, 120J, 120K, 120L side of vessel 120, 120', 120E, 120F, 120G, 120H, 120I, 120J, 120K, 120L, 120M as discussed above) or in a lid L of the container. The circuitry EM can receive information from and/or transmit information (e.g., instructions) to one or more heating or cooling elements HC, such as the TEC 220, 220E, 220F1, 220F2, 220G, 220L (e.g., to operate each of the heating or cooling elements in a heating mode and/or in a cooling mode, turn off, turn on, vary power output of, etc.) and optionally to one or more power storage devices PS (e.g., batteries 277, 277E, 277F, 277L such as to charge the batteries or manage the power provided by the batteries to the one or more heating or cooling elements 220, 220E, 220F1, 220F2, 220G, 220L).

Optionally, the circuitry EM can include a wireless transmitter, receiver and/or transceiver to communicate with, e.g., transmit information, such as sensed temperature, position data, to and receive information, such as user instructions, from one or more of: a) a user interface UI1 on the unit (e.g., on the body of the vessel 120, 120E, 120F, 120G, 120H, 120I, 120J, 120K, 120L, 120M), b) an electronic device ED (e.g., a mobile electronic device such as a mobile phone, PDA, tablet computer, laptop computer, electronic watch, a desktop computer, remote server), c) the cloud CL (e.g., a cloud-based data storage system), or d) communicate via a wireless communication system such as WiFi and Bluetooth BT. The electronic device ED (such as electronic device 600) can have a user interface UI2 (such as GUI 610), that can display information associated with the operation of the container system, and that can receive information (e.g., instructions) from a user and communicate said information to the container system 100, 100E, 100F, 100G, 100H, 100I, 100J, 100K, 100L, 100M (e.g., to adjust an operation of the cooling system 200, 200E, 200F, 200G, 200H, 200I, 200J, 200K, 200L).

In operation, the container system 100 can operate to maintain one or both of the first heat sink 210 and the chamber 126, 126' of the vessel 120, 120' at a preselected temperature or a user selected temperature. The cooling system 200 can operate the one or more TECs 220 to cool the first heat sink 210 and, optionally the chamber 126, 126', 126E, 126F1, 126F2, 126G1, 126L (e.g., if the temperature of the first heat sink 210 or chamber 126, 126', 126E, 126F1, 126F2, 126G1, 126L is above the preselected temperature, such as when the ambient temperature is above the preselected temperature) or to heat the first heat sink 210 and, optionally chamber 126, 126', 126E, 126F1, 126F2, 126G1, 126L (e.g., if the temperature of the first heat sink 210 or chamber 126, 126', 126E, 126F1, 126F2, 126G1, 126L is below the preselected temperature, such as when the ambient temperature is below the preselected temperature). The preselected temperature may be tailored to the contents of the container (e.g., a specific medication, a specific vaccine, insulin pens, epinephrine pens or cartridges, etc.), and can be stored in a memory of the container 100, and the cooling system 200 or heating system, depending on how the temperature control system is operated, can operate the TEC 220 to approach the preselected or set point temperature.

Optionally, the circuitry EM can communicate (e.g., wirelessly) information to a remote location (e.g., cloud based data storage system, remote computer, remote server, mobile electronic device such as a smartphone or tablet computer or laptop or desktop computer) and/or to the individual carrying the container (e.g., via their mobile phone, via a visual interface on the container, etc.), such as a temperature history of the first heat sink 210, 210E1, 210E2, 210F1, 210F2, 210L and/or chamber 126, 126' 126E, 126F1, 126F2, 126G1, 126L to provide a record that can be used to evaluate the efficacy of the medication in the container and/or alerts on the status of the medication in the container 100, 100E, 100F, 100G, 100H, 100I, 100J, 100K, 100L, 100M. Optionally, the temperature control system (e.g., cooling system, heating system) 200, 200E, 200F, 200G, 200H, 200I, 200J, 200K, 200L automatically operates the TEC 220, 220E, 220F1, 220F2, 220L to heat or cool the first heat sink 210, 210E1, 210E2, 210F1, 210F2, 210L and, optionally, the chamber 126, 126', 120E, 120F1, 210F2 of the vessel 120, 120', 120E, 120F to approach the preselected temperature. In one implementation, the cooling system 200, 200E, 200F, 200G, 200H, 200I, 200J, 200K, 200L can cool and maintain one or both of the chamber 126, 126', 126E, 126F1, 126F1, 126G1, 126L and the containers 150 at or below 15 degrees Celsius, such as at or below 10 degrees Celsius, in some examples at approximately 5 degrees Celsius.

In one implementation, the one or more sensors S1-Sn can include one more air flow sensors in the lid L that can monitor airflow through one or both of the intake vent 203 and exhaust vent 205. If said one or more flow sensors senses that the intake vent 203 is becoming clogged (e.g., with dust) due to a decrease in air flow, the circuitry EM (e.g., on the PCBA 278) can optionally reverse the operation of the fan 280, 280E, 280F for one or more predetermined periods of time to draw air through the exhaust vent 205 and exhaust air through the intake vent 203 to clear (e.g., unclog, remove the dust from) the intake vent 203. In another implementation, the circuitry EM can additionally or alternatively send an alert to the user (e.g., via a user interface on the container 100, 100E, 100F, 100G, 100H, 100I, 100J, 100K, 100L, 100M, wirelessly to a remote electronic device such as the user's mobile phone via GUI 610) to inform the user of the potential clogging of the intake vent 203, so that the user can inspect the container 100, 100E, 100F, 100G, 100H, 100I, 100J, 100K, 100L, 100M and can instruct the circuitry EM (e.g., via an app on the user's mobile phone) to run an "cleaning" operation, for example, by running the fan 280, 280E, 280F in reverse to exhaust air through the intake vent 203.

In one implementation, the one or more sensors S1-Sn can include one more Global Positioning System (GPS) sensors for tracking the location of the container system 100, 100E, 100F, 100G, 100H, 100I, 100J, 100K, 100L, 100M. The location information can be communicated, as discussed above, by a transmitter and/or transceiver associated with the circuitry EM to a remote location (e.g., a mobile electronic device, a cloud-based data storage system, etc.).

In another variation, the circuitry 278 and one or more batteries 277 can be in a removable pack (e.g., DeWalt battery pack) that attaches to the distal end 124 of the vessel 120, 120', 120E, 120F, where one or more contacts in the removable pack contact one or more contacts on the distal end 124 of the vessel 120, 120', 120E, 120F 120G. The one or more contacts on the distal end 124 of the vessel 120, 120', 120E, 120F, 120G are electrically connected (via one or more wires or one or more intermediate components) with the electrical connections on the proximal 122 of the vessel 120, 120E, 120F, 120G, 120H, 120I, 120J, 120K, or via as discussed above, to provide power to the components of the cooling system 200, 200E, 200F, 200G, 200H, 200I, 200J, 200K, 200L.

Figure 10A:
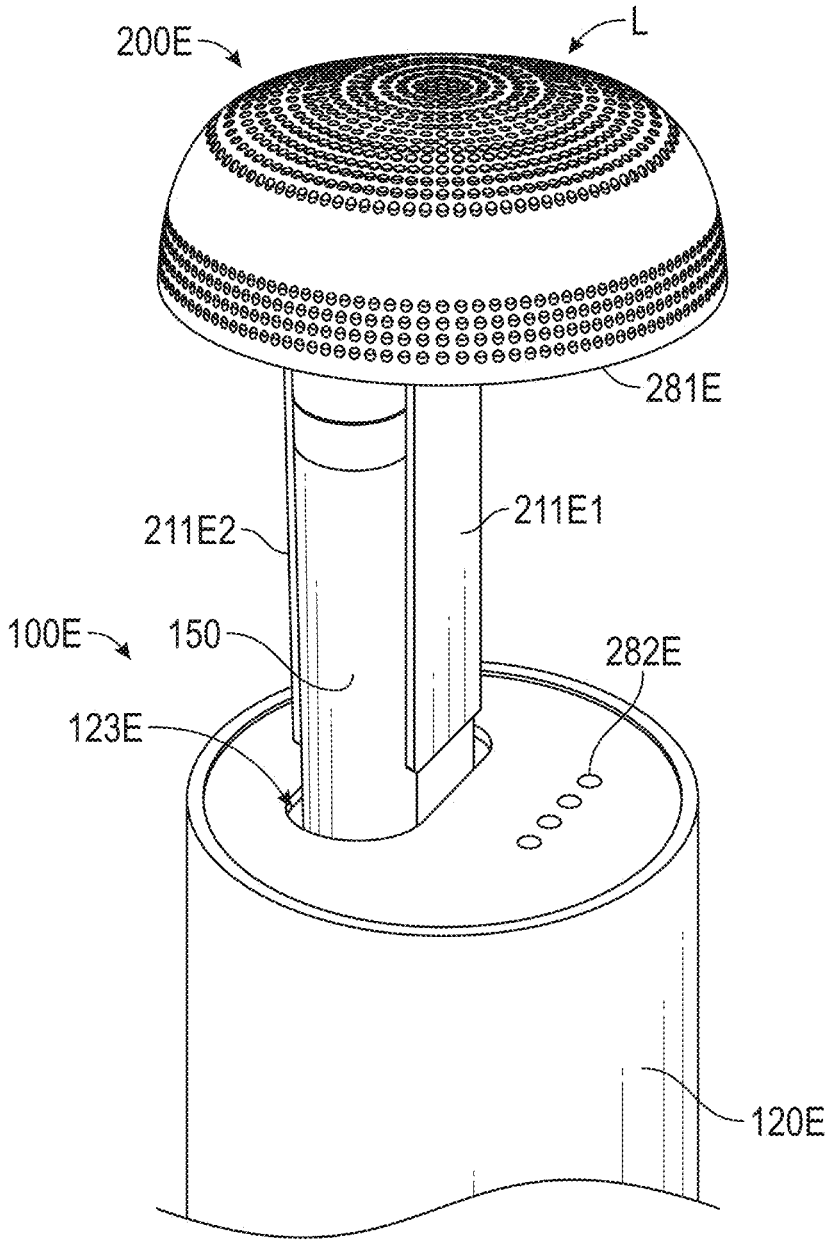
FIG. 10A is a schematic partial perspective view of another cooler container.
Figure 10B:
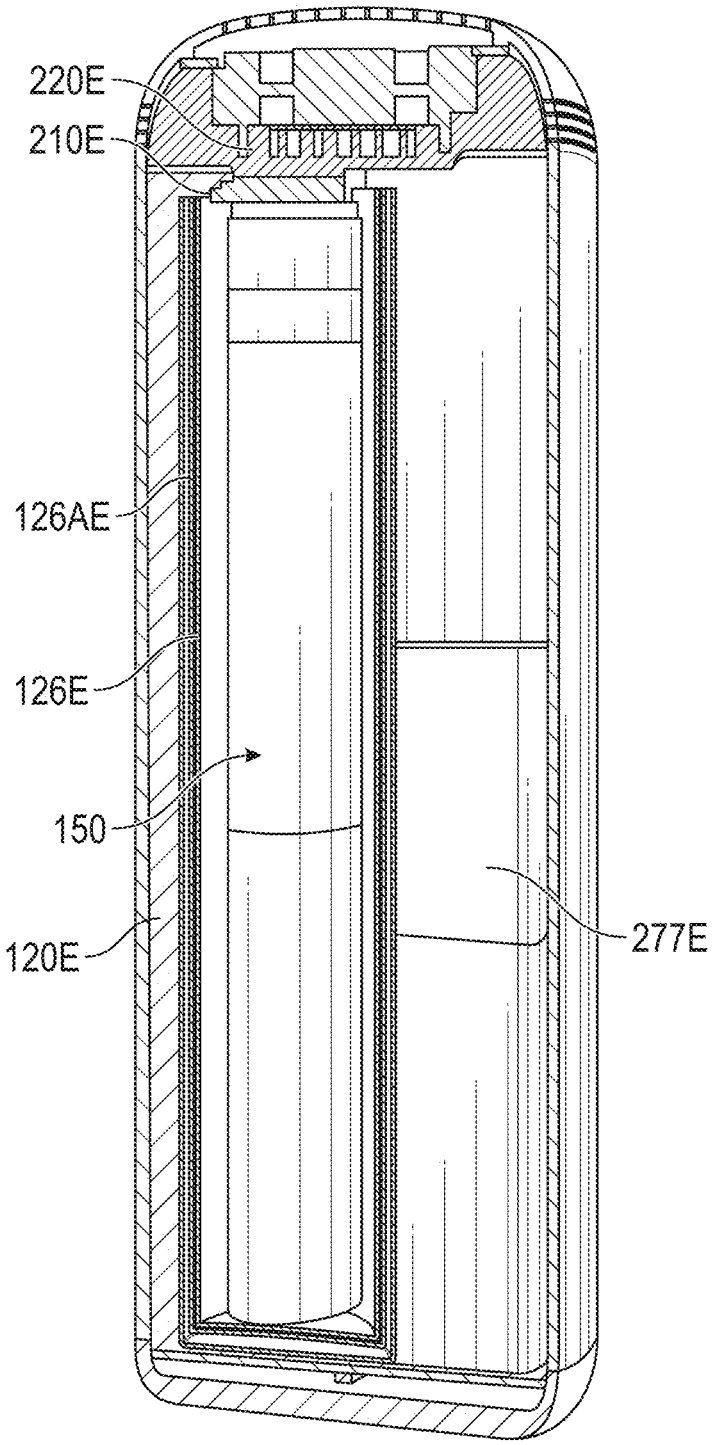
FIG. 10B is a schematic cross-sectional view of the cooler container of FIG. 10A.

FIGS. 10A-10B show a container system 100E (e.g., capsule container) that includes a cooling system 200E. The container system 100E and cooling system 200E are similar to the container system 100 and cooling system 200 described above in connection with FIGS. 1-8. Thus, references numerals used to designate the various components of the container vessel 100E and cooling system 200E are identical to those used for identifying the corresponding components of the container system 100 and cooling system 200 in FIGS. 1-8, except that an "E" is added to the numerical identifier. Therefore, the structure and description for the various components of the container system 100 and cooling system 200 in FIGS. 1-8 is understood to also apply to the corresponding components of the container system 100E and cooling system 200E in FIGS. 10A-10B, except as described below.

The container system 100E differs from the container system 100 in that the opening 123E in the vessel 120E has an oval shape and the open chamber 126E has an oval cross-section. The chamber 126E is sized to receive a pair of containers 150 (e.g., medicine containers, such as vials, cartridges (such as for injector pens), injector pens, etc.) side-by-side therein. The container 100E has electrical contacts 282E that can interface with electrical contacts 281E in the lid L.

The lid L can have a pair of spaced apart plates 211E1, 211E2 that can hold the pair of containers (e.g., medicine containers, such as vials, cartridges (such as for injector pens), injector pens, etc.) therebetween, such as in slots between the plates 211E1, 211E2. The plates 211E1, 211E2 can be part of the first heat sink 210E in thermal communication with one or more TECs 220E, such as Peltier element(s), and be in thermal communication with the chamber 126E of the vessel 120E (when the lid L is attached to the vessel 120E. As shown in FIG. 10B, the plates 211E1, 211E2 can be interposed between the containers 150 (medicine containers, such as vials, cartridges (such as for injector pens), injector pens, etc.) and the inner wall 126AE of the chamber 126E.

The chamber 126E can be approximately ½ as large as the chamber 126 of vessel 120 (which is sized to hold up to four containers 150). The other half of the vessel 100E can house one or more batteries 277E therein. The chamber 126E can be insulated (e.g., vacuum insulated) relative to the outer wall 121E of the vessel 120E.

Figure 11A:
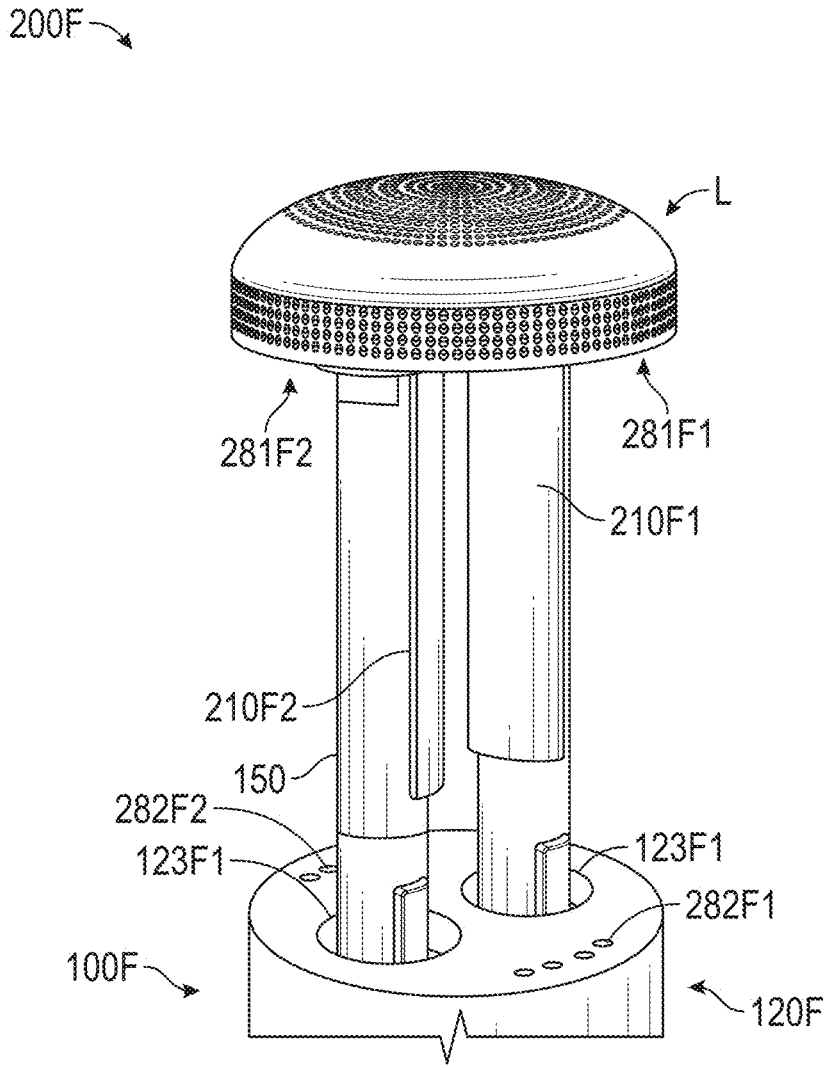
FIG. 11A is a schematic partial perspective view of another cooler container.
Figure 11B:
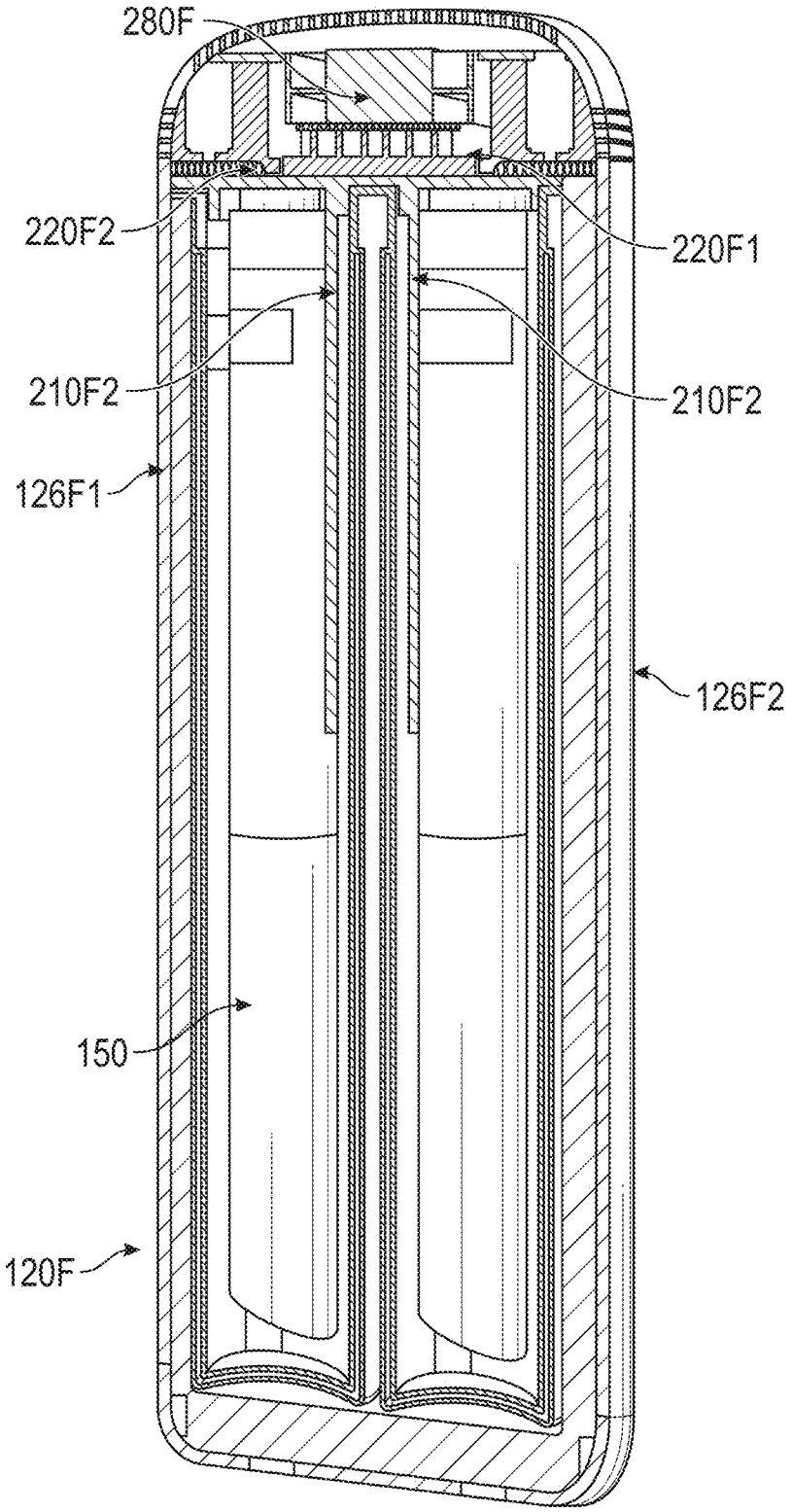
FIG. 11B is a schematic cross-sectional view of the cooler container of FIG. 11A.
Figure 11C:
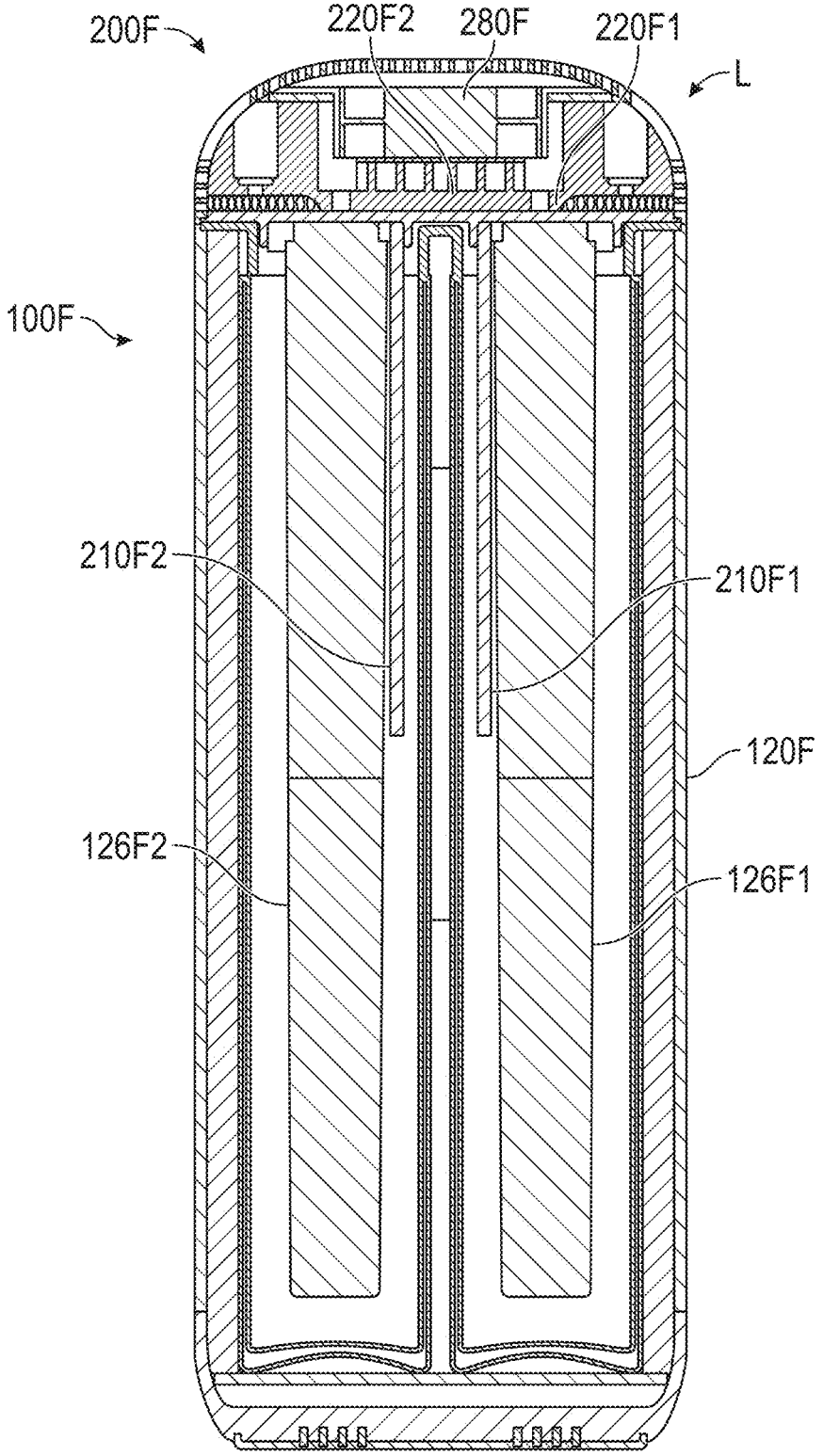
FIG. 11C is a schematic cross-sectional view of the cooler container in FIG. 11A.

FIGS. 11A-11C show a container system 100F (e.g., capsule container) that includes a cooling system 200F. The container system 100F and cooling system 200F are similar to the container system 100 and cooling system 200 described above in connection with FIGS. 1-8. Thus, references numerals used to designate the various components of the container system 100F and cooling system 200F are identical to those used for identifying the corresponding components of the container system 100 and cooling system 200 in FIGS. 1-8, except that an "F" is added to the numerical identifier. Therefore, the structure and description for the various components of the container system 100 and cooling system 200 in FIGS. 1-8 is understood to also apply to the corresponding components of the container vessel 100F and cooling system 200F in FIGS. 11A-11C, except as described below.

The container system 100F differs from the container system 100 in that the vessel 120F has two openings 123F1, 123F2 at the top of two separate and spaced apart chambers 126F1, 126F2. Optionally, the openings 123F1, 123F2 has a circular shape and each of the chambers 126F1, 126F2 has a circular cross-section. Each of the chambers 126F1, 126F2 is sized to receive a container 150 (e.g., medicine containers, such as vials, cartridges (such as for injector pens), injector pens, etc.) side-by-side therein. The container vessel 100F has two separate groups of electrical contacts 282F1, 282F2 that can interface with electrical contacts 281F1, 281F2 in the lid L.

The lid L can have a pair of spaced apart heat sinks 210F1, 210F2, each sized to resiliently hold one container 150 (e.g., medicine containers, such as vials, cartridges (such as for injector pens), injector pens, etc.), for example in a slot defined by the heat sinks 210F1, 210F2. Each of the heat sinks 210F1, 210F2 can be in thermal communication with a separate TEC 220F1, 220F2, which in turn can optionally be in thermal communication with separate second heat sinks (not shown) in the lid L. As discussed in FIGS. 1-8, the cooling system 200F can have one or more fans 280F operable to draw air over the second heat sinks (not shown) in the lid L. The chambers 126F1, 126F2 can be insulated (e.g., vacuum insulated) relative to each other and relative to the outer wall 121F of the vessel 100F.

Advantageously, the heat sinks 210F1, 210F2 can be operated independently of each other. Accordingly, in one implementation both heat sinks 210F1, 210F2 are operable to cool the containers 150 to the approximately the same temperature (e.g., down to approximately 5 degrees Celsius) when the containers 150 are in the chambers 126F1, 126F2 and the lid L is disposed on top of the vessel 120F to seal the vessel 120F. In another implementation both heat sinks 210F1, 210F2 are operable to cool the containers 150 to different temperatures when the containers 150 are in the chambers 126F1, 126F2 and the lid L is disposed on top of the vessel 120F to seal the vessel 120F. In another implementation, for example when a user is ready or almost ready to consume the medicine in the container 100F, one of the heat sinks 210F1 can be heated to heat its associated container 150 (e.g., to a predetermined consumption or administration temperature, for example to body temperature, to room temperature), while the other heat sink 210F2 cools its associated container 150 in the associated chamber 126F2. In still another implementation, both heat sinks 210F1, 210F2 are operated to heat their associated containers 150 (e.g., to the same temperature, to different temperatures).

Figure 12A:
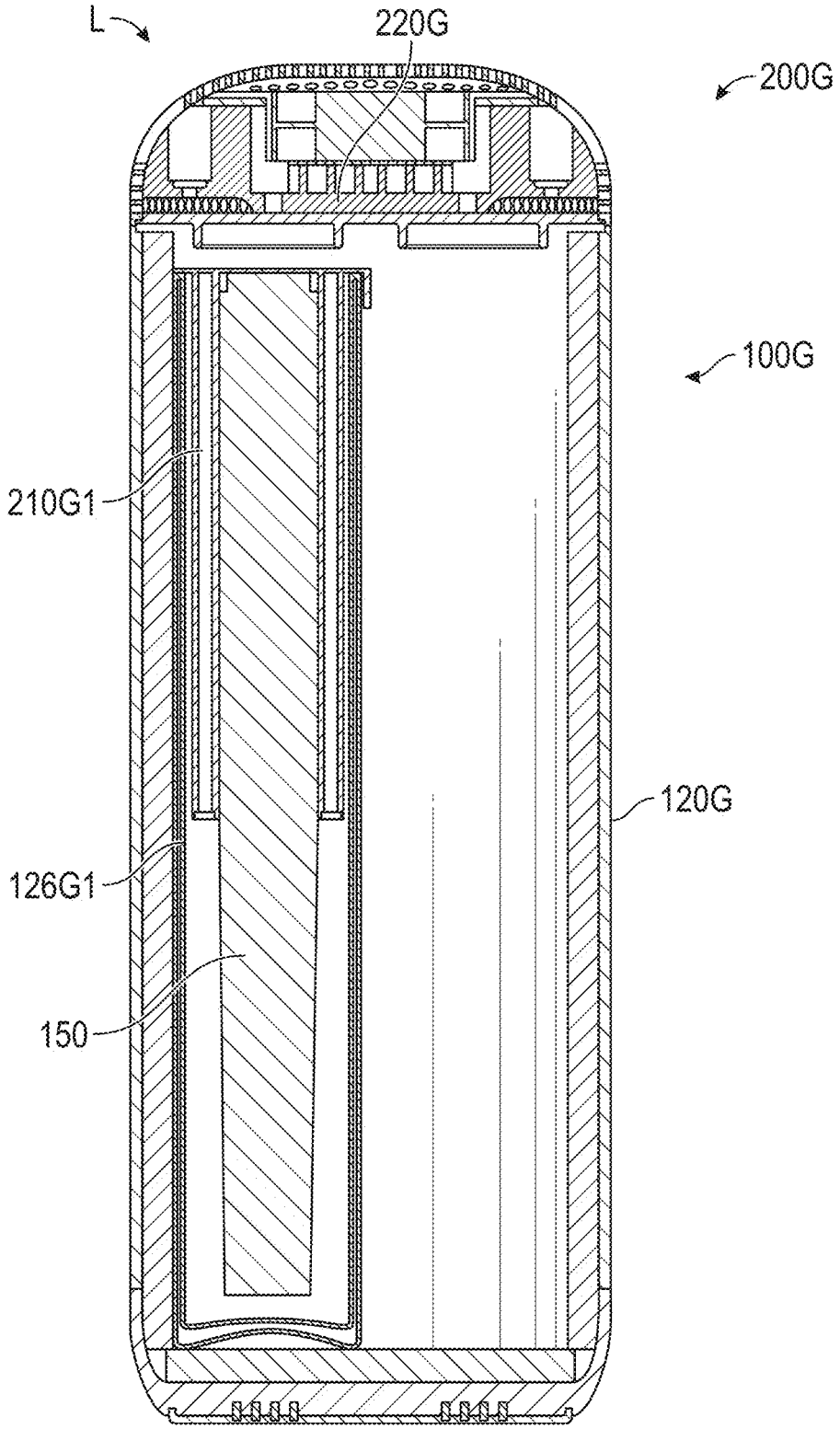
FIG. 12A-12C is a schematic cross-sectional view of another cooler container.
Figure 12B:
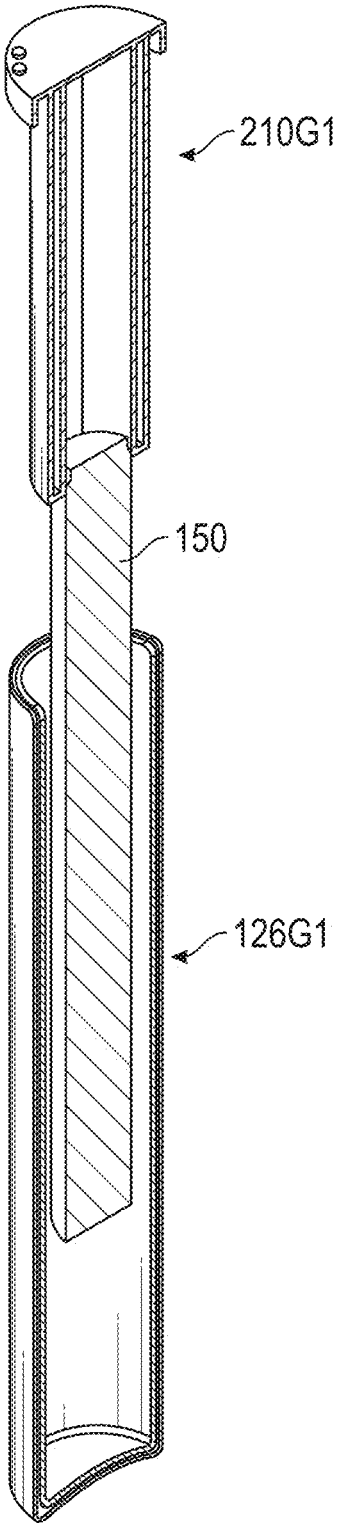
Figure 12C:
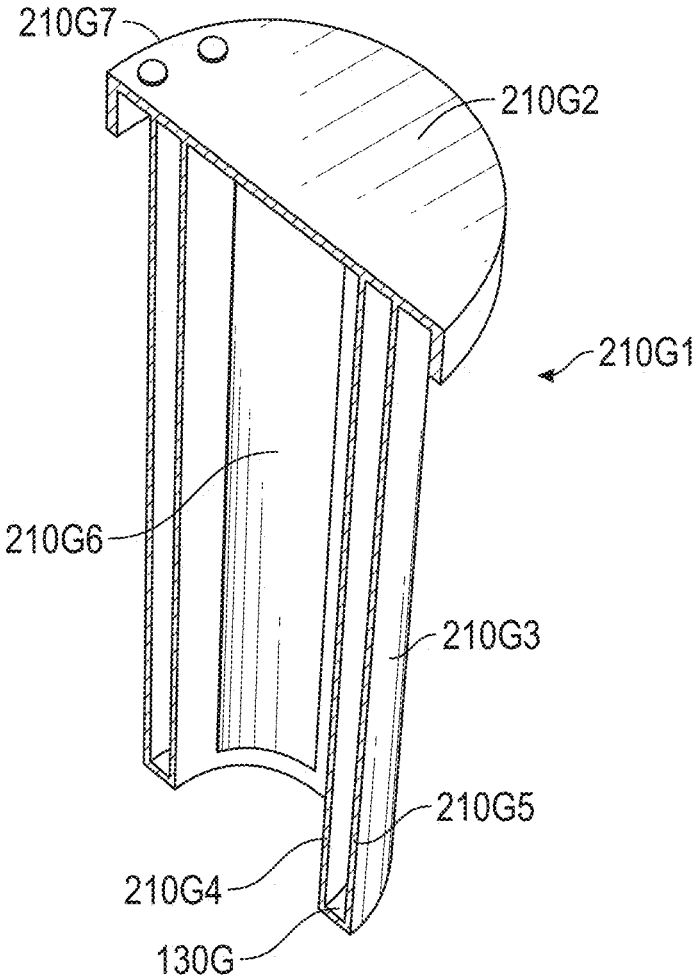

FIGS. 12A-12C show a container system 100G (e.g., a capsule container) that includes a cooling system 200G. The container system 100G and cooling system 200G are similar to the container system 100F and cooling system 200F described above in connection with FIGS. 11A-11C. Thus, references numerals used to designate the various components of the container system 100G and cooling system 200G are identical to those used for identifying the corresponding components of the container system 100F and cooling system 200F in FIGS. 11A-11C, except that a "G" instead of an "F" is added to the numerical identifier. Therefore, the structure and description for the various components of the container system 100F and cooling system 200F in FIGS. 11A-11C is understood to also apply to the corresponding components of the container vessel 100G and cooling system 200G in FIGS. 12A-12C, except as described below. For clarity, FIG. 12A only shows one chamber 126G1, but can have two chambers 126G1, 126G2 similar to chambers 126F1, 126F2 described above. Optionally, the chamber(s) 126G1, 126G2 are removable from the container system 100G, as further described below.

The container system 100G differs from the container system 100F in that the heat sink 210G1 is a removable sleeve 210G1 that removably couples to the container 150 (e.g., medicine containers, such as vials, cartridges (such as for injector pens), injector pens, etc.). The sleeve 210G1 can be made of a thermally conductive material (e.g., a metal, such as aluminum). The sleeve 210G1 can be removed along with the container 150 from the container vessel 120G (e.g., for placement in a user's purse, backpack, work bag during a commute or travel, etc.). Optionally, the sleeve 210G1 can maintain the container 150 in a cooled state for an extended period of time (e.g., between about 1 hour and about 10 hours, between about 1 hour and about 5 hours, between about 1 hour and about 3 hours, about 2 hours, etc.). When the sleeve 210G1 is coupled with the container 150 and inserted into the chamber 126G1, the sleeve 210G1 can interface with the cooling system 200G and operate as a heat transfer interface between the cooling system 200G (e.g., between one or more TECs 220G of the cooling system 200G and the container 150) to help cool and/or heat the container 150. For example, when the cooling system 200G is used to cool the container 150, the sleeve 210G1 can function as a heat sink to remove heat (e.g., cool) the container 150 that is attached to the sleeve 210G1.

With reference to FIG. 12C, the sleeve 210G1 can have a top surface 210G2, an outer wall 210G3 and an inner wall 210G4, where at least a portion of the inner wall 210G4 can be in contact with the container 150 when the sleeve 210G1 is coupled to the container 150. Optionally, the sleeve 210G1 can define a cavity (e.g., an annular cavity) 210G5 between the outer wall 210G3 and the inner wall 210G4. In one implementation, the cavity 210G5 can house a thermal mass material 130G. In one implementation, the thermal mass material 130G is a phase change material PCM (e.g., a solid-solid PCM, a solid-fluid PCM) that can transition from a heat absorbing state to a heat releasing state at a transition temperature. In another implementation, the cavity 210G5 is excluded and the sleeve 210G1 instead has a wall that extends between the inner surface 210G4 and the outer wall 210G3 with a thermal surface that can absorb and release heat.

The sleeve 210G1 can optionally include a heater 210G6 (e.g., a flex heater) in thermal communication with the inner wall 210G4 (e.g., the heater 210G6 can be disposed on the inner wall 210G4, embedded in the inner wall 210G4, disposed behind the inner wall 210G4 (e.g., disposed in the cavity 210G5. The sleeve 210G1 can have one or more electrical contacts 210G7 on a surface thereof (e.g., on the top surface 210G2). The one or more electrical contacts 210G7 can be in electrical communication with the heater 210G6. In another implementation, the sleeve 210G1 can exclude the heater 210G6 and one or more electrical contacts 210G7.

In operation, while the sleeve 210G1 is coupled to the container 150 and inserted into the container vessel 120G with the lid L in the closed position relative to the container vessel 120G, the cooling system 200G can operate to cool one or both of the chamber 126G1 and the sleeve 210G1. For example, one or more TECs 220G of the cooling system 200G can cool a heat sink surface that contacts the top surface 210G2 of the sleeve 210G1, thereby also being placed in thermal communication with the inner wall 210G4, outer wall 210G3 and optional thermal mass 130G (e.g., PCM) in the cavity 210G5. The TECs 220G can thereby cool the sleeve 210G1 and thereby cool the container 150 attached to it, as well as charge the optional thermal mass 130G (e.g., PCM). Optionally, where the sleeve 210G1 includes the heater 210G6, a controller of the system 200G can operate the heater 210G6 to heat the contents of the container 150 (e.g., to room temperature, body temperature) prior to the container 150 being removed from the container vessel 120G for use (e.g. for application of the contents of the container to the user, such as via an injector pen). For example, the controller can provide power to the heater 210G6 via the electrical contacts 210G7 that contact electrical contacts in the lid L when the lid L is in a closed position relative to the container vessel 100.

In one implementation, once the cooling system 200G has cooled the sleeve 210G1 and its attached container 150, the user can optionally remove the sleeve 210G1 with its attached container 150 from the container vessel 120G, as described above (e.g., for travel, commute, etc.) and the charged thermal mass 130G can maintain the container 150 attached to the sleeve 210G1 in a cooled state for an extended period of time, as discussed above.

Figure 13:
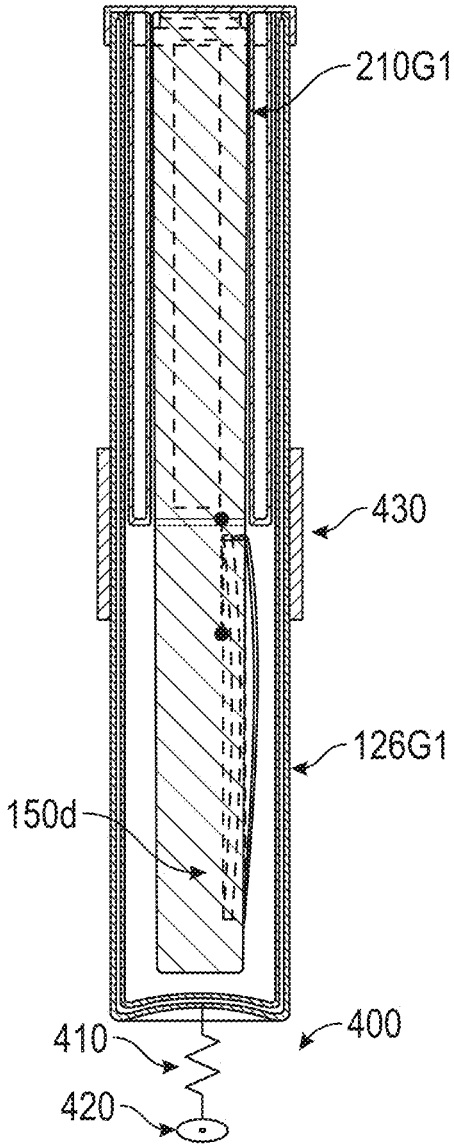
FIG. 13 is a schematic partial cross-sectional view of a portion of another cooler container.

FIG. 13 shows another implementation of a chamber 126G1 in the container system 100G (e.g., a capsule container) that includes a cooling system 200G. As discussed above, the chamber 126G1 can receive a container 150 (e.g., medicine containers, such as vials, cartridges (such as for injector pens), injector pens, etc.) attached to the sleeve 210G1. The chamber 126G1 can be actuated between a retracted position and an extended position in the container vessel 100G. As shown in FIG. 13, the chamber 126G1 can be spring loaded within the container vessel 100G. A guide 430 can guide the movement of the chamber 126G1 between the retracted and extended position.

In one implementation, the chamber 126G1 can have an actuation mechanism 400 that can optionally include a spring 410 that extends between a bottom of the chamber 126G1 and a cam 420. The spring 410 can be a compression spring. In one implementation, the cam 240 can move between a first orientation to position the chamber 126G1 in the retracted position and a second orientation to position the chamber 126G2 in the extended position. The movement of the cam 240 to change its orientation can be actuated by pushing down on the sleeve 210G1 (e.g., on the top surface 210G2 of the sleeve 210G1). Movement of the chamber 126G1 to the extended position can facilitate removal of the container 150 (e.g., with the attached sleeve 210G1) from the chamber 126G1 (e.g., when ready for use by the user, as discussed above).

Optionally, with the chamber 126G1 in the extended position, and with the container 150 in the chamber 126G1 and attached to the sleeve 210G1, movement of the lid L to the closed position relative to the container vessel 120G can urge the chamber 126G1 into the container vessel 120G and actuate the movement of the cam 420 to allow the chamber 126G1 to move to the retracted position. Though the actuation mechanism 400 is described in connection with the chamber 126G1 and container system 100G, one of skill in the art will recognize that the features of the actuation mechanism 400 described herein can also be applied to all the other implementations discussed herein for the container system 100, 100E, 100F, 100G.

Figure 14A:
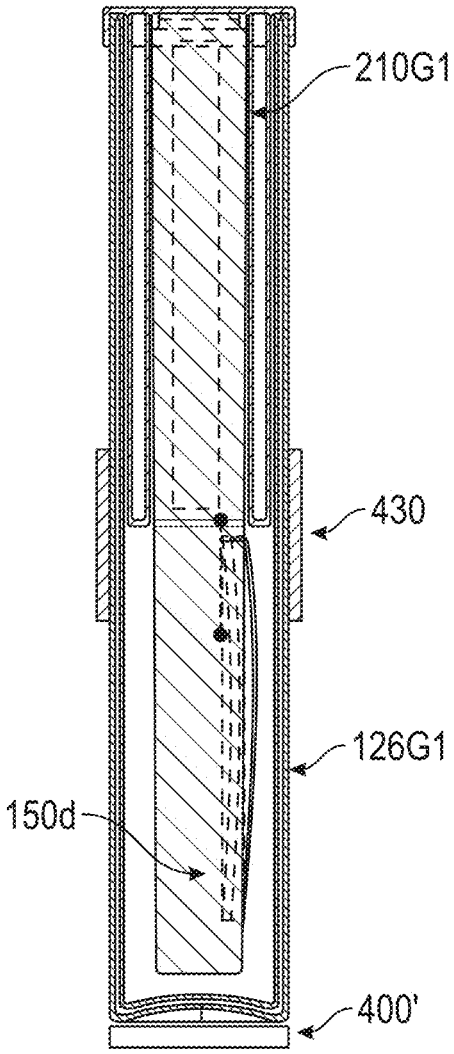
FIGS. 14A-14B are a schematic partial cross-sectional view of another cooler container.
Figure 14B:
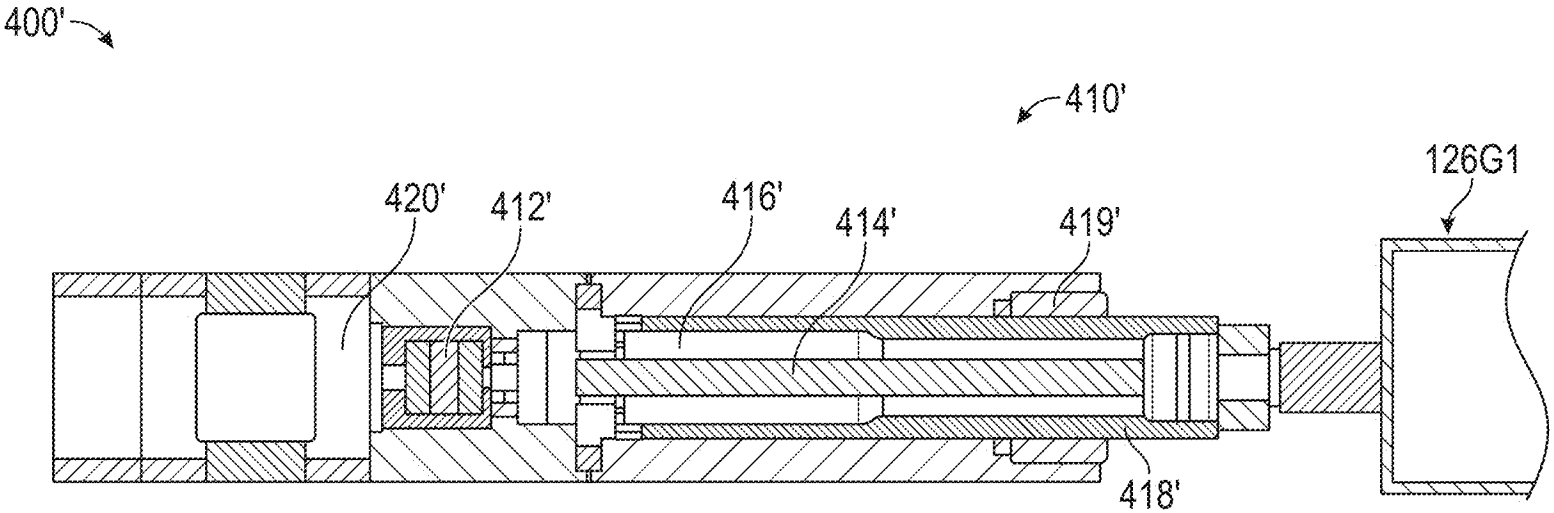

FIGS. 14A-14B shows another implementation of a chamber 126G1 in the container system 100G (e.g., a capsule container) that includes a cooling system 200G. As discussed above, the chamber 126G1 can receive a container 150 (e.g., medicine containers, such as vials, cartridges (such as for injector pens), injector pens, etc.) attached to the sleeve 210G1. The chamber 126G1 can be actuated between a retracted position and an extended position in the container vessel 120G. As shown in FIG. 14A-14B, the chamber 126G1 can be actuated between the retracted position and the extended position by an actuation mechanism 400'. The actuation mechanism 400' can optionally be housed in the container vessel 120G below the chamber 126G1 (e.g., between a bottom of the chamber 126G1 and a bottom of the container vessel 120G). A guide 430 can guide the movement of the chamber 126G1 between the retracted and extended position.

With reference to FIG. 14B, the actuation mechanism 400' can include a linear actuator 410' and a motor 420' operable to drive the linear actuator 410'. The linear actuator 410' can optionally include a coupling that couples to an output shaft of the motor 420'. The coupling 412' is coupled to a ball screw 414' that rotates when the motor 420' rotates the coupling 412'. The ball screw 414' rotates relative to a ball screw nut 416', where the ball screw nut 416' travels along the ball screw 414' as the motor 420' rotates the coupling 412' (e.g., travels rightward in the drawing when coupling 412' rotates in one direction and travels leftward in the drawing when the coupling 412' rotates in the opposite direction). The ball screw nut 416' can be attached to a rod such that the rod translates (at least partially within a bushing 419') along the axis of the ball screw 414' as the screw 414' rotates. An end of the rod 418' can engage a bottom of the chamber 126G1 to move the chamber 126G1 between the retracted and extended position relative to the container vessel 120G. however, in other implementations, the actuation mechanism 400' can be other suitable linear motion mechanisms (e.g., instead of an electric motor 420' can include a pneumatic or hydraulic system to translate the rod 418'). Though the actuation mechanism 400' is described in connection with the chamber 126G1 and container vessel 120G, one of skill in the art will recognize that the features of the actuation mechanism 400' described herein can also be applied to all the other implementations discussed herein for the container vessel 100, 100E, 100F, 100G.

Figure 15:
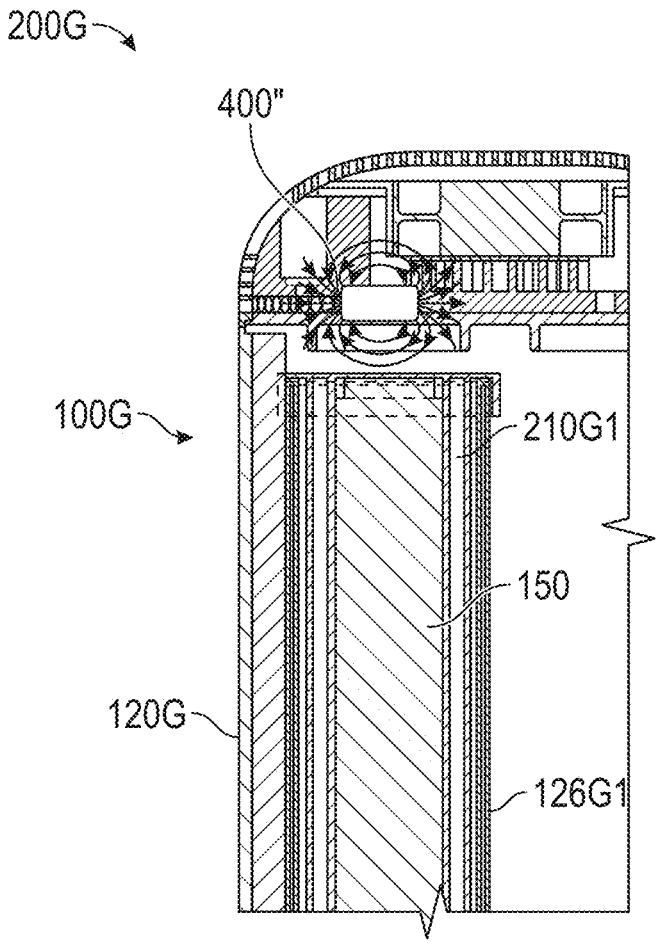
FIG. 15 is a schematic partial cross-sectional view of another cooler container.

FIG. 15 shows another implementation of a chamber 126G1 in the container system 100G (e.g., a capsule container) that includes a cooling system 200G. As discussed above, the chamber 126G1 can receive a container 150 (e.g., medicine containers, such as vials, cartridges (such as for injector pens), injector pens, etc.) attached to the sleeve 210G1. The chamber 126G1 can be actuated between a retracted position and an extended position in the container vessel 120G. As shown in FIG. 15, the chamber 126G1 can be actuated between the retracted position and the extended position by an actuation mechanism 400". The actuation mechanism 400" can optionally be housed in the lid L. Though not shown, a guide (similar to guide 430) can guide the movement of the chamber 126G1 between the retracted and extended position.

With reference to FIG. 15, the actuation mechanism 400" can include a magnet 420". In one implementation, the magnet 420" can be an electromagnet. In operation, the electromagnet 420" can be operated to draw the sleeve 210G1 (e.g., the top surface 210G2 of the sleeve 210G1) into contact with a heat sink surface and/or one or more TECs 220G to place the sleeve 210G1 (and therefore the container 150 coupled to the sleeve 210G1) in thermal communication with the one or more TECs 220G, which can be operated to cool the sleeve 210G1 and/or container 150 and/or the chamber 126G1. The electromagnet 420" can be turned off or not operated to allow the sleeve 210G1 (and container 150 attached to it) to be displaced from the heat sink and/or one or more TECs 220G to thereby thermally disconnect the container 150 and sleeve 210G1 from the TECs 220G. The electromagnet 420" can be turned off or disengaged when, for example, the user wishes to remove the container 150 and sleeve 210G1 from the container vessel 120G (e.g., for storing in another compartment, such as a purse, backpack, travel bag, etc. during a commute or trip). Though the actuation mechanism 400" is described in connection with the chamber 126G1 and container vessel 120G, one of skill in the art will recognize that the features of the actuation mechanism 400" described herein can also be applied to all the other implementations discussed herein for the container vessel 100, 100E, 100F, 100G.

In another implementation, the container system 100, 100E, 100F, 100G can have chambers 126, 126E, 126F1, 126F2, 126G1 that can be completely removed from the container vessel 120, 120E, 120F, 120F, such as for travel or commute, where the chamber can hold the container 150 (e.g., vial, cartridge (such as for use in injector pen), injector pen, etc.) therein (e.g., provide a travel pack) until the container 150 is ready for use.

Figure 16:
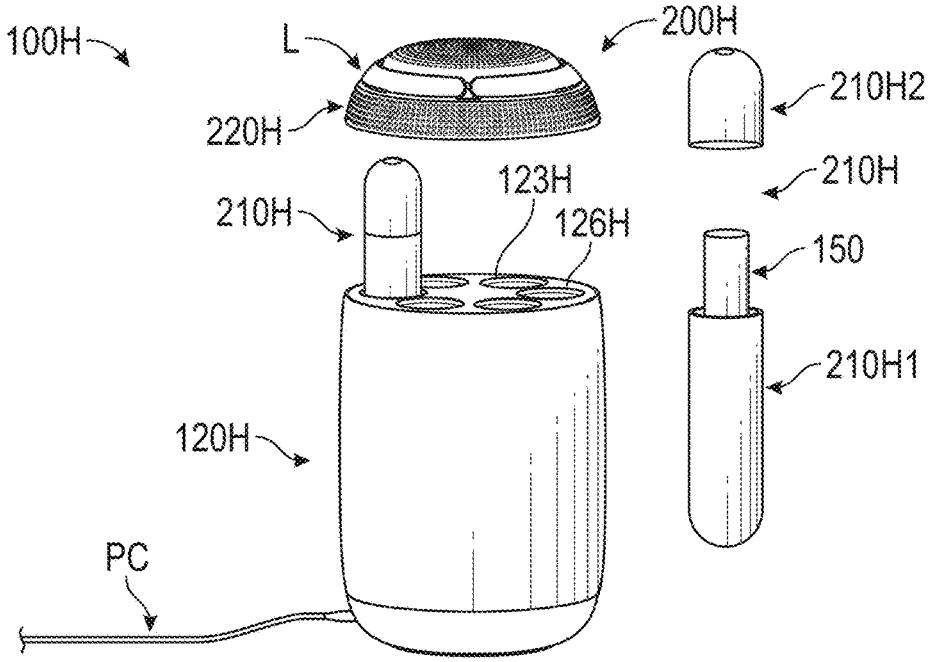
FIG. 16 shows a schematic perspective view of another cooler container and an exploded view of a capsule for use with the container.
Figure 16A:
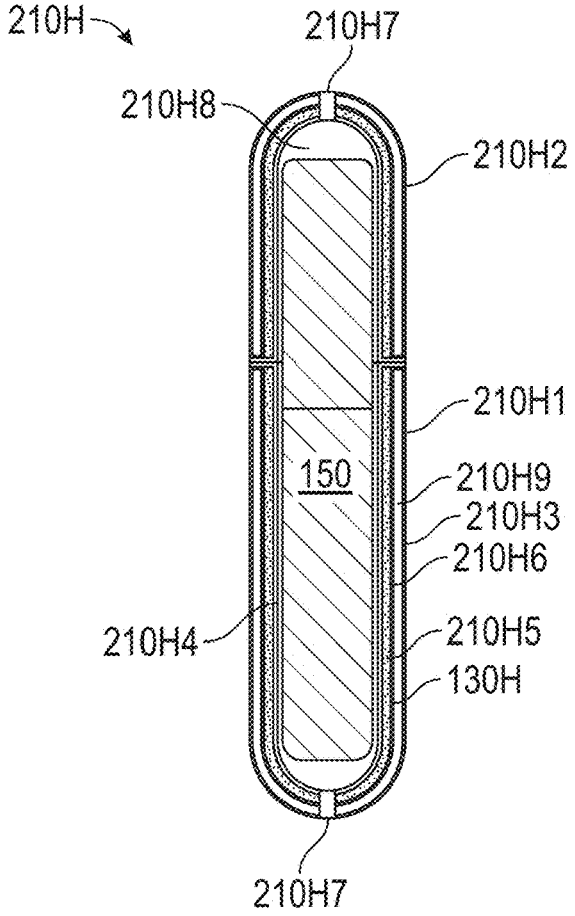
FIG. 16A shows a schematic cross-sectional view of a capsule for use with the cooler container of FIG. 16.
Figure 16B:
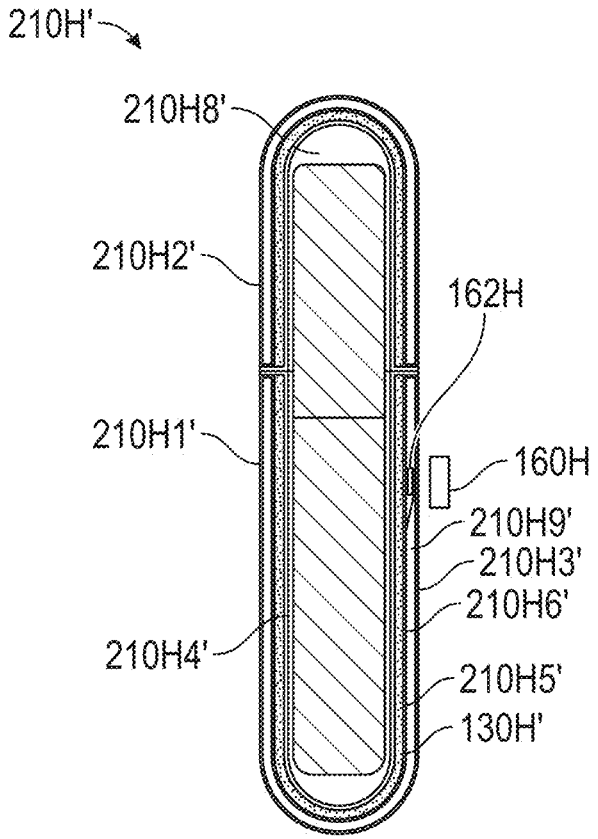
FIG. 16B shows a schematic cross-sectional view of another capsule for use with cooler container of FIG. 16.
Figure 16C:
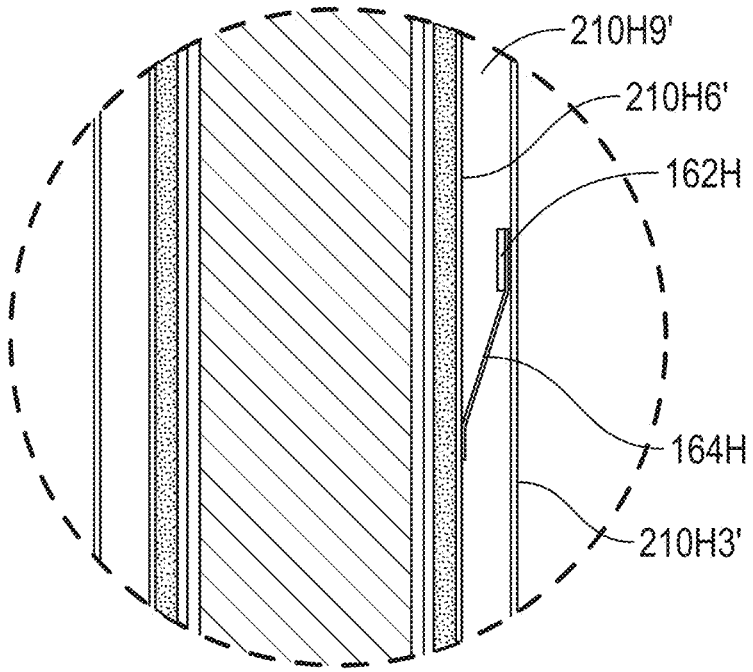
FIG. 16C shows an enlarged cross-sectional view of a portion of the capsule in FIG. 16B.

FIGS. 16A-16C show a container system 100H (e.g., a capsule container) that includes a cooling system 200H. The container system 100H and cooling system 200H are similar to the container system 100G and cooling system 200G described above in connection with FIGS. 12A-12C. Thus, references numerals used to designate the various components of the container system 100H and cooling system 200H are identical to those used for identifying the corresponding components of the container system 100G and cooling system 200G in FIGS. 12A-12C, except that an "H" instead of a "G" is added to the numerical identifier. Therefore, the structure and description for the various components of the container system 100G and cooling system 200G in FIGS. 12A-12C is understood to also apply to the corresponding components of the container system 100H and cooling system 200H in FIGS. 16A-16C, except as described below.

As shown in FIG. 16, the container system 100H has a container vessel 120H and a lid L. The lid L can include a cooling system 200G. The container vessel 120H can optionally have one or more chambers 126H that extend to corresponding one or more openings 123H. Though FIG. 16 shows the container vessel 120H having six chambers 126H, one of skill in the art will recognize that the container vessel 120H can have more or fewer chambers 126H than shown in FIG. 16. The chamber(s) 126H of the container vessel 120H can removably hold a corresponding capsule 210H therein. In one implementation, the container vessel 120H can have the same or similar structure as shown and described above for the container vessel 120, 120E, 120F, 120G. Optionally, the container vessel 120H can have a cavity between the chamber(s) 126H and the outer surface of the container vessel 120H that is vacuum insulated. In another implementation, the container vessel 120H excludes vacuum insulation and can instead have a gap or cavity between the chamber(s) 126H and an outer surface of the container vessel 120H that is filled with air. In still another implementation, the container vessel 120H can have a gap or cavity between the chamber(s) 126H and an outer surface of the container vessel 120H that includes an insulating material.

With continued reference to FIG. 16, the capsule(s) 210H have a vessel portion 210H1 and a lid portion 210H2 that together can enclose a container 150 (e.g., medicine containers, such as vials, cartridges (such as for injector pens), injector pens, etc.). The lid portion 210H2 can be moved between a closed position relative to (e.g., adjacent) the vessel portion 210H1 and an open position relative to (e.g., spaced apart from) the vessel portion 210H1. In the closed position, the lid portion 210H2 can optionally be held against the vessel portion 210H1 (e.g., by one or more magnetic surfaces of the lid portion 210H2 and/or vessel portion 210H1) to inhibit (e.g., prevent) the container 150 from inadvertently falling out of the capsule 210H.

FIG. 16A shows one implementation of a capsule 210H, where the vessel portion 210H1 and lid portion 210H2 have an outer surface 210H3 and an inner surface 210H4 that defines a cavity 210H8 that receives the container 150. The vessel portion 210H1 and lid portion 210H2 can also have one or more intermediate walls 210H6 radially between the inner surface 210H4 and the outer surface 210H3 that define a first cavity 210H5 between the inner wall 210H4 and the intermediate wall(s) 210H6 and a second cavity 210H9 between the intermediate wall(s) 210H6 and the outer surface 210H3. Optionally, the second cavity 210H5 can be vacuum insulated (i.e., the second cavity 210H5 can be under vacuum or negative pressure force). Optionally, the first cavity 210H5 can house a thermal mass material 130H. In one implementation, the thermal mass material 130H is a phase change material PCM (e.g., a solid-solid PCM, a solid-fluid PCM) that can transition from a heat absorbing state to a heat releasing state at a transition temperature. In another implementation, the cavity 210H5 is excluded and the capsule 210H instead has a wall that extends between the inner surface 210H4 and the intermediate wall(s) 210H6 that can absorb and release heat.

With continued reference to FIG. 16A, the capsule 210H has a thermally conductive contact 210H7 at one or both ends of the capsule 210H. The thermally conductive contact 210H7 can be made of metal, though is can be made of other thermally conductive material. In one implementation, the thermally conductive contact 210H7 is made of copper. The thermally conductive contact 210H7 can extend from the outer surface 210H3 to the inner surface 210H4 and through the first and second cavities 210H5, 210H9, so as to be in thermal contact with the thermal mass material 130H.

In operation, when a container 150 (e.g., medicine containers, such as vials, cartridges (such as for injector pens), injector pens, etc.) is inserted into the capsule 210H (e.g. into the vessel portion 210H1 and lid portion 210H2) and then inserted into the chamber 126H, and the lid L closed over the container vessel 120H, the thermally conductive contact(s) 210H7 will be placed in thermal communication (e.g., thermally contact, directly contact) with a cold-side heat sink of the cooling system 200G (e.g., similar to the heat sink 210 in FIG. 4) that is itself in thermal communication with one or more TECs (e.g., similar to TEC 220 in FIG. 4), where the one or more TECs are operated to remove heat from (e.g., cool) the cold side heat sink, which in turn removes heat from (e.g., cools) the thermally conductive contact(s) 210H7. The thermally conductive contact(s) 210H7 in turn remove heat from the cavity 210H8 to thereby cool the container 150, as well as remove heat from the thermal mass material 130H in the cavity 210H5 to thereby charge the thermal mass material 130H. In one implementation, the cold side heat sink thermally contacts one of the thermally conductive contacts 210H7. In another implementation, the cold side heat sink thermally contacts both of the thermally conductive contacts 210H7. For example, the cold side heat sink in the lid L can thermally contact the thermally conductive contact 210H7 at one end of the capsule 210H as well as thermally contact an inner wall of the chamber 126H that itself contacts the thermally conductive contact 210H7 at the opposite end of the capsule 210H.

The capsule 210H can be removed along with the container 150 (e.g., one at a time, two at a time, etc.) from the container vessel 120H (e.g., for placement in a user's purse, backpack, work bag during a commute or travel, etc.). Optionally, the capsule 210H can maintain the container 150 in a cooled state for an extended period of time (e.g., between about 1 hour and about 15 hours, about 14 hours, between about 1 hour and about 10 hours, between about 1 hour and about 3 hours, about 2 hours, etc.). The capsule 210H can maintain the container 150 approximately at a temperature of about 2-8 degrees Celsius. When the capsule 210H receives or houses the container 150 and is then inserted into the chamber 126H of the container vessel 120H, the capsule 210H can interface with the cooling system 200H and operate as a heat transfer interface between the cooling system 200H (e.g., between one or more TECs 220H of the cooling system 200H and the container 150) to help cool and/or heat the container 150. For example, when the cooling system 200H is used to cool the container 150, the capsule 210H can function as a heat sink to remove heat (e.g., cool) the container 150 that is disposed in the capsule 210H.

In one implementation, the cooling system 200H receives power via a power cord PC that can be connected to a wall outlet. However, the power cord PC can have other suitable connectors that allow the cooling system 200H to receive power from a power source other than a wall outlet. Power can be provided from the container vessel 120H, to which the power cord PC is connected, to the cooling system 200H in the lid via one or more electrical contacts on a rim of the container vessel 120H and on the lid L (e.g., similar to electrical contacts 282 described above in connection with FIG. 3). In another implementation, the power cord PC is excluded and the container vessel 120H can have one or more batteries (such as batteries 277 in FIG. 4) that provide power to the cooling system 200H (e.g., via electrical contacts, such as contacts 282 in FIG. 3) when the lid L is disposed over the container vessel 120H.

FIGS. 16B-16C show another implementation of the capsule 210H' for use with a container system 100H' and cooling system 200H'. The capsule 210H', container system 100H' and cooling system 200H' are similar to the capsule 210H, container system 100H and cooling system 200H described above in connection with FIGS. 16-16A. Thus, references numerals used to designate the various components of the capsule 210H, container system 100H and cooling system 200H are identical to those used for identifying the corresponding components of the capsule 210H', container system 100H' and cooling system 200H' in FIGS. 16B-16C, except that an "'" is added to the numerical identifier. Therefore, the structure and description for the various components of the capsule 210H, container system 100H and cooling system 200H in FIGS. 16-16A is understood to also apply to the corresponding components of the capsule 210H', container system 100H' and cooling system 200H' in FIGS. 16B-16C, except as described below.

The capsule 210H' differs from the capsule 210H in that the thermally conductive contact(s) 210H7 are excluded. The capsule 210H' has a movable mass 162H disposed in the cavity 210H9' between the intermediate wall 210H6' and the outer wall 210H3'. The movable mass 162H can optionally be a magnet. In another implementation, the movable mass 162H can be a metal block. The movable mass 162H can optionally be movably coupled to the intermediate wall 210H6' by a flexible thermally conductive element 164H, which operates as a thermal bridge between the movable mass 162H and the thermal mass material 130H'. In one implementation, the flexible thermally conductive element 164H can be made of copper. However, the flexible thermally conductive element 164H can be made of other suitable thermally conductive materials. The flexible thermally conductive element 164H can be a leaf spring or similar resilient member that is attached at one end to the intermediate wall 210H6' and at its other end to the movable mass 162H. The movable mass 162H can optionally move within the second cavity 210H9' (e.g., a vacuum insulated cavity) between a first position where it is in contact with the intermediate wall 210H6' and a second position where it is in contact with the outer wall 210H3' of the capsule 210H'.

The container vessel 120H' can include one or more magnets 160H adjacent a wall of the chamber(s) 126H'. In one implementation, the one or more magnets 160H are permanent magnets. In another implementation, the one or more magnets 160H are electromagnets. The one or more magnets 160H can be in thermal communication with a cold side heat sink of the cooling system 200H' (e.g., via a wall or surface of the container vessel 120H', such as a wall of the chamber(s) 126H' that interfaces with the cold side heat sink when the lid L is placed on the container vessel 120H').

In operation, when a container 150 (e.g., medicine containers, such as vials, cartridges (such as for injector pens), injector pens, etc.) is inserted into the capsule 210H' (e.g. into the vessel portion 210H1' and lid portion 210H2') and then inserted into the chamber 126H', and the lid L closed over the container vessel 120H', the one or more magnets 160H in the container vessel 120H' draw the movable mass 162H into contact with the outer wall 210H3' of the capsule 210H'. The cooling system 200H' draws heat out of the cavity 210H8' of the capsule 210H' (e.g., via operation of one or more TECs to draw heat from cold side heat sink, which itself draws heat from surfaces of components in the container vessel 120H' in thermal communication with the magnet 160H) by drawing heat from the thermal mass material 130H' via the flexible thermally conductive element 164H and contact between the movable mass 162H, outer wall 210H3' and magnet 160H. As heat is drawn from the thermal mass material 130H' to charge it, it also draws heat from the cavity 210H8' via the inner wall 210H4'. The magnet 160H and movable mass 162H (e.g., magnet, metallic component) therefore operate to form a thermal bridge through the cavity 210H9' (e.g., vacuum insulated cavity) to the thermal mass material 130H'.

The capsule 210H' can be removed along with the container 150 (e.g., one at a time, two at a time, etc.) from the container vessel 120H' (e.g., for placement in a user's purse, backpack, work bag during a commute or travel, etc.). Optionally, the capsule 210H' can maintain the container 150 in a cooled state for an extended period of time (e.g., between about 1 hour and about 15 hours, about 14 hours, between about 1 hour and about 10 hours, between about 1 hour and about 3 hours, about 2 hours, etc.). The capsule 210H' can maintain the container 150 approximately at a temperature of about 2-8 degrees Celsius.

The capsule(s) 210H, 210H' can optionally have a wireless transmitter and/or transceiver and a power source (e.g., battery) disposed therein (e.g., disposed in the cavity 210H9, 210H9'), and can have a temperature sensors in communication with the cavity 210H8, 210H8' (e.g., in thermal contact with the inner wall 210H4, 210H4'). The wireless transmitter and/or transceiver can optionally allow connectivity of the capsule(s) 210H, 210H' with an electronic device (e.g., a mobile electronic device, such as a smartphone), such as via an app on the electronic device, and can transmit sensed temperature information to the electronic device for tracking of internal temperature of the capsule 210H', 210H. Optionally, the transmitter and/or transceiver can transmit an alert signal to the electronic device (e.g., visual alert, audible alert), such as a notification via the app, if the sensed temperature exceeds a temperature range (e.g., predetermined temperature range, preselected temperature limit) for the medication in the container 150. When the capsule 210H, 210H' is inserted into the chamber 126H, 126H' of the container vessel 120H, 120H', the transmitter and/or transceiver can also wirelessly transmit sensed temperature data sensed by the temperature sensor to the electronic device. Optionally, when in the container vessel 120H, 120H', the battery in the capsule(s) 210H, 210H' can be recharged (e.g., via induction power transfer, or via electrical contacts). In addition to maintaining the container 150 (and medication in the container 150) at or below a predetermined temperature range (e.g., 2-8 degrees C.) for a prolonged period of time (e.g., up to 14 hours, up to 10 hours, up to 5 hours, up to 3 hours, etc.), the capsule(s) 210H, 210H' can protect the container 150 therein from damage (e.g., breaking, spillage) if the capsule 210H, 210H' is dropped.

Figure 17:
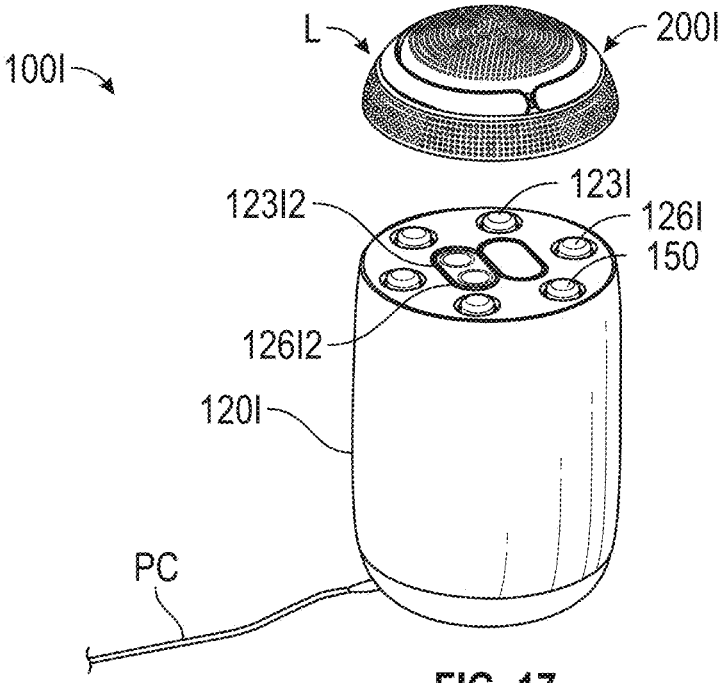
FIG. 17 shows a schematic perspective view of another cooler container.
Figure 17A:
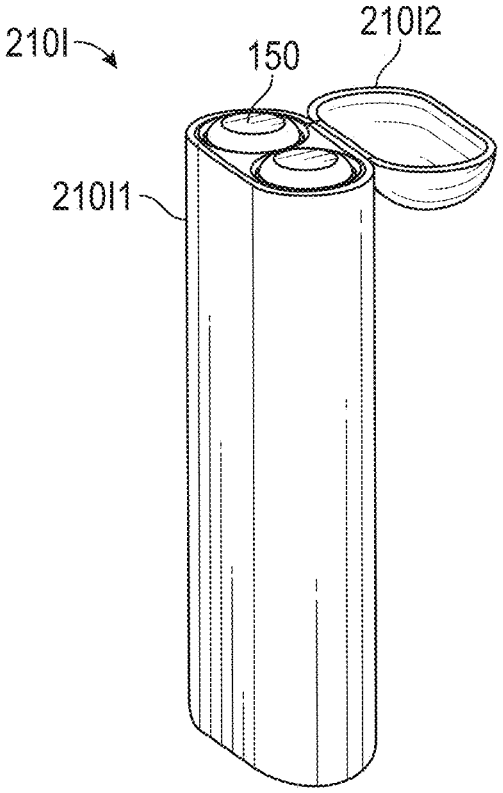
FIG. 17A shows a schematic perspective view of a capsule for use with the cooler container of FIG. 17.
Figure 17B:
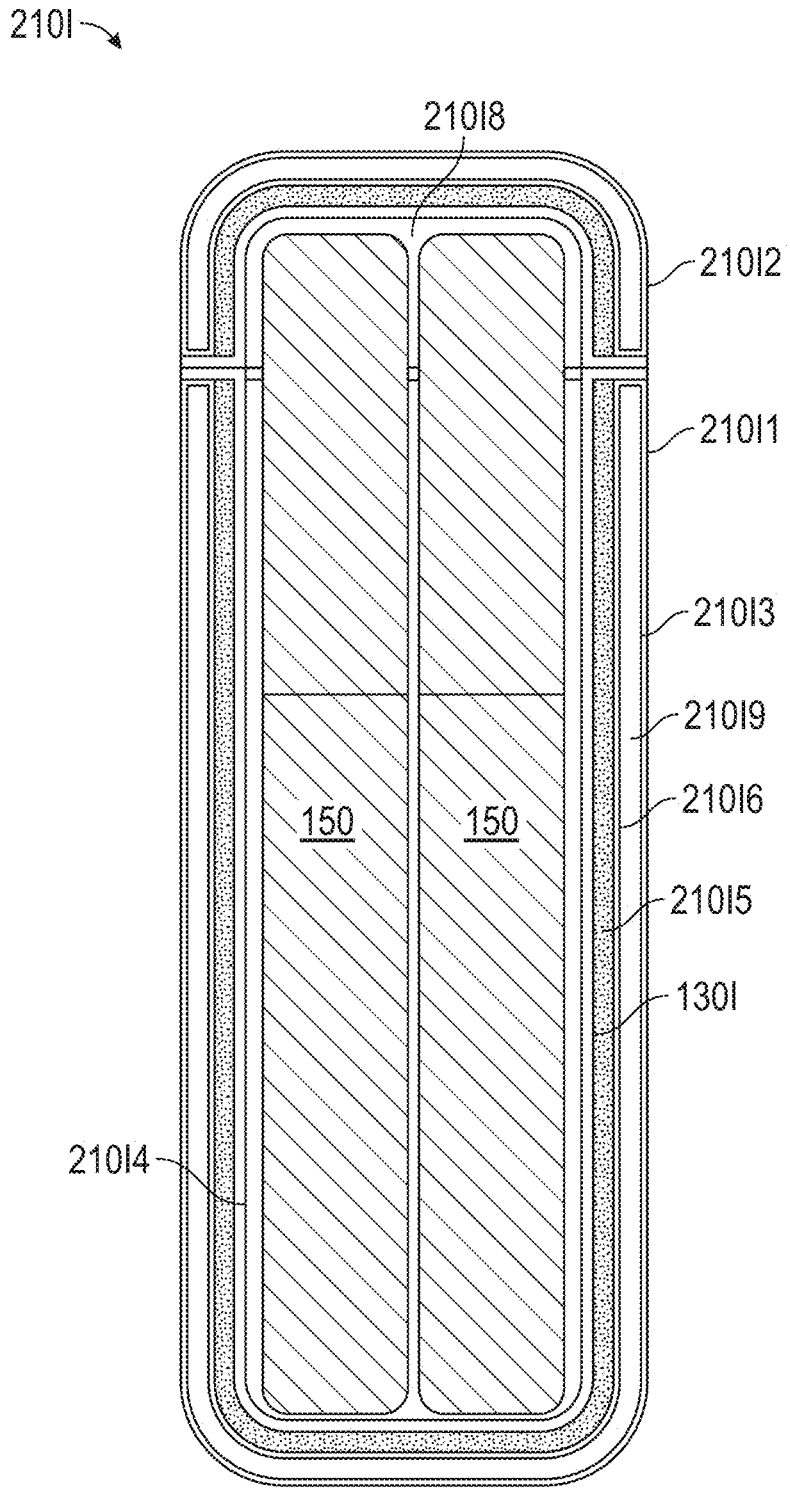
FIG. 17B shows a schematic cross-sectional view of the capsule in FIG. 17A for use with the cooler container of FIG. 17.

FIGS. 17-17B show a container system 100I (e.g., a capsule container) that includes a cooling system 200I. The container system 100I and cooling system 200I are similar to the container system 100H and cooling system 200H described above in connection with FIGS. 16-16A. Thus, references numerals used to designate the various components of the container system 100I and cooling system 200I are identical to those used for identifying the corresponding components of the container system 100H and cooling system 200H in FIGS. 16-16A, except that an "I" instead of an "H" is added to the numerical identifier. Therefore, the structure and description for the various components of the container system 100H and cooling system 200H in FIGS. 16-16A is understood to also apply to the corresponding components of the container system 100I and cooling system 200I in FIGS. 17-17B, except as described below.

As shown in FIG. 17, the container system 100I has a container vessel 120I and a lid L. The lid L can include a cooling system 200I. The container vessel 120I can optionally have one or more chambers 126I that extend to corresponding one or more openings 123I, each chamber 126I sized to receive and hold a container 150 (e.g., medicine containers, such as vials, cartridges (such as for injector pens), injector pens, etc.). Though FIG. 17 shows the container vessel 120I having six chambers 126I, one of skill in the art will recognize that the container vessel 120I can have more or fewer chambers 126I than shown in FIG. 17. Optionally, the container vessel 120I can have a chamber 126I2 that extends to an opening 123I2, the chamber 126I2 sized to receive a capsule 210I, which itself can hold one or more (e.g., one, two, etc.) containers 150 (e.g., medicine containers, such as vials, cartridges (such as for injector pens), injector pens, etc.), as further described below.

In one implementation, the container vessel 120I can have the same or similar structure as shown and described above for the container vessel 120, 120E, 120F, 120G, 120H. Optionally, the container vessel 120I can have a cavity between the chamber(s) 126I and the outer surface of the container vessel 120I that is vacuum insulated. In another implementation, the container vessel 120I excludes vacuum insulation and can instead have a gap or cavity between the chamber(s) 126I and an outer surface of the container vessel 120I that is filled with air. In still another implementation, the container vessel 120I can have a gap or cavity between the chamber(s) 126I and an outer surface of the container vessel 120I that includes an insulating material.

FIG. 17A-17B shows one implementation of a capsule 210I having a vessel portion 210I1 and a lid portion 210I2 (attached via a hinge 211I) that together can enclose one or more containers 150 (e.g., two containers 150 in FIG. 17A). The hinge 211I allows the lid portion 210I2 to be moved between a closed position an open position relative to the vessel portion 210I1. In the closed position, the lid portion 210I2 can optionally be held against the vessel portion 210I1 (e.g., by one or more magnetic surfaces of the lid portion 210I2 and/or vessel portion 210I1) to inhibit (e.g., prevent) the container 150 from inadvertently falling out of the capsule 210I.

The vessel portion 210I1 and lid portion 210I2 have an outer surface 210I3 and an inner surface 210I4 that defines a cavity 210I8 that receives the container(s) 150. The vessel portion 210I1 and lid portion 210I2 can also have an intermediate wall 210I6 radially between the inner surface 210I4 and the outer surface 210I3 that define a first cavity 210I5 between the inner wall 210I4 and the intermediate wall 210I6 and a second cavity 210I9 between the intermediate wall 210I6 and the outer surface 210I3. Optionally, the second cavity 210I5 can be vacuum insulated (i.e., the second cavity 210I5 can be under vacuum or negative pressure force). Optionally, the first cavity 210I5 can house a thermal mass material 130I. In one implementation, the thermal mass material 130I is a phase change material PCM (e.g., a solid-solid PCM, a solid-fluid PCM) that can transition from a heat absorbing state to a heat releasing state at a transition temperature. In another implementation, the cavity 210I5 is excluded and the capsule 210I instead has a wall that extends between the inner surface 210I4 and the intermediate wall(s) 210I6 that can absorb and release heat.

In operation, when a container 150 (e.g., medicine containers, such as vials, cartridges (such as for injector pens), injector pens, etc.) is inserted into the capsule 210I (e.g. into the vessel portion 210I1) and then inserted into the chamber 126I, and the lid L closed over the container vessel 120I, the lid portion 210I2 can be in the open position relative to the vessel portion 210I1 (see FIG. 17, 17A), allowing the thermal mass material 130I in the cavity 210I5 to be placed in thermal communication (e.g., thermally contact, directly contact) with a cold-side heat sink of the cooling system 200I (e.g., similar to the heat sink 210 in FIG. 4) that is itself in thermal communication with one or more TECs (e.g., similar to TEC 220 in FIG. 4), where the one or more TECs are operated to remove heat from (e.g., cool) the cold side heat sink, which in turn removes heat from (e.g., cools) the thermal mass material 130I and cavity 210I8 in the capsule 210I, as well as any containers 150 in the capsule 210I.

The capsule 210I can be removed along with one or more containers 150 (e.g., one at a time, two at a time, etc.) from the container vessel 120I (e.g., for placement in a user's purse, backpack, work bag during a commute or travel, etc.). Optionally, the capsule 210I can maintain the container(s) 150 in a cooled state for an extended period of time (e.g., between about 1 hour and about 15 hours, about 14 hours, between about 1 hour and about 10 hours, between about 1 hour and about 3 hours, about 2 hours, etc.). The capsule 210I can maintain the container 150 approximately at a temperature of about 2-8 degrees Celsius.

The capsule 210I can optionally have a wireless transmitter and/or transceiver and a power source (e.g., battery) disposed therein (e.g., disposed in the cavity 210I9), and can have a temperature sensors in communication with the cavity 210I8 (e.g., in thermal contact with the inner wall 210I4). The wireless transmitter and/or transceiver can optionally allow connectivity of the capsule 210I with an electronic device (e.g., a mobile electronic device, such as a smartphone), such as via an app on the electronic device, and can transmit sensed temperature information to the electronic device for tracking of internal temperature of the capsule 210I. Optionally, the transmitter and/or transceiver can transmit an alert signal to the electronic device (e.g., visual alert, audible alert), such as a notification via the app, if the sensed temperature exceeds a temperature range (e.g., predetermined temperature range, preselected temperature limit) for the medication in the container 150. When the capsule 210I is inserted into the chamber 126I of the container vessel 120I, the transmitter and/or transceiver can also wirelessly transmit sensed temperature data sensed by the temperature sensor to the electronic device. Optionally, when in the container vessel 120I, the battery in the capsule(s) 210I can be recharged (e.g., via induction power transfer, or via electrical contacts). In addition to maintaining the container 150 (and medication in the container 150) at or below a predetermined temperature range (e.g., 2-8 degrees C.) for a prolonged period of time (e.g., up to 14 hours, up to 10 hours, up to 5 hours, up to 3 hours, etc.), the capsule 210I can protect the container 150 therein from damage (e.g., breaking, spillage) if the capsule 210I is dropped.

In one implementation, the cooling system 200I receives power via a power cord PC that can be connected to a wall outlet. However, the power cord PC can have other suitable connectors that allow the cooling system 200I to receive power from a power source other than a wall outlet. Power can be provided from the container vessel 120I, to which the power cord PC is connected, to the cooling system 200I in the lid via one or more electrical contacts on a rim of the container vessel 120I and on the lid L (e.g., similar to electrical contacts 282 described above in connection with FIG. 3). In another implementation, the power cord PC is excluded and the container vessel 120I can have one or more batteries (such as batteries 277 in FIG. 4) that provide power to the cooling system 200I (e.g., via electrical contacts, such as contacts 282 in FIG. 3) when the lid L is disposed over the container vessel 120I.

Figure 18:
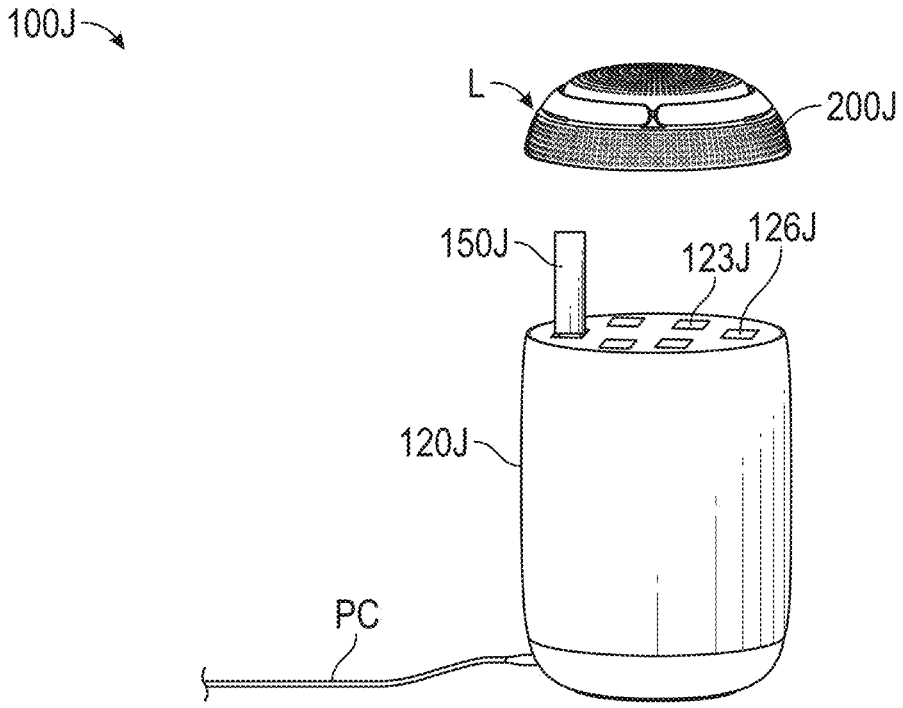
FIG. 18 shows a schematic perspective view of another cooler container.
Figure 18A:
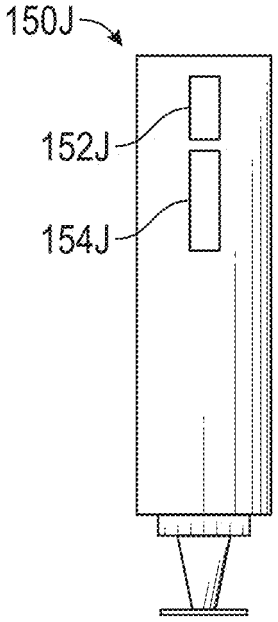
FIG. 18A shows a schematic view of an injector pen for use with cartridges taken from the cooler container of FIG. 18.
Figure 18B:
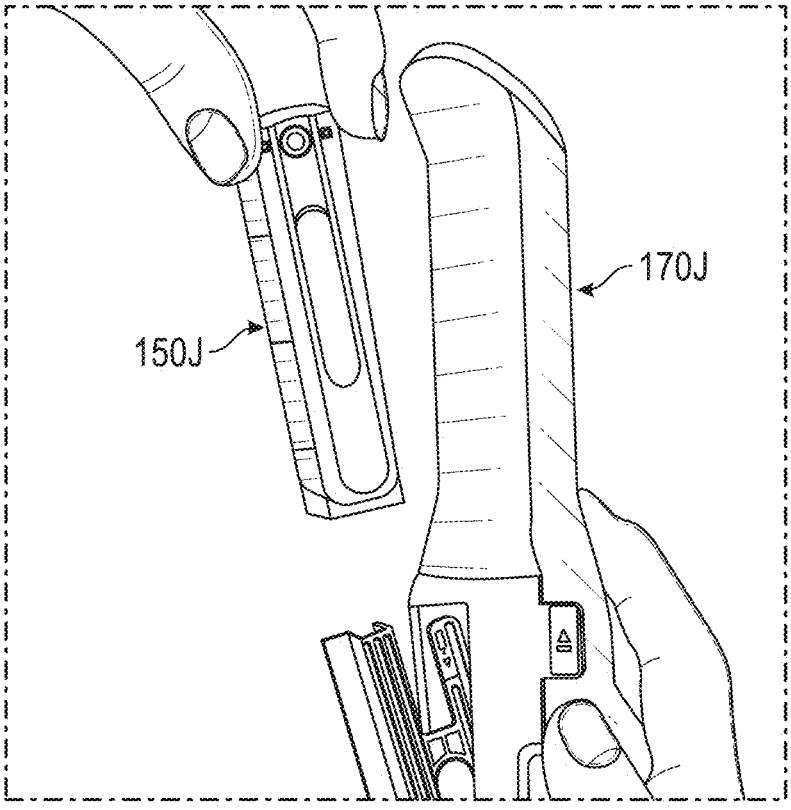
FIG. 18B shows a schematic partial view of a cartridge from the cooler container of FIG. 18 loaded into an injector pen.

FIGS. 18-18B show a container system 100J (e.g., a cartridge container) that includes a cooling system 200J. The container system 100J and cooling system 200J are similar to the container system 100H and cooling system 200H described above in connection with FIGS. 16-16A. Thus, references numerals used to designate the various components of the container system 100J and cooling system 200J are identical to those used for identifying the corresponding components of the container system 100H and cooling system 200H in FIGS. 16-16A, except that a "J" instead of an "H" is added to the numerical identifier. Therefore, the structure and description for the various components of the container system 100H and cooling system 200H in FIGS. 16-16A is understood to also apply to the corresponding components of the container system 100J and cooling system 200J in FIGS. 18-18B, except as described below.

As shown in FIG. 18, the container system 100J has a container vessel 120J and a lid L. The lid L can include a cooling system 200J. The container vessel 120J can optionally have one or more chambers 126J that extend to corresponding one or more openings 123J, each chamber 126J sized to receive and hold a container 150J (e.g., medicine containers, such as vials, cartridges (such as for injector pens), injector pens, etc.). In FIG. 16, the container 150J is a cartridge that can be separately inserted into an injector device (e.g., injector pen) 170J (see FIG. 18B), as discussed further below. The container vessel 120J differs from the container vessel 120H in that the opening(s) 123J and chamber(s) 126J are sized to receive container(s) 150J that are cartridges. Though FIG. 18 shows the container vessel 120J having six chambers 126J, each being sized to removably receive a container 150J (e.g., a cartridge), one of skill in the art will recognize that the container vessel 120J can have more or fewer chambers 126J than shown in FIG. 18.

In one implementation, the container vessel 120J can have the same or similar structure as shown and described above for the container vessel 120, 120E, 120F, 120G, 120H, 120I and can maintain the container(s) 150 in a cooled state of approximately at a temperature of about 2-8 degrees Celsius. Optionally, the container vessel 120J can have a cavity between the chamber(s) 126J and the outer surface of the container vessel 120J that is vacuum insulated. In another implementation, the container vessel 120J excludes vacuum insulation and can instead have a gap or cavity between the chamber(s) 126J and an outer surface of the container vessel 120J that is filled with air. In still another implementation, the container vessel 120J can have a gap or cavity between the chamber(s) 126J and an outer surface of the container vessel 120J that includes an insulating material.

FIG. 18A shows one implementation of a container 150J (e.g. a cartridge, an injector pen) that can optionally house a medication (e.g., epinephrine, insulin, a vaccine, etc.). the container 150J can have a temperature sensor 152J and a radiofrequency identification (RFID) tag or chip 154J, with the temperature sensors 152J being in communication (e.g., electrically connected) with the RFID chip 154J. The RFID chip 154J can store temperature data sensed by the temperature sensor 152J. Advantageously, the temperature sensor 152J can track the temperature of the container 150J from when it leaves the distribution center to when it arrives at a person's (consumer's) home, and to when it needs to be administered. The temperature data sensed by the temperature sensor 152J is stored in the RFID chip 154J, thereby providing a temperature history of the container 150J from when it leaves the distribution center to when it arrives at a person's (consumer's) home, and to when it needs to be administered. In one implementation, the container vessel 120J can have an optional RFID reader that can read the RFID chip 154J once the container 150J is inserted into the chamber 126J of the container vessel 120J to capture the temperature history stored in the RFID chip 154J. Optionally, the container system 100J can inform the user (e.g., via one or both of a graphical user interface on the container vessel 120J and an app on an electronic device paired with the container system 100J) that the medication in the container 150J (e.g., cartridge) can be delivered (e.g., that the temperature history read from the RFID chip 154J indicates the medication in the container 150J has been maintained within a predetermined temperature range, so that the medication is deemed effective for delivery).

FIG. 18B shows an injection device 170J (e.g., auto injection device) into which the container 150J can be inserted prior to use (e.g., prior to application of the auto injection device on the user to deliver a medication in the container 150J, such as via a needle of the injection device 170J). When the container 150J (e.g., cartridge) is removed from the container vessel 120J and placed into the injection device 170J, an optional RFID reader in the injection device 170J can read the RFID chip 154J and send an alert to the user (via one or both of a graphical user interface on the injection device 170J and an app on an electronic device paired with the injection device 170J) that the medication can be delivered (e.g., that the temperature history read from the RFID chip 154J indicates the medication in the container 150 has been maintained within a predetermined temperature range, so that the medication is deemed effective for delivery).

In operation, when a container 150J (e.g., medicine containers, such as vials, cartridges (such as for injector pens), injector pens, etc.) is inserted into the chamber 126J, and the lid L closed over the container vessel 120J, the container 150J can optionally be placed in thermal communication (e.g., thermally contact, directly contact) with a cold-side heat sink of the cooling system 200J (e.g., similar to the heat sink 210 in FIG. 4) that is itself in thermal communication with one or more TECs (e.g., similar to TEC 220 in FIG. 4), where the one or more TECs are operated to remove heat from (e.g., cool) the cold side heat sink, which in turn removes heat from (e.g., cools) the container(s) 150J in the vessel container 120J.

Optionally, the container 150J can optionally have a wireless transmitter and/or transceiver and a power source (e.g., battery) disposed therein. The wireless transmitter and/or transceiver can optionally allow connectivity of the container 150J with an electronic device (e.g., a mobile electronic device, such as a smartphone), such as via an app on the electronic device, and can transmit sensed temperature information (from the temperature sensor 152J) to the electronic device for tracking of internal temperature of the container 150J (e.g., in addition to or in place of tracking the sensed temperature history of the container 150J via the RFID chip 154J). Optionally, the transmitter and/or transceiver can transmit an alert signal to the electronic device (e.g., visual alert, audible alert), such as a notification via the app, if the sensed temperature exceeds a temperature range (e.g., predetermined temperature range, preselected temperature limit) for the medication in the container 150J. When the container 150J is inserted into the chamber 126J of the container vessel 120J, the transmitter and/or transceiver can also wirelessly transmit sensed temperature data sensed by the temperature sensor 152J to the electronic device. Optionally, when in the container vessel 120J, the battery in the container 150J can be recharged (e.g., via induction power transfer, or via electrical contacts).

In one implementation, the cooling system 200J receives power via a power cord PC that can be connected to a wall outlet. However, the power cord PC can have other suitable connectors that allow the cooling system 200J to receive power from a power source other than a wall outlet. Power can be provided from the container vessel 120J, to which the power cord PC is connected, to the cooling system 200J in the lid via one or more electrical contacts on a rim of the container vessel 120J and on the lid L (e.g., similar to electrical contacts 282 described above in connection with FIG. 3). In another implementation, the power cord PC is excluded and the container vessel 120J can have one or more batteries (such as batteries 277 in FIG. 4) that provide power to the cooling system 200J (e.g., via electrical contacts, such as contacts 282 in FIG. 3) when the lid L is disposed over the container vessel 120J.

Figure 19A:
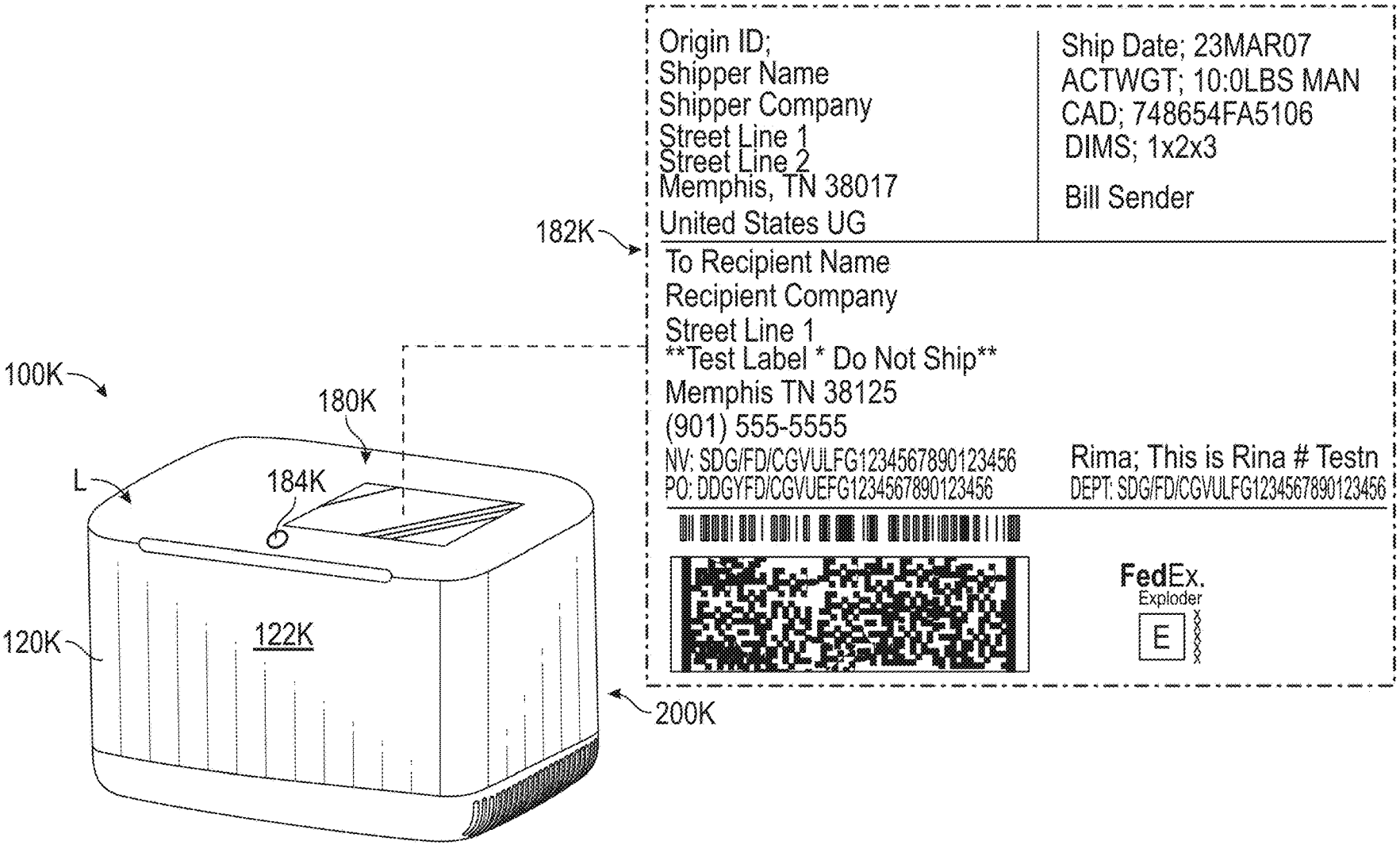
FIG. 19A shows a schematic perspective view of a cooler container.

FIG. 19A shows a container system 100K (e.g., a medicine cooler container) that includes a cooling system 200K. Though the container system 100K has a generally box shape, in other implementations it can have a generally cylindrical or tube shape, similar to the container system 100, 100E, 100F, 100G, 100H, 100I, 100J. In one implementation, the cooling system 200K can be in the lid L of the container system 100K and can be similar to (e.g., have the same or similar components as) the cooling system 200, 200E, 200F, 200G, 200H, 200I, 200J. In another implementation, the cooling system can be disposed in a portion of the container vessel 120K (e.g. a bottom portion of the container vessel 120K).

As shown in FIG. 19A, the container system 100K can include a display screen 180K. Though FIG. 19A shows the display screen 180K on the lid L, it can alternatively (or additionally) be incorporated into a side surface 122K of the container vessel 120K. The display screen 180K can be an electronic ink or E-ink display (e.g., electrophoretic ink display). In another implementation, the display screen 180K can be a digital display (e.g., liquid crystal display or LCD, light emitting diode or LED, etc.). Optionally, the display screen 180K can display a label 182K (e.g., a shipping label with one or more of an address of sender, an address of recipient, a Maxi Code machine readable symbol, a QR code, a routing code, a barcode, and a tracking number). The container system 100K can also include a user interface 184K. In FIG. 19A, the user interface 184K is a button on the lid L. In another implementation, the user interface 184K is disposed on the side surface 122K of the container vessel 120K. In one implementation, the user interface 184K is a depressible button. In another implementation, the user interface 184K is a capacitive sensor (e.g., touch sensitive sensor). In another implementation, the user interface 184K is a sliding switch (e.g., sliding lever). In another implementation, the user interface 184K is a rotatable dial. Advantageously, actuation of the user interface 184K can alter the information shown on the display 180K, such as the form of a shipping label shown on an E-ink display 180K. For example, actuation of the user interface 184K, can switch the text associated with the sender and receiver, allowing the container system 100K to be shipped back to the sender once the receiving party is done with it.

Figure 19B:
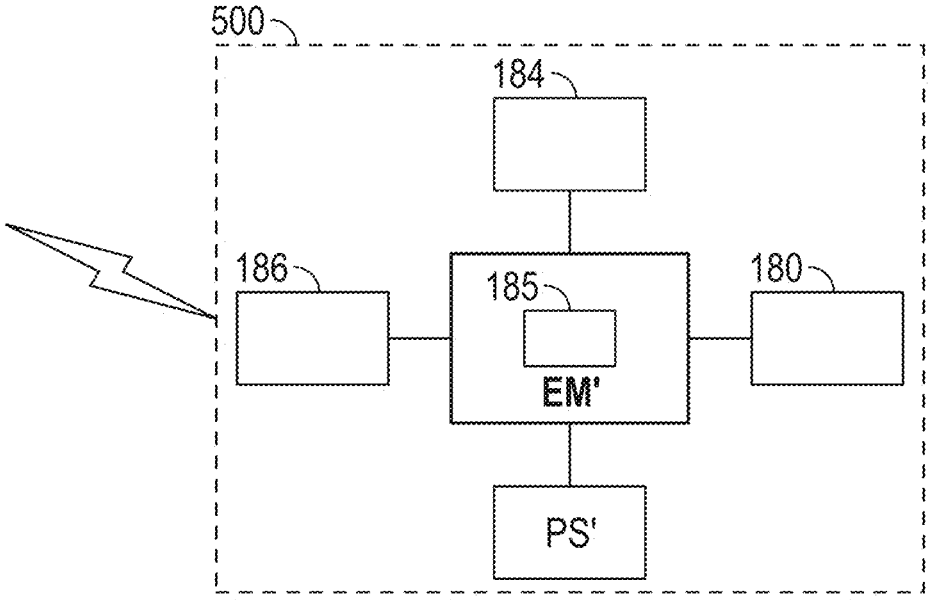
FIG. 19B is a is a schematic block diagram showing electronics in the cooler container associated with operation of the display screen of the cooler container.

FIG. 19B shows a block diagram of electronics 500 of the container system 100K. The electronics 500 can include circuitry EM' (e.g., including one or more processors on a printed circuit board). The circuitry EM' communicate with one or more batteries PS', with the display screen 180K, and with the user interface 184K. Optionally, a memory module 185K is in communication with the circuitry EM'. In one implementation, the memory module 185K can optionally be disposed on the same printed circuit board as other components of the circuitry EM'. The circuitry EM' optionally controls the information displayed on the display screen 180K. Information (e.g., sender address, recipient address, etc.) can be communicated to the circuitry EM' via an input module 186K. The input module 186K can receive such information wirelessly (e.g., via radiofrequency or RF communication, via infrared or IR communication, via WiFi 802.11, via BLUETOOTH®, etc.), such as using a wand (e.g., a radiofrequency or RF wand that is waved over the container system 100K, such as over the display screen 180K, where the wand is connected to a computer system where the shipping information is contained). Once received by the input module 186K, the information (e.g., shipping information for a shipping label to be displayed on the display screen 180K can be electronically saved in the memory module 185K). Advantageously, the one or more batteries PS' can power the electronics 500, and therefore the display screen 180K for a plurality of uses of the container 100K (e.g., during shipping of the container system 100K up to one-thousand times).

Figure 20A:
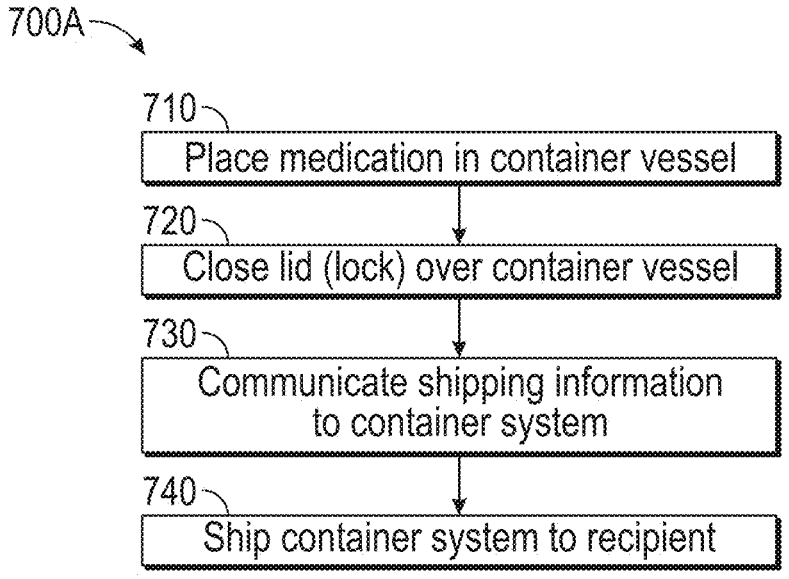
FIGS. 20A-20B show block diagrams of a method for operating the cooler container of FIG. 19A.

FIG. 20A shows a block diagram of one method 700A for shipping the container system 100K. At step 710, one or more containers, such as containers 150, 150J (e.g., medicine containers, such as vials, cartridges (such as for injector pens), injector pens, vaccines, medicine such as insulin, epinephrine, etc.) are placed in the container vessel 120K of the container system 100K, such as at a distribution facility for the containers 150, 150J. At step 720, the lid L is closed over the container vessel 120K once finished loading all containers 150, 150J into the container vessel 120K. Optionally, the lid L is locked to the container vessel 120K (e.g., via a magnetically actuated lock, including an electromagnet actuated when the lid is closed that can be turned off with a code, such as a digital code). At step 730, information (e.g., shipping label information) is communicated to the container system 100K. For example, as discussed above, a radiofrequency (RF) wand can be waved over the container system 100K (e.g., over the lid L) to transfer the shipping information to the input module 186K of the electronics 500 of the container system 100K. At step 740, the container system 100K is shipped to the recipient (e.g., displayed on the shipping label 182K on the display screen 180K).

Figure 20B:
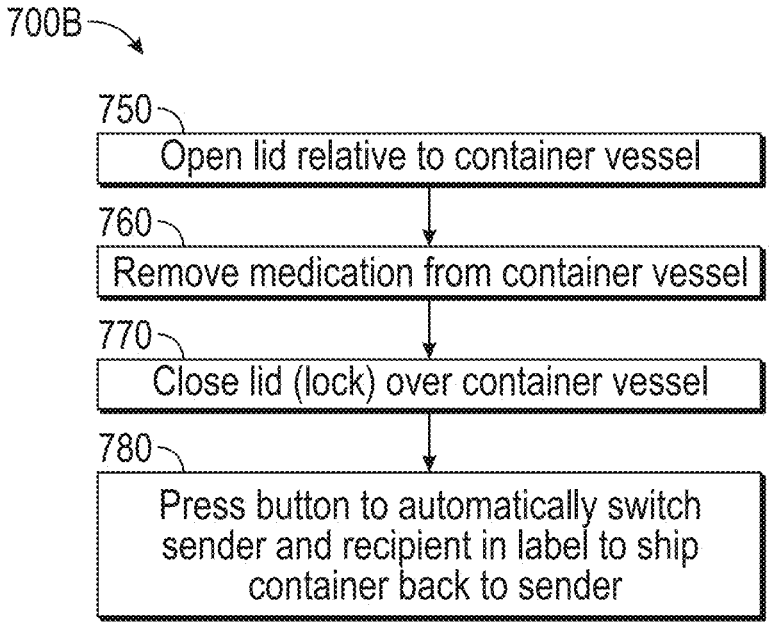
Figure 21A:
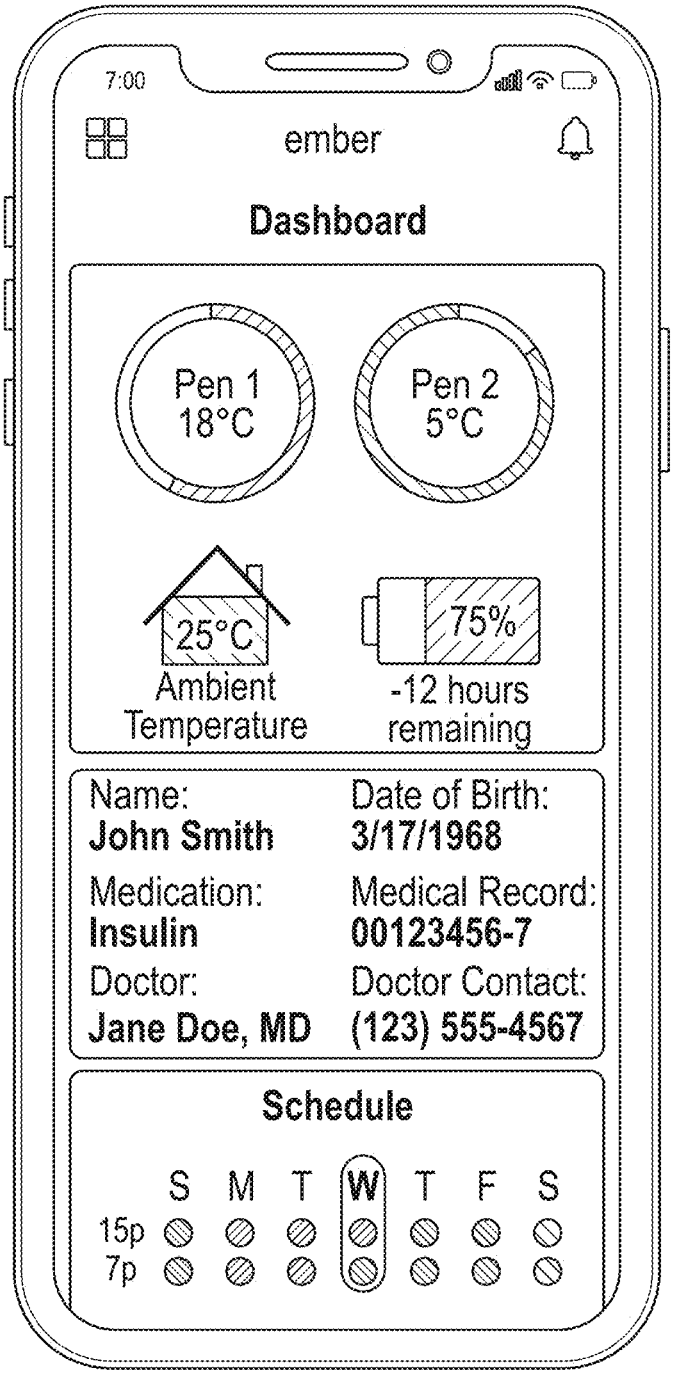
FIGS. 21A-21D are schematic user interfaces for an electronic device for use with a cooler container.
Figure 21B:
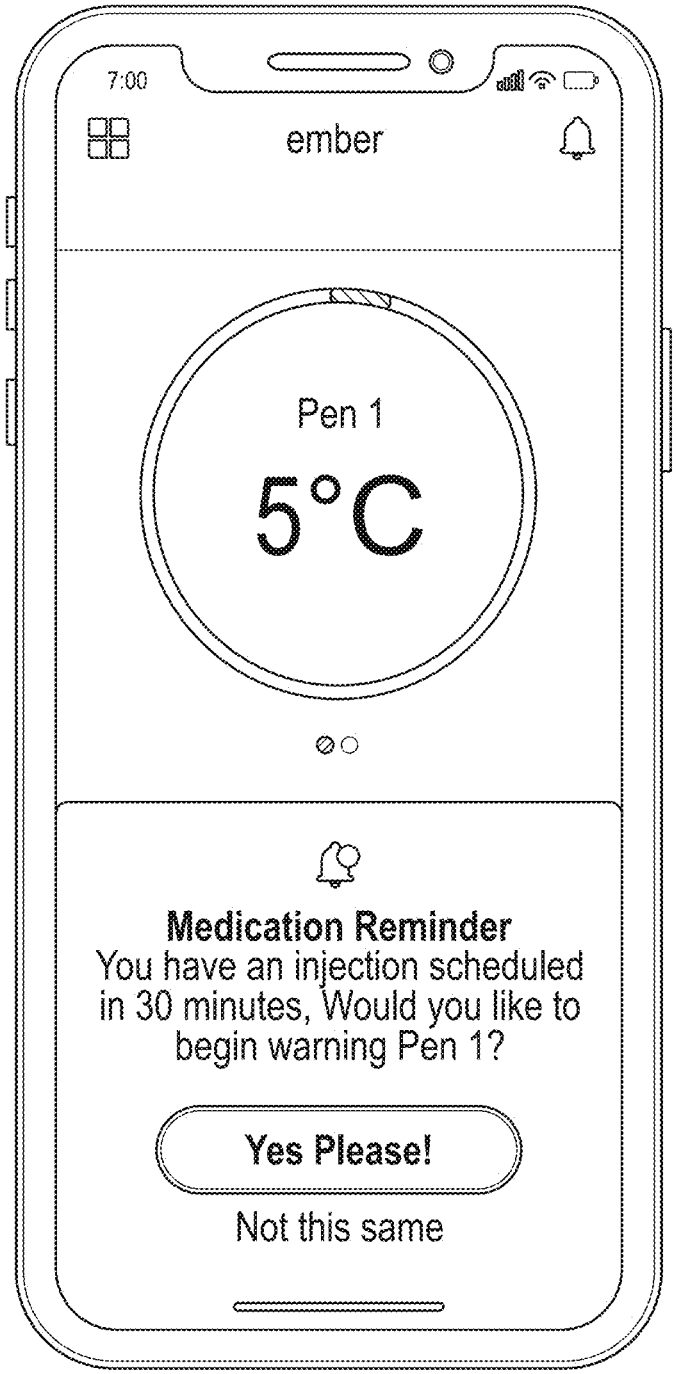
Figure 21C:
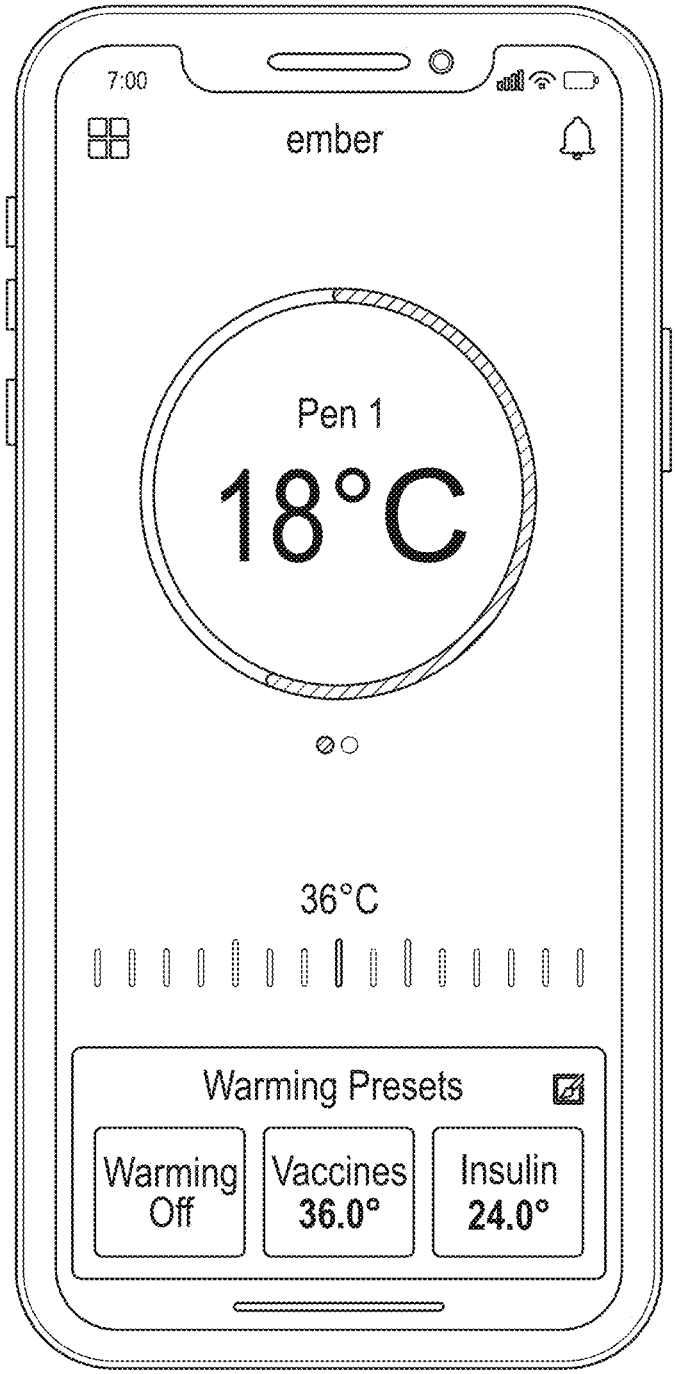
Figure 21D:
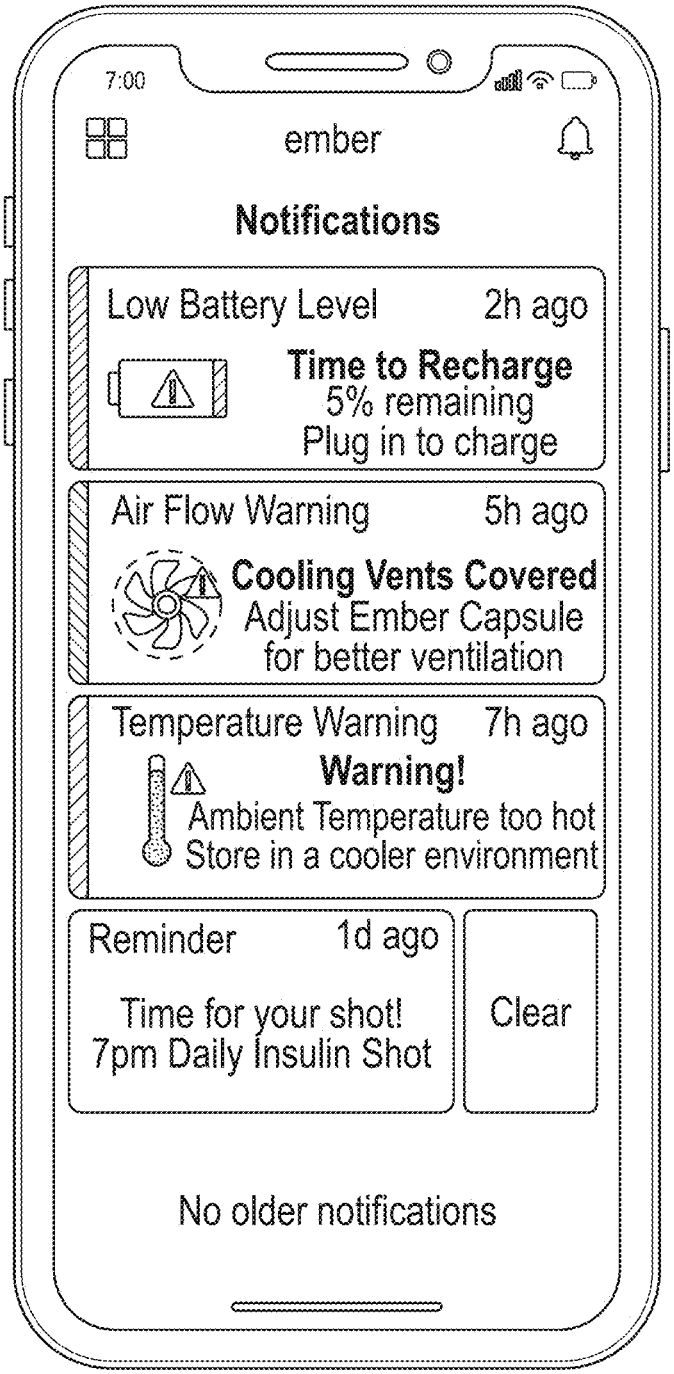

FIG. 20B shows a block diagram of a method 700B for returning the container 100K. At step 750, after receiving the container system 100K, the lid L can be opened relative to the container vessel 120K. Optionally, prior to opening the lid L, the lid L is unlocked relative to the container vessel 100K (e.g., using a code, such as a digital code, provided to the recipient from the shipper). At step 760, the one or more containers 150, 150J are removed from the container vessel 120K. At step 770, the lid L is closed over the container vessel 120K. At step 780, the user interface 184K (e.g., button) is actuated to switch the information of the sender and recipient in the display screen 180 with each other, advantageously allowing the return of the container system 100K to the original sender to be used again without having to reenter shipping information on the display screen 180K. The display screen 180K and label 182K advantageously facilitate the shipping of the container system 100K without having to print any separate labels for the container system 100K. Further, the display screen 180K and user interface 184K advantageously facilitate return of the container system 100K to the sender (e.g. without having to reenter shipping information, without having to print any labels), where the container system 100K can be reused to ship containers 150, 150J (e.g., medicine containers, such as vials, cartridges (such as for injector pens), injector pens, vaccines, medicine such as insulin, epinephrine, etc.) again, such as to the same or a different recipient. The reuse of the container system 100K for delivery of perishable material (e.g., medicine) advantageously reduces the cost of shipping by allowing the reuse of the container vessel 120K (e.g., as compared to commonly used cardboard containers, which are disposed of after one use).

FIGS. 21A-21D show different screens of a graphical user interface (GUI) used on a remote electronic device (e.g., mobile electronic device, such as a mobile phone, tablet computer). The GUI advantageously allows a user to interface with the cooling system 200, 200E, 200F, 200G, 200H, 200I, 200J, 200K, 200L provide control settings (e.g., temperature presets for different medications in the containers 150, 150J), provide scheduling information (e.g., for the consumption of medication in the containers 150, 150J), provide alerts (e.g., battery life of the cooling system, temperature of the container(s) 150, 150J). The GUI can provide additional information not shown on the screens in FIGS. 21A-21D. Via the GUI, a user can communicate with the cooling system 200, 200E, 200F, 200G, 200H, 200I, 200J, 200K, 200L when they are ready to ingest the contents of the container 150, 150J and the system 200, 200E, 200F, 200G, 200H, 200I, 200J, 200K, 200L can optionally heat one of the containers 150, 150J a predetermined temperature (e.g., body temperature, room temperature) and optionally alert the user when ready (via the GUI) to notify the user when the contents (e.g., medication) is ready for consumption. Optionally, where the container vessel 120, 120E, 120F, 120G, 120H, 120I, 120J, 120K, 120L includes more than one container 150, 150J, the user can communicate via the GUI with the system 200, 200E, 200F, 200G, 200H, 200I, 200J, 200K, 200L to prepare (e.g., heat) one of the containers (e.g., to body temperature) while the rest of the containers 150, 150J in the container vessel 100 remain in a cooled state. Optionally, once the container 150, 150J has been prepared (e.g., heated), in addition to notifying the user that the contents (e.g., medication) in the container 150, 150J is ready for consumption, it can also actuate the chamber 126, 126', 126E, 126F1, 126F2, 126G1, 126L to move it to the extended position (e.g., via one of the linear actuation mechanisms disclosed herein) so when the user removes the lid from the container vessel 120, 120E, 120F, 120G, 120H, 120I, 120J, 120K, 120L the user can readily identify which of the containers 150, 150J is the one that is ready for consumption (e.g., which one has been heated to room temperature or body temperature), while the rest of the chambers 126, 126', 126E, 126F1, 126F2, 126G1, 126L remain in the retracted position.

Figure 22A:
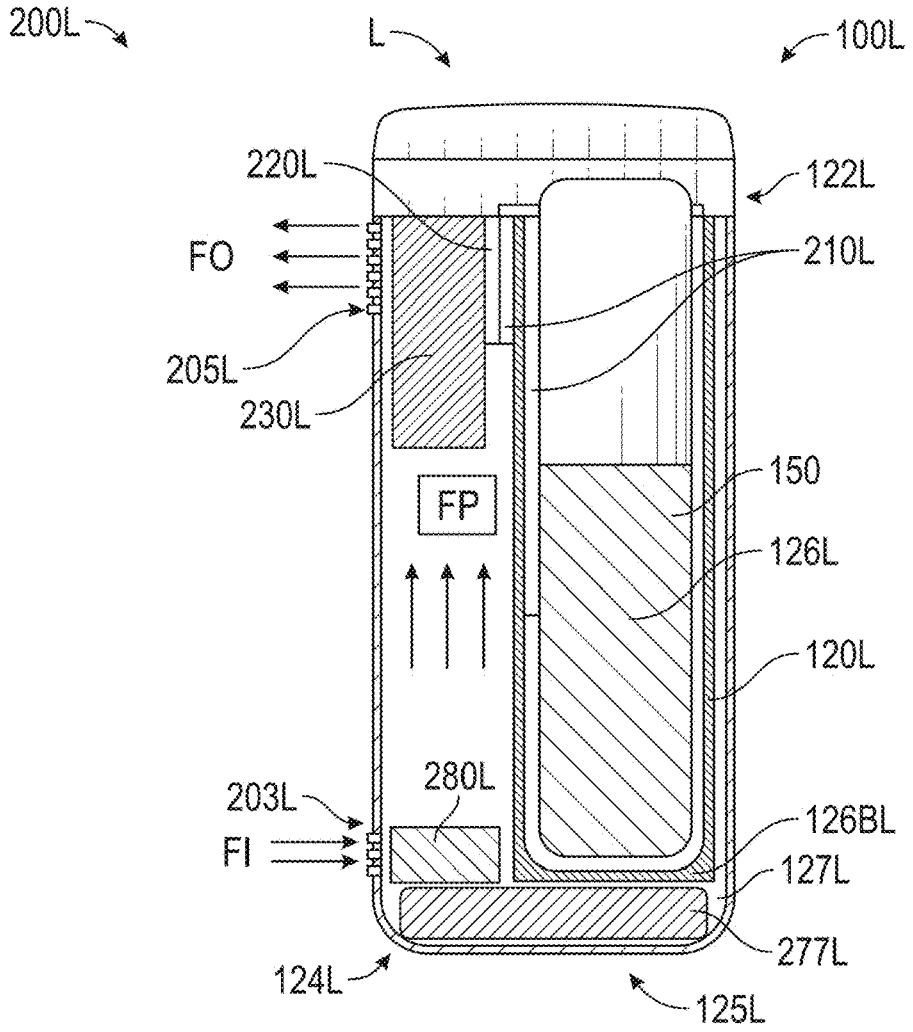
FIG. 22A is a schematic longitudinal cross-sectional view of a cooler container.
Figure 22B:
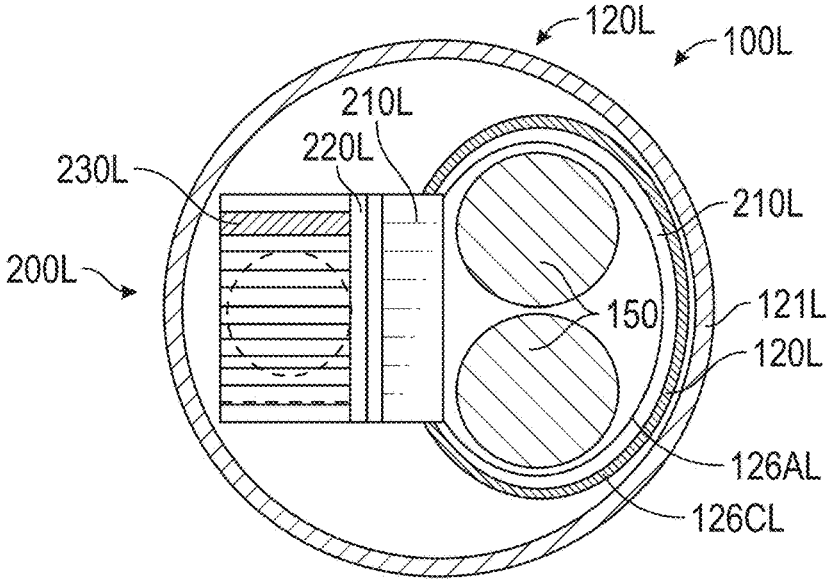
FIG. 22B is a schematic transverse cross-sectional view of the cooler container in FIG. 22A.
Figure 23:
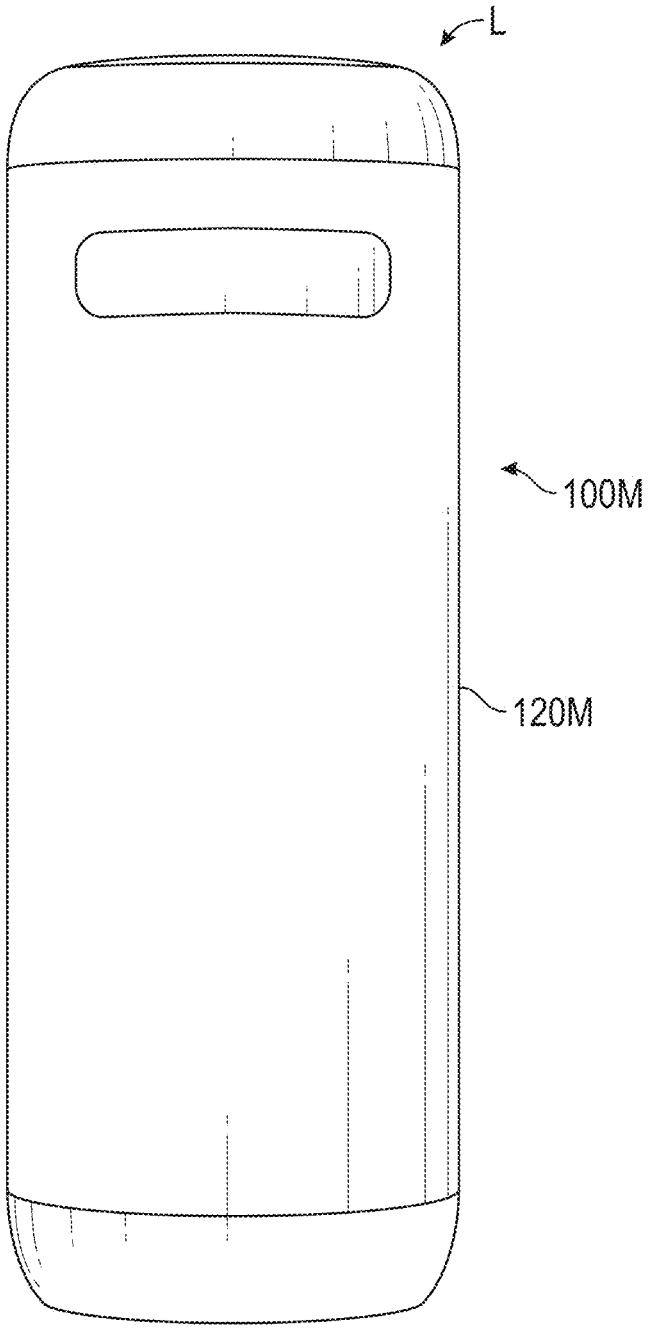
FIG. 23 is a schematic view of one embodiment of a cooler container.
Figure 24:
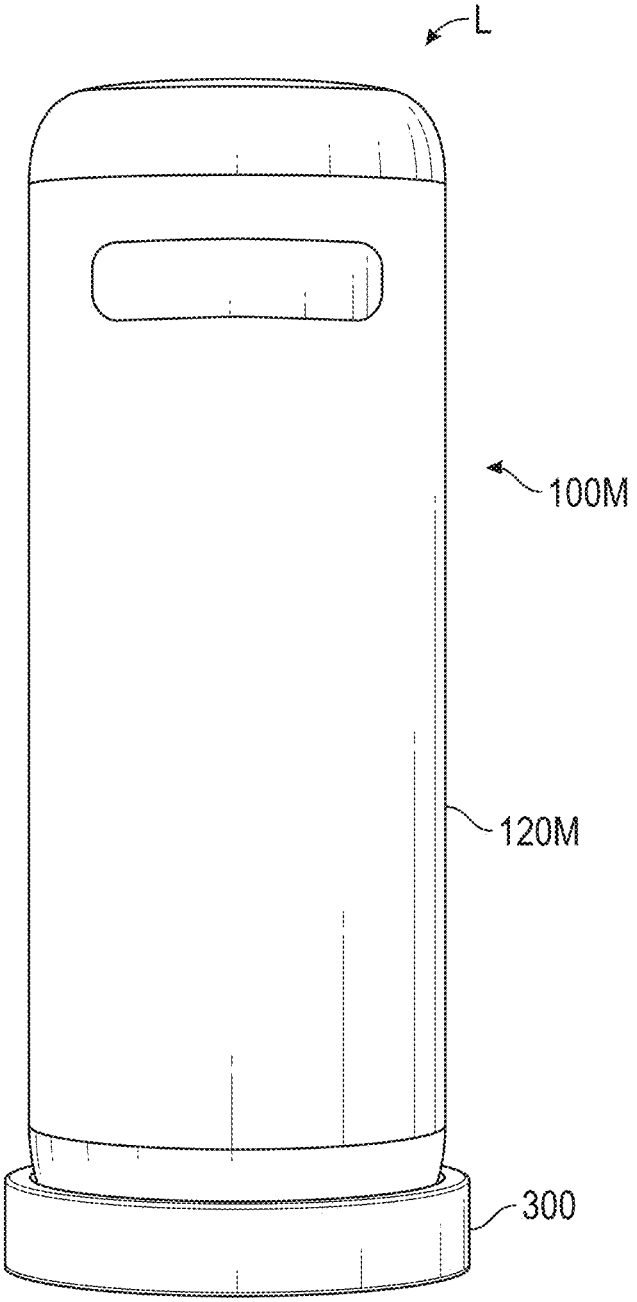
FIG. 24 is a schematic view of the cooler container of FIG. 23 on one embodiment of a charging base.
Figure 25:
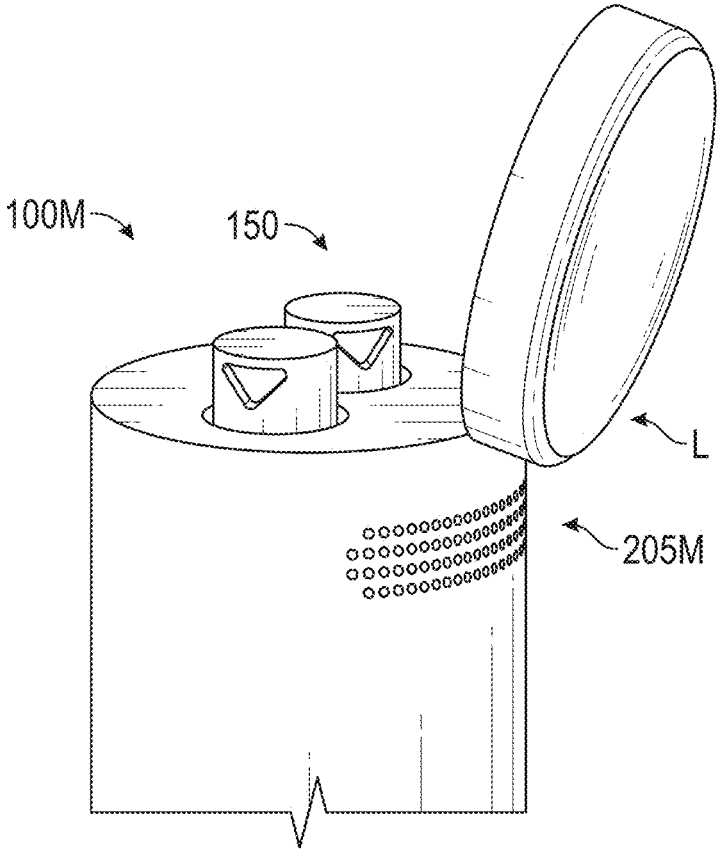
FIG. 25 is a perspective partial view of the cooler container of FIG. 23 with the lid open, exposing two injector pens in the cooler container.

FIGS. 22A-22B show a container system 100L (e.g., capsule container) that includes a cooling system 200L. Some of the features of the container system 100L and cooling system 200L are similar to features of the container system 100-100K and cooling system 200-200K in FIGS. 1-19A. Thus, reference numerals used to designate the various components of the container system 100L and cooling system 200K are identical to those used for identifying the corresponding components of the container system 100-100K and cooling system 200-200K in FIGS. 1-19A, except that an "L" has been added to the numerical identifier. Therefore, the structure and description for the various features of the container system 100-100K and cooling system 200-200K and how it's operated and controlled in FIGS. 1-19A are understood to apply to the corresponding features of the container system 100L and cooling system 200L in FIG. 22A-22B, except as described below.

The container system 100L has a container vessel 120L that is optionally cylindrical. The container vessel 120L is optionally a cooler with active temperature control provided by the cooling system 200L to cool the contents of the container vessel 120L and/or maintain the contents of the vessel 120L in a cooled or chilled state. Optionally, the vessel 120L can hold therein one or more (e.g., a plurality of) separate containers 150 (e.g., medicine containers, such as injector pens, vials, cartridges (such as for injector pens), etc.). Optionally, the one or more (e.g., plurality of) separate containers 150 that can be inserted into the container vessel 120L can contain a medication or medicine (e.g., epinephrine, insulin, vaccines, etc.).

The container vessel 120L has an outer wall 121L that extends between a proximal end 122L that has an opening and a distal end 124L having a base 125L. The opening is selectively closed by a lid L removably attached to the proximal end 122L. the vessel 120L has an inner wall 126AL and a base wall 126BL that together define an open chamber 126L that can receive and hold contents to be cooled therein (e.g., medicine containers, such as one or more vials, cartridges, injector pens, etc.). The vessel 120L can optionally have an intermediate wall 126CL spaced about the inner wall 126AL and base wall 126BL, such that the intermediate wall 126CL is at least partially disposed between the outer wall 121L and the inner wall 126AL. The intermediate wall 126CL is spaced apart from the inner wall 126AL and base wall 126BL so as to define a gap between the intermediate wall 126CL and the inner wall 126AL and base wall 126B. The gap can optionally be under vacuum so that the inner wall 126AL and base 126BL are vacuum insulated relative to the intermediate wall 126CL and the outer wall 121L of the vessel 120L.

Optionally, one or more of the inner wall 126AL, intermediate wall 126CL and outer wall 121L can be made of metal (e.g., stainless steel). In one implementation, the inner wall 126AL, base wall 126BL and intermediate wall 126CL are made of metal (e.g., stainless steel). In another implementation, one or more portions (e.g., outer wall 121L, intermediate wall 126CL and/or inner wall 126AL) of the vessel 120L can be made of plastic.

The vessel 120L has a cavity 127L between the base wall 126BL and the base 125L of the vessel 120L. The cavity 127L can optionally house electronics, such as, for example, one or more batteries 277L and one or more printed circuit boards (PCBA) with circuitry that controls the operation of the cooling system 200L. In one implementation, the cavity 127L can optionally house a power button or switch actuatable by a user through the bottom of the vessel 120L. Optionally, at least a portion of the base 125L (e.g. a cap of the base 125L) is removable to access the electronics in the cavity 127L (e.g., to replace the one or more batteries 277L, perform maintenance on the electronics, such as the PCBA, etc.). The power button or switch is accessible by a user (e.g., can be pressed to turn on the cooling system 200L, pressed to turn off the cooling system 200L, pressed to pair the cooling system 200L with a mobile electronic device, etc.). Optionally, the power switch can be located generally at the center of the base 125L.

The cooling system 200L is optionally at least partially housed in the vessel 120L. In one implementation, the cooling system 200L can include a first heat sink (cold side heat sink) 210L in thermal communication with one or more thermoelectric elements (TECs) 220L, such as Peltier element(s), and can be in thermal communication with the chamber 126L of the vessel 120L (e.g., via contact with the inner wall 126AL, via conduction with air in the chamber 126L, etc.). The first heat sink 210L portion outside the vessel 120L communicates with the first heat sink 210L portion inside the vessel 120L via a first heat sink 210L portion (e.g., bridge portion) that interconnects the portions of the first heat sink 210L outside and inside the vessel 120L.

The one or more TECs 220L are selectively operated (e.g., by the circuitry) to draw heat from the first heat sink (e.g., cold-side heat sink) 210L and transfer it to the second heat sink (hot-side heat sink) 230L. A fan 280L is selectively operable to draw air into the vessel 120L (e.g., into a channel FP of the vessel 120L) to dissipate heat from the second heat sink 230L, thereby allowing the TECs 220L to draw further heat from the first heat sink 210L, and thereby draw heat from the chamber 126L. During operation of the fan 280L, intake air flow Fi is drawn through one or more intake vents 203L (having one or more openings) in the vessel 120L and over the second heat sink 230L (where the air flow removes heat from the second heat sink 230L), after which the exhaust air flow Fo flows out of one or more exhaust vents 205L (having one or more openings) in the vessel 120L.

The chamber 126L optionally receives and holds one or more (e.g., a plurality of) containers 150 (e.g., medicine containers, such as injector pens or cartridges for injector pens, vials, etc.). In one implementation, the first heat sink 210L can be made of aluminum. However, the first heat sink 210L can be made of other suitable materials (e.g., metals with high thermal conductivity).

The electronics (e.g., PCBA, batteries 277L) can electrically communicate with the fan 280L and TECs 220L. Accordingly, power can be provided from the batteries 277L to the TECs 220L and/or fan 280L, and the circuitry (e.g., in or on the PCBA) can control the operation of the TECs 220L and/or fan 280L.

The container 100L can optionally have a visual display on the outer surface 121L of the vessel 120L (e.g., on the lid L). The visual display can optionally display one or more of the temperature in the chamber 126L, the temperature of the first heat sink 210L, the ambient temperature, a charge level or percentage for the one or more batteries 277L, and amount of time left before recharging of the batteries 277L is needed, etc. The visual display can optionally include a user interface (e.g., pressure sensitive buttons, capacitance touch buttons, etc.) to adjust (up or down) the temperature preset at which the cooling system 200L is to cool the chamber 126L. Accordingly, the operation of the container 100L (e.g., of the cooling system 200L) can be selected via the visual display and user interface on a surface of the container 100L. Optionally, the visual display can include one or more hidden-til-lit LEDs. Optionally, the visual display can include an electrophoretic or electronic ink (e-ink) display. In one variation, the container 100L can optionally include a hidden-til-lit LED that can selectively illuminate (e.g., to indicate one or more operating functions of the container 100L, such as to indicate that the cooling system 200L is in operation). The LED can optionally be a multi-color LED selectively operable to indicate one or more operating conditions of the container 100L (e.g., green if normal operation, red if abnormal operation, such as low battery charge or inadequate cooling for sensed ambient temperature, etc.).

In operation, the cooling system 200L can optionally be actuated by pressing a power button. Optionally, the cooling system 200L can additionally (or alternatively) be actuated remotely (e.g., wirelessly) via a remote electronic device, such as a mobile phone, tablet computer, laptop computer, etc. that wirelessly communicates with the cooling system 200L (e.g., with a receiver or transceiver of the circuitry). In still another implementation, the cooling system 200L can automatically cool the chamber 126L when the lid L is in a closed position on the vessel 120L. The chamber 126L can be cooled to a predetermined and/or a user selected temperature or temperature range, or automatically cooled to a temperature preset corresponding to the contents in the containers 150 (e.g., insulin, epinephrine, vaccines, etc.). The user selected temperature or temperature range can be selected via a user interface on the container 100L and/or via the remote electronic device.

In one variation, the container system 100L is powered using 12 VDC power (e.g., from one or more batteries 277L or a power base on which the vessel 120L is placed). In another variation, the container system 100L is powered using 120 VAC or 240 VAC power, for example using a power base. The circuitry in the container 100L can include a surge protector to inhibit damage to the electronics in the container 100L from a power surge. The container system 100L is advantageously easy to assemble and simpler to use. For example, inclusion of the cooling system 200 in the vessel 120L makes it easier for users with limitations in hand articulation (e.g., users suffering from arthritis) to open the lid L (e.g., because it is lighter or weighs less) to remove the container(s) 150 (e.g., vaccines, insulin, medical containers) from the chamber 126L. The lid L can optionally be insulated (e.g., be made of a hollow plastic body filled with foam insulation, such as light density Styrofoam).

FIGS. 23-31C show a container system 100M (e.g., capsule container) that includes a cooling system. Some of the features of the container system 100M and cooling system are similar to features of the container system 100-100L and cooling system 200-200L in FIGS. 1-22B. Thus, reference numerals used to designate the various components of the container system 100M and its cooling system are identical to those used for identifying the corresponding components of the container system 100-100L and cooling system 200-200L in FIGS. 1-22B, except that an "M" has been added to the numerical identifier. Therefore, the structure and description for the various features of the container system 100-100L and cooling system 200-200L and how it's operated and controlled in FIGS. 1-22B are understood to apply to the corresponding features of the container system 100M and its cooling system in FIG. 23-31C, except as described below. The features of the capsule container 100M, such as the visual display 110M described below, can be incorporated in any of the capsule containers 100, 100E, 100F, 100G, 100H, 100I, 100J, 100K, 100L described above.

The container system or capsule container 100M is similar in shape as the capsule container 100L described above. It can be cylindrical in shape with a lid L that can movably cover one or more openings 123M in a vessel 120M of the capsule container 100M that receive one or more (e.g., a plurality of) containers 150 (e.g., medicine containers, such as injector pens or cartridges for injector pens, vials, etc.). The capsule container 100M can be sized to at least partially couple with a power base 300 that can provide power to the electronics in the container 100M to, for example, charge the one or more batteries or provide power directly to the thermoelectric components (e.g., Peltier element(s)) and/or fan(s) of the cooling system of the capsule container 100M as described previously (e.g., in connection with capsule container 100L).

The capsule container 100M has one or more exhaust vents 205M (see FIG. 25) having one or more openings in the vessel 120M via which airflow is exhausted after air is driven (by fan(s) past one or more heat sink(s) connected to thermoelectric elements in the vessel 120M. Though not shown, the capsule container 100M has air intake vents in the vessel 120M, similar to the air intake vents 203L of the container 100L.

With reference to FIGS. 26A-31C, the capsule container 100M differs from the capsule container 100L in that it includes a visual display (e.g., electronic display) 110M on the lid L (e.g., on a top surface of the lid L). Power to the visual display 110M can optionally be provided via the hinged connection between the lid L and the vessel 120M, or via electrical contacts between the lid L and the vessel 120M (e.g., where batteries PS are disposed in the vessel 120M). Optionally, the visual display 110M can be an electrophoretic (e.g., electronic ink or E-ink) display. In other implementations, the visual display 110M is a liquid crystal display (LCD). The visual display 110M can be powered by one or more batteries (such as batteries 277L in vessel 100L) in the vessel 120M, and can communicate with circuitry (e.g., EM in FIG. 9) in the vessel 120M. The circuitry EM can control the information shown on the visual display 110M. The circuitry EM can also communicate wirelessly (e.g., with a smartphone or other remote electronic device, with a smartwatch (e.g., Apple® watch), with a virtual personal assistant (e.g., Alexa), which can then route messages from the circuitry EM through a smart speaker.

Figure 26A:
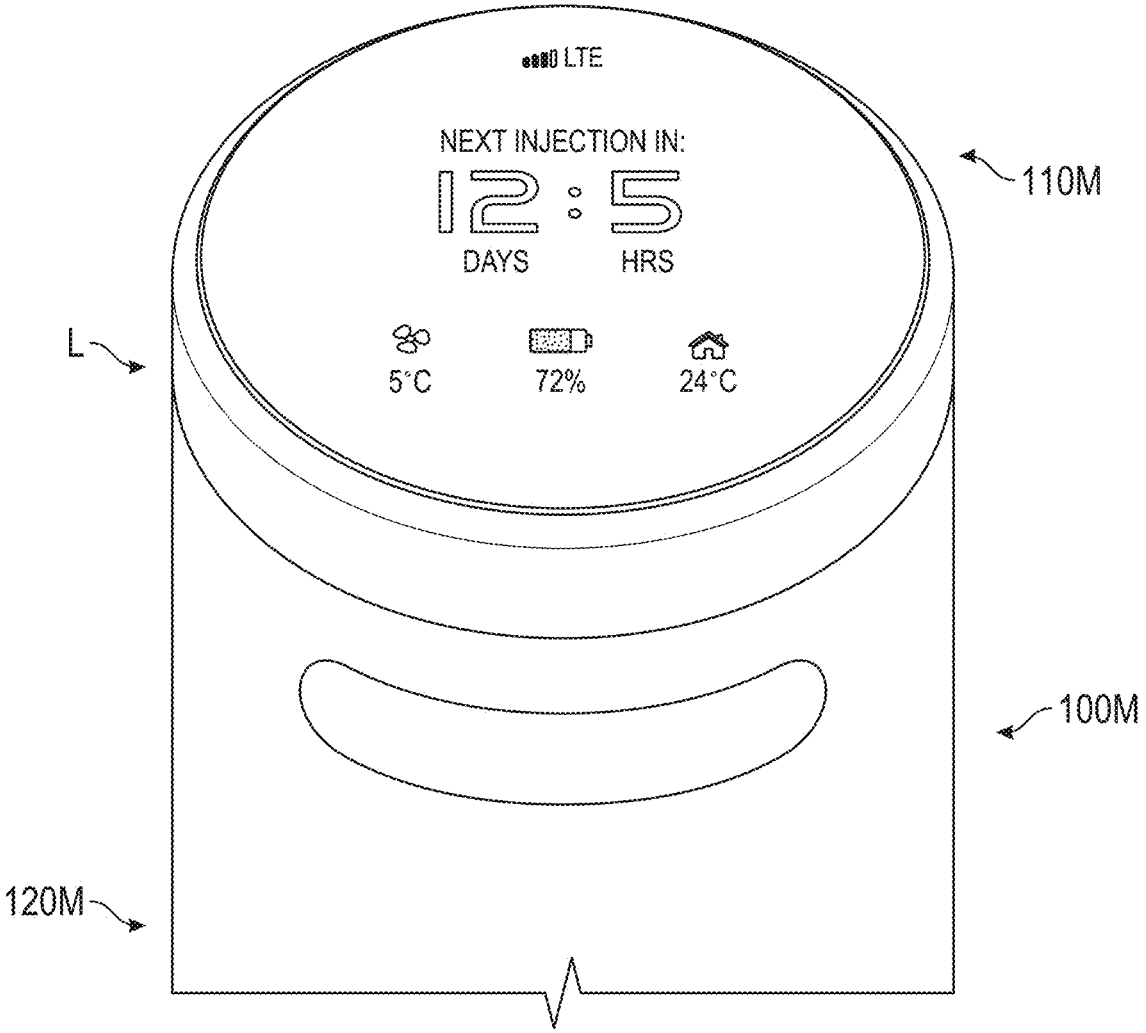
FIG. 26A is a perspective partial view of the cooler container of FIG. 23 showing a visual display of the cooler container.
Figure 26B:
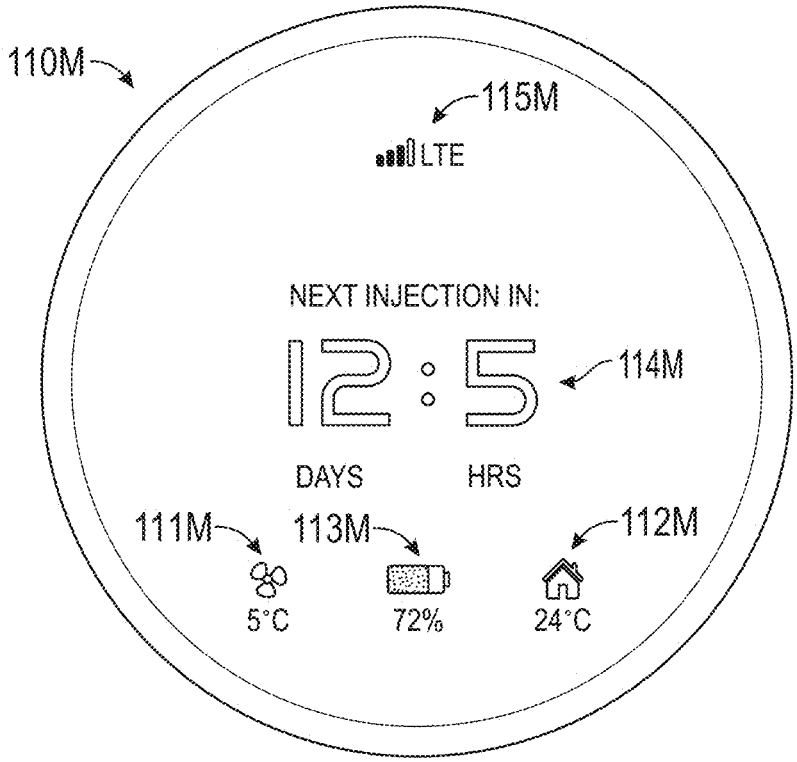
FIG. 26B is a top view of the cooler container of FIG. 23 showing one embodiment of a visual display of the cooler container.

The visual display 110M, as shown in FIGS. 26A-26B can display one or more parameters associated with the operation of the capsule container 100M or its contents. For example, the visual display 110M can optionally display temperature 111M inside a chamber of the vessel 120M indicative of a temperature of the containers 150 (e.g., medicine containers, such as injector pens or cartridges for injector pens, vials, etc.) in the vessel 120M. The visual display 110M can optionally display an ambient temperature 112M where the capsule container 100M is located. The visual display 110M can optionally display a power charge level 113M for the one or more batteries in the vessel 120M, which can indicate to a user whether the batteries of the capsule container 100M need to be charged (e.g., by placing the capsule container 100M on the power base 300).

With continued reference to FIGS. 26A-26B, the visual display 110M can optionally display a visual alert 114M for the user (e.g., countdown) for when the user needs to take medication (e.g., injection) from the containers 150 (e.g., medicine containers, such as injector pens or cartridges for injector pens, vials, etc.) in the vessel 120M. The visual alert 114M can show the days and or hours or minutes left until the user needs to take medication. In one implementation, the alert 114M can flash and/or change color (e.g., to red) when the countdown to the next medication dose falls below a predetermine time period (e.g., less than 30 min, less than 15 min, less than 10 min, less than 1 min, etc.). Additionally or alternatively, as discussed further below, the capsule container 100M can provide an audible alert (e.g., verbal message, buzzer noise), such as via a speaker in the capsule container 100M, when the countdown to the next medication dose falls below a predetermine time period (e.g., less than 15 seconds, less than 10 seconds, less than 5 seconds, etc.).

Additionally or alternatively, the capsule container 100M can communicate via its circuitry EM with a virtual personal assistant (e.g., Alexa), which can deliver an audible alert to the user via a smart speaker to take their medication, and/or with a remote electronic device (e.g., smart watch, such as Apple® watch, smartphone, such as iPhone) to deliver an alert via these devices to the user that they need to take their medication. The visual display 110M can optionally display a cell strength 115M, for example where the capsule container is using a cell radio to communicate wirelessly (e.g., with the virtual personal assistant, such as Alexa, with a smart watch, with a smartphone, etc.).

Figure 27:
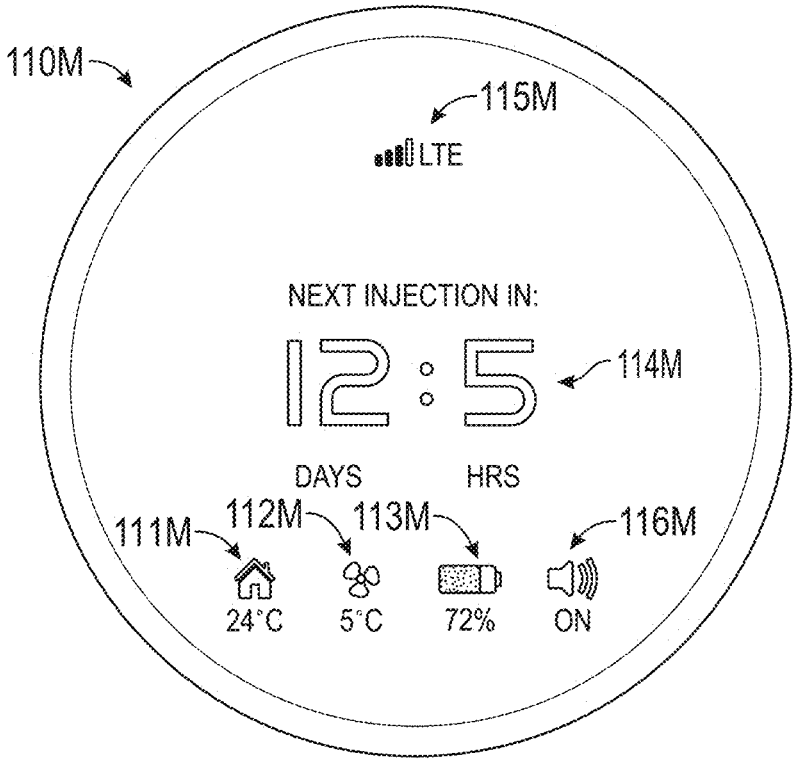
FIG. 27 is a top view of the cooler container of FIG. 23 showing one embodiment of a visual display of the cooler container.

FIG. 27 shows another embodiment of a display on the visual display 110M that differs from the display on the visual display 110M in FIGS. 26A-26B in that it provides an indication 116M of whether a speaker of the capsule cooler 100M is turned ON, via which an audible alert (e.g., voice alert, buzzer sound) can be provided by the capsule container 100M to the user when it's time to take a medication dose from the containers 150 (e.g., medicine containers, such as injector pens or cartridges for injector pens, vials, etc.) in the vessel 120M.

Figure 28:
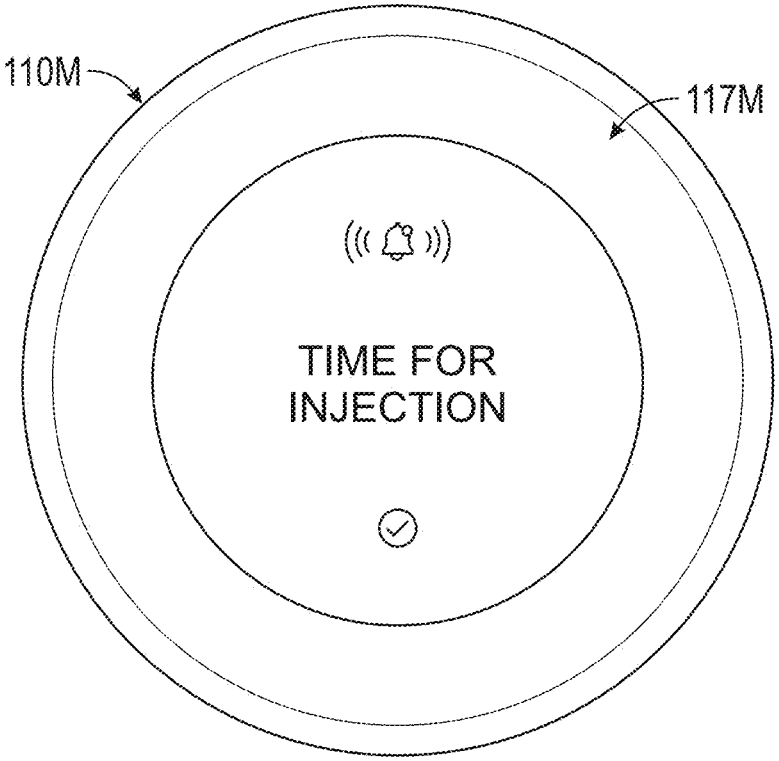
FIG. 28 is a top view of the cooler container of FIG. 23 showing one embodiment of a visual display of the cooler container.
Figure 29:
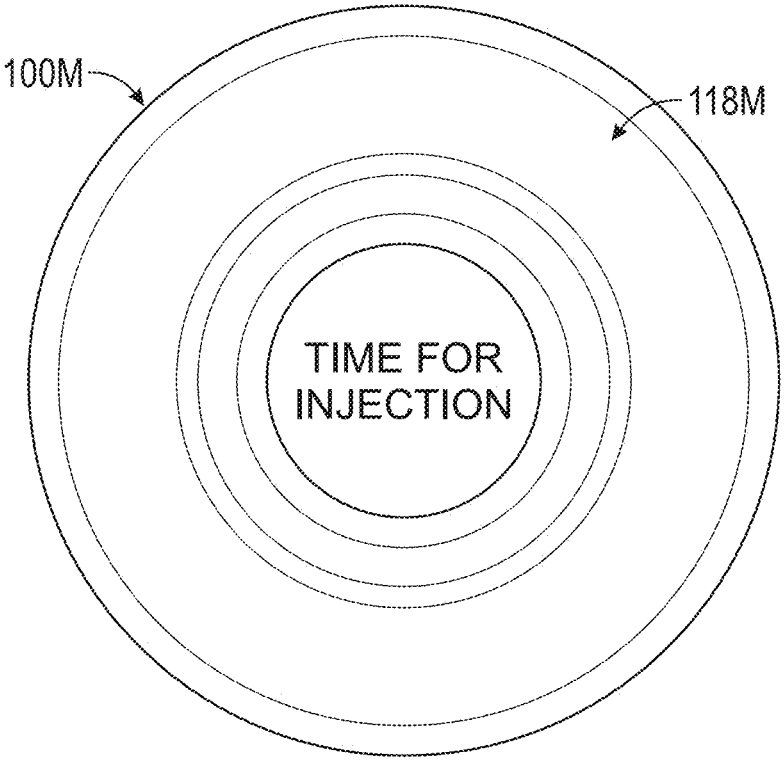
FIG. 29 is a top view of the cooler container of FIG. 23 showing one embodiment of a visual display of the cooler container.
Figure 30:
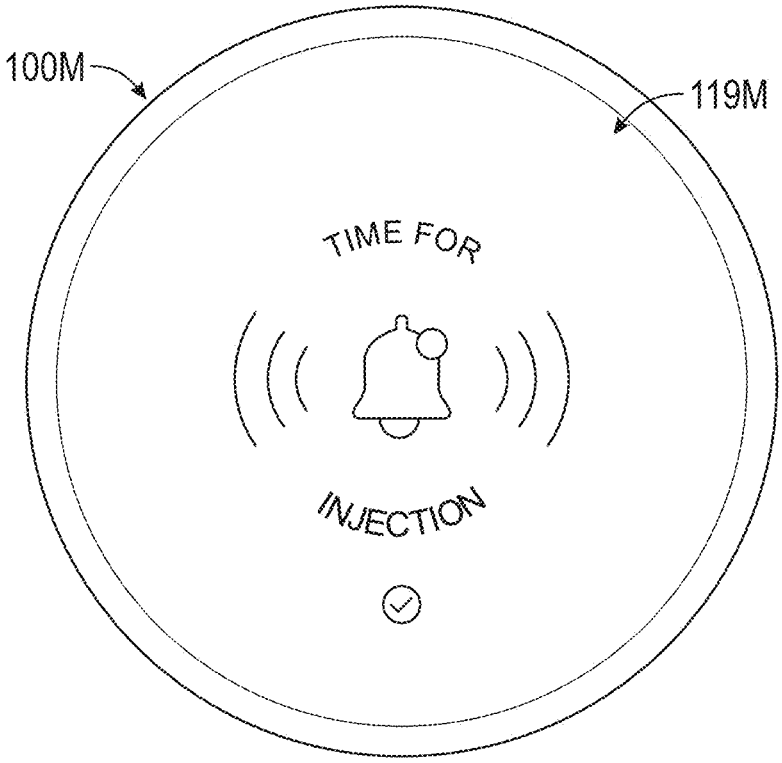
FIG. 30 is a top view of the cooler container of FIG. 23 showing one embodiment of a visual display of the cooler container.

FIGS. 28-30 show another embodiment of a display on the visual display 110M that differs from the display on the visual display 110M in FIGS. 26A-27. In FIGS. 28-29, the visual display 110M shows a notice 117M, 118M, 119M to the user that it's time for them to take medication (e.g., injection) from the containers 150 (e.g., medicine containers, such as injector pens or cartridges for injector pens, vials, etc.) in the vessel 120M. Such a notice 117M, 118M, 119M can be provided once the countdown (see FIGS. 26A-27) has dropped below a predetermined time period (e.g., less than 1 minute, less than 30 seconds, less than 15 seconds, less than 10 seconds, reached zero seconds). As discussed above, in addition to the visual alert, additionally or alternatively an audible alert (voice alert, buzzer) and/or alert via a virtual personal assistant (Alexa) or electronic device (e.g., smartwatch, smartphone) can be provided to the user.

Figure 31A:
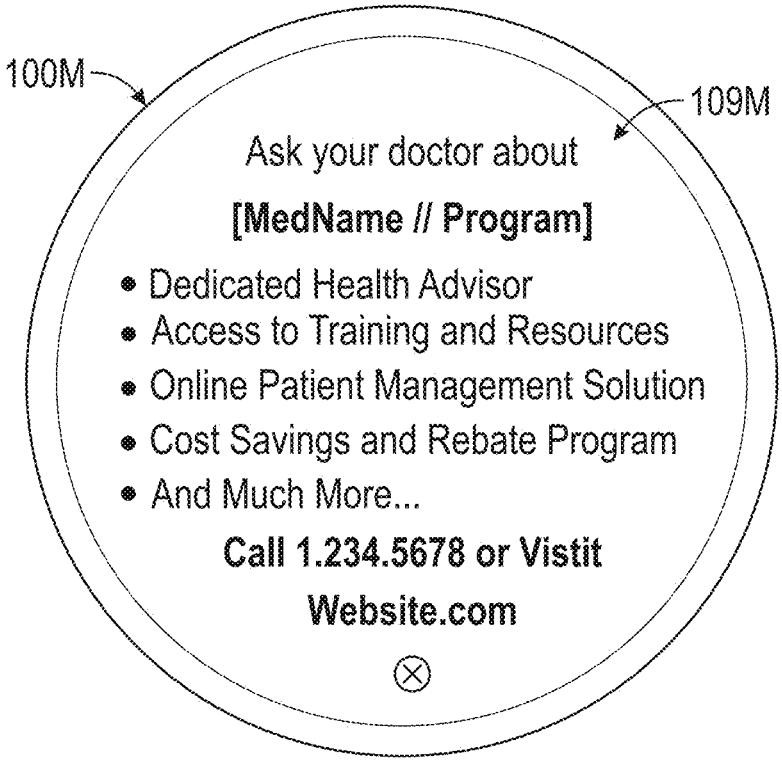
FIG. 31A is a top view of the cooler container of FIG. 23 showing one embodiment of a visual display of the cooler container.
Figure 31B:
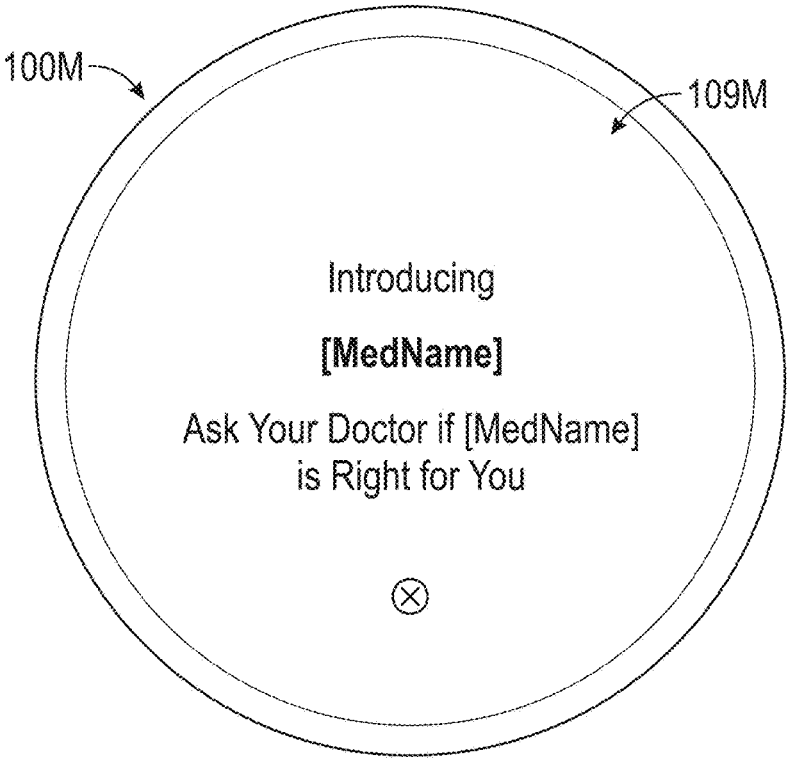
FIG. 31B is a top view of the cooler container of FIG. 23 showing one embodiment of a visual display of the cooler container.
Figure 31C:
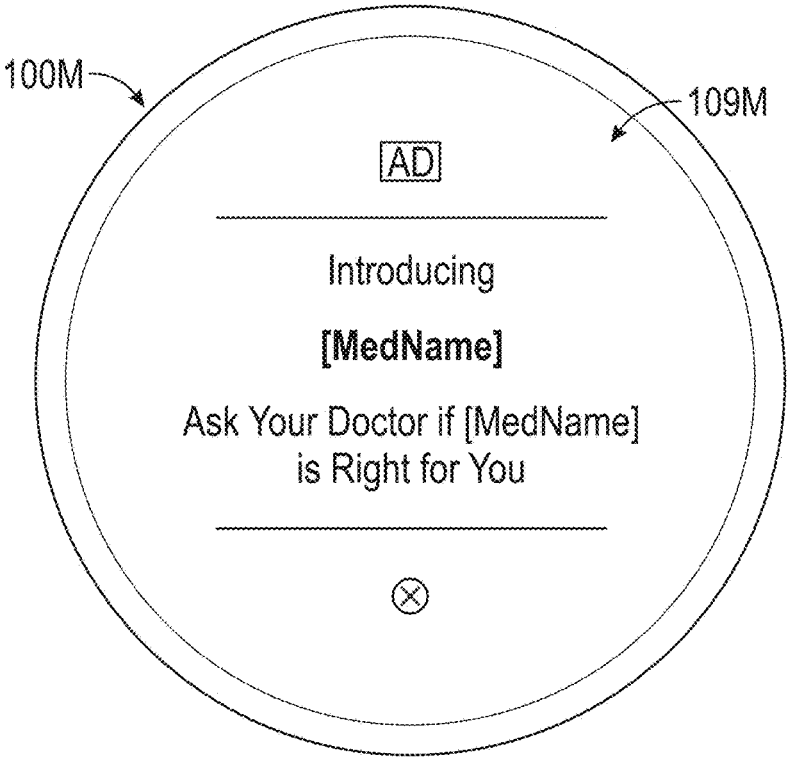
FIG. 31C is a top view of the cooler container of FIG. 23 showing one embodiment of a visual display of the cooler container.

With reference to FIGS. 31A-31C, the visual display 110M of the capsule container 100M can optionally selectively display advertisements 109M, such as for medication. Such display of advertisements can be done on a regular basis (e.g., once a day, twice a day, once an hour, etc.).

Figure 32:
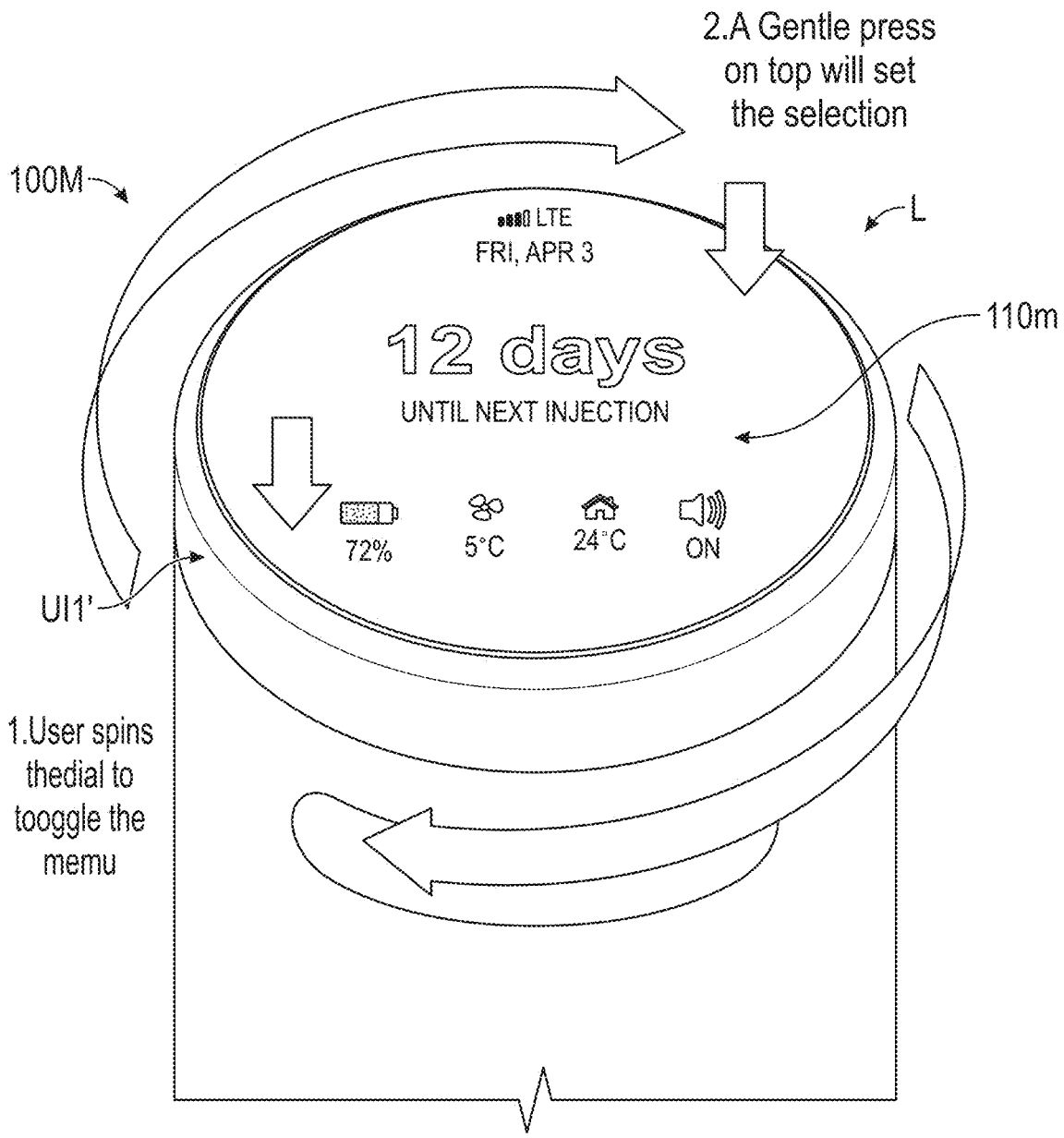
FIG. 32 is a perspective view of a portion of a cooler container with a rotatable dial user interface.

FIG. 32 shows a variation of the cooler container 100M with a rotatable dial UI1' of the lid L' that provides a user interface a user can operate to operate or change settings of the cooler container 100M, e.g. via the visual display 110M. In one example, a user can rotate the dial UI1' to toggle between different items on a menu (e.g., of settings, or operational parameters) of the cooler container 100M. Optionally, the user can select the item on the menu by pressing on the dial UI1'. Further details on a rotatable dial are provided in U.S. application Ser. No. 14/712,813 filed May 14, 2015, now U.S. Pat. No. 9,814,331 and U.S. application Ser. No. 15/705,117 filed Sep. 14, 2017, now U.S. Ser. No. 10/383,476, the entirety of both of which is hereby incorporated by reference and should be considered a part of this specification.

Figure 33A:
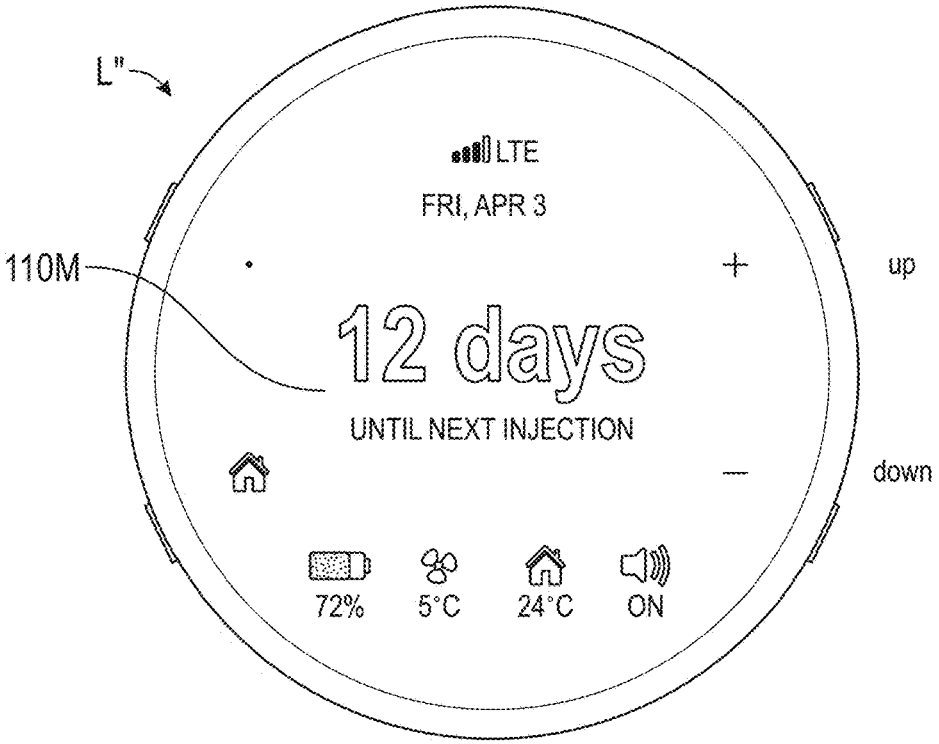
FIGS. 33A-33B are a top view and perspective view, respectively, of a portion of a cooler container with user interface buttons on a side of the container.
Figure 33B:
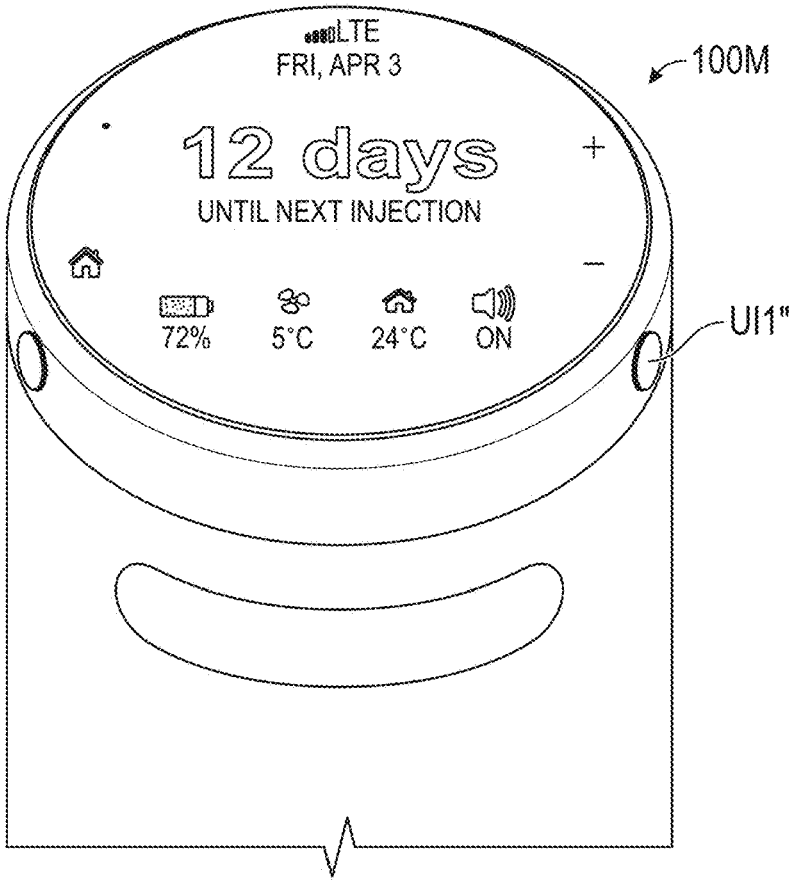

FIGS. 33A-33B show a variation of the cooler container 100M with one or more buttons UI1" on a side of the cooler container 100M (e.g., on a side surface of the lid L") that provides a user interface a user can operate to operate or change settings of the cooler container 100M, e.g. via the visual display 110M. In one example, a user can press at least one of the one or more buttons UI1" to select and/or change different items on a menu (e.g., of settings, or operational parameters) of the cooler container 100M. In one example, the one or more buttons UI1" are depressible buttons. In another example, the one or more buttons UI1" are capacitive touch sensors.

Figure 34A:
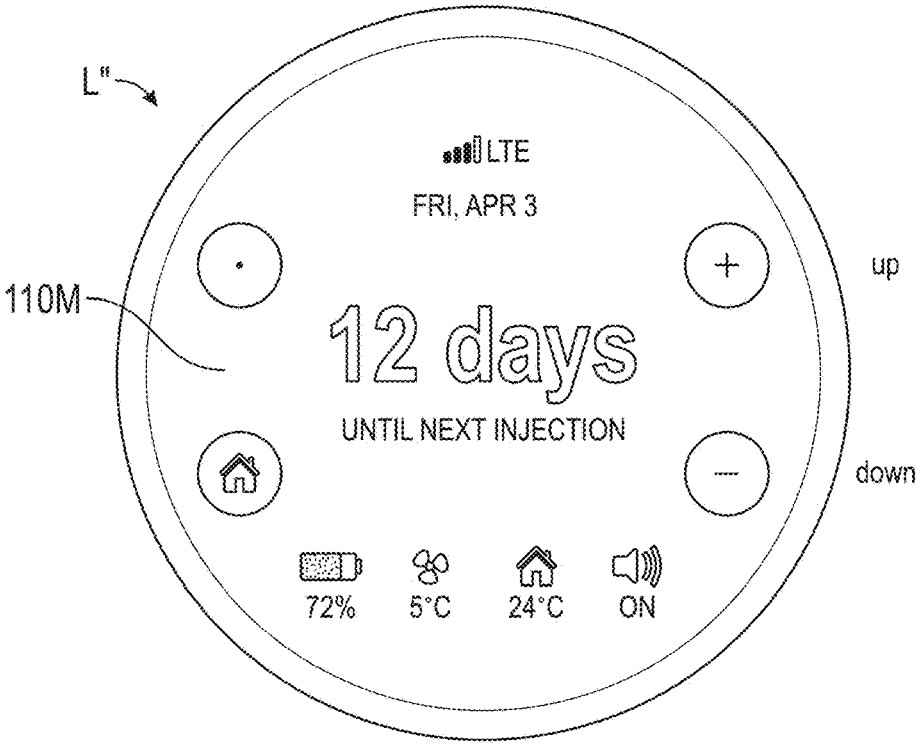
FIGS. 34A-34B are a top view and perspective view, respectively, of a portion of a cooler container with user interface buttons on a top of the lid of the container.
Figure 34B:
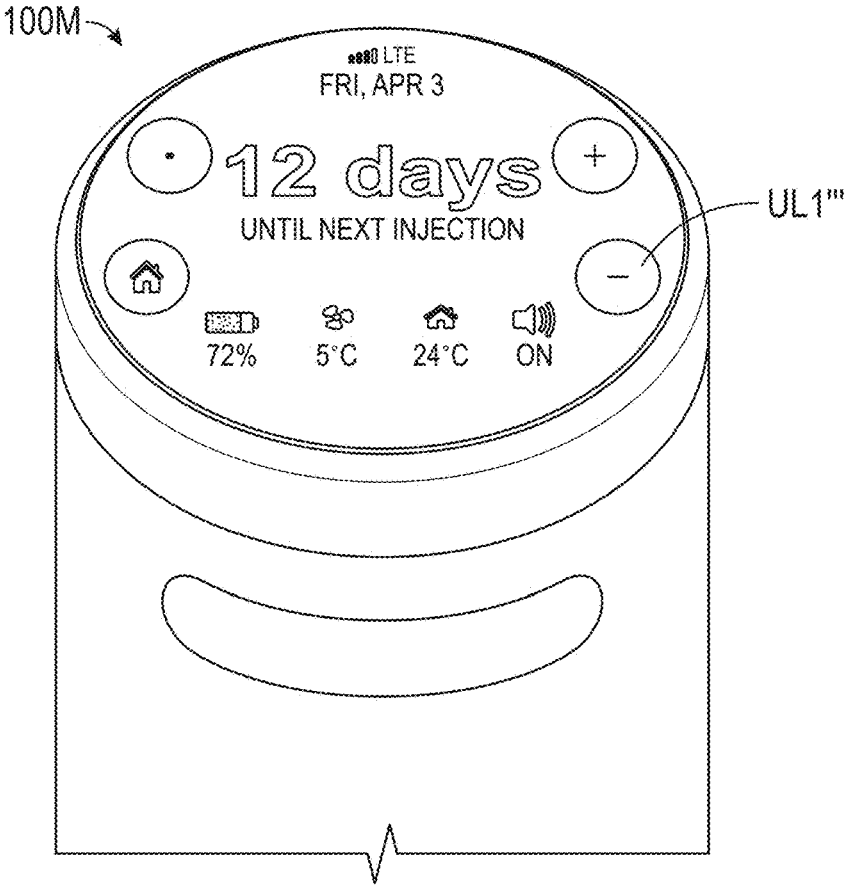

FIGS. 34A-34B show a variation of the cooler container 100M with one or more buttons UI1''' on an end surface (e.g., top surface) of the cooler container 100M (e.g., on a top surface of the lid L") that provides a user interface a user can operate to operate or change settings of the cooler container 100M, e.g. via the visual display 110M. In one example, a user can press at least one of the one or more buttons UI1''' to select and/or change different items on a menu (e.g., of settings, or operational parameters) of the cooler container 100M. In one example, the one or more buttons UI1''' are depressible buttons. In another example, the one or more buttons UI1''' are capacitive touch sensors.

Figure 35:
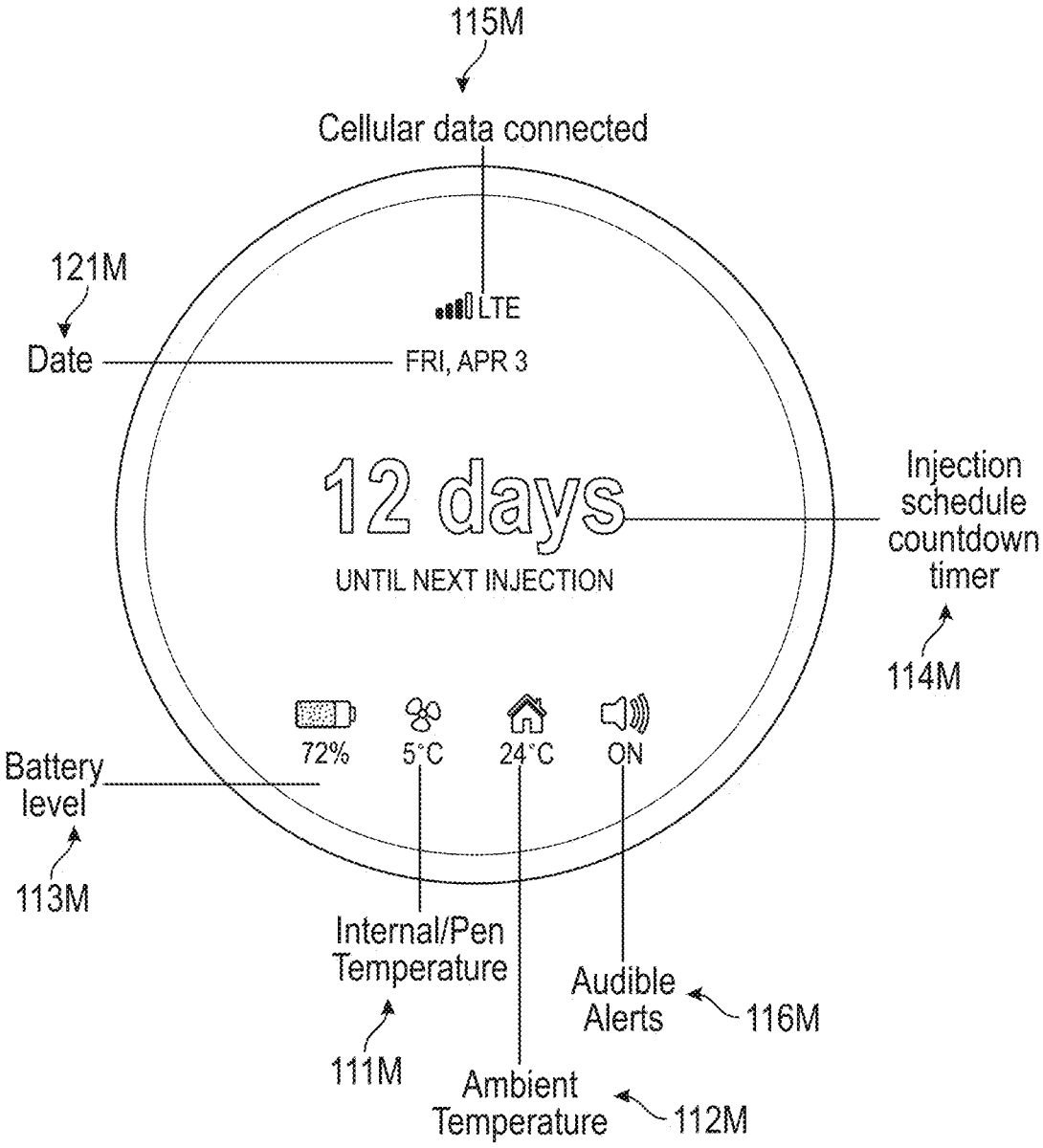
FIG. 35 is an end view of the cooler container.

FIG. 35 shows an example screen of the visual display 110M of the cooler container 100M. For example, the visual display 110M can optionally display temperature 111M inside the cooler container 100M (e.g., in a chamber of the vessel 120M) indicative of a temperature of the containers 150 (e.g., medicine containers, such as injector pens or cartridges for injector pens, vials, etc.) in the cooler container 100M. The visual display 110M can optionally display an ambient temperature 112M in the vicinity of the capsule container 100M (e.g., the room the capsule container 100M is located). The visual display 110M can optionally display a power charge level 113M for the one or more batteries in the vessel 120M, which can indicate to a user whether the batteries of the capsule container 100M need to be charged (e.g., by placing the capsule container 100M on the power base 300). The visual display 110M can display an injection schedule countdown timer 114M, as previously described above. The visual display 110M can optionally display a cell strength indication 115M, for example where the capsule container is using a cell radio to communicate wirelessly (e.g., with the virtual personal assistant, such as Alexa, with a smart watch, with a smartphone, etc.). The visual display 110M can provide an indication 116M of whether a speaker of the capsule cooler 100M is turned ON, via which an audible alert (e.g., voice alert, buzzer sound) can be provided by the capsule container 100M to the user, e.g. when it's time to take a medication dose from the containers 150 (e.g., medicine containers, such as injector pens or cartridges for injector pens, vials, etc.) in the vessel 120M of the cooler container 100M. Optionally, the visual display 110M can display the current date 121M.

Figure 36:
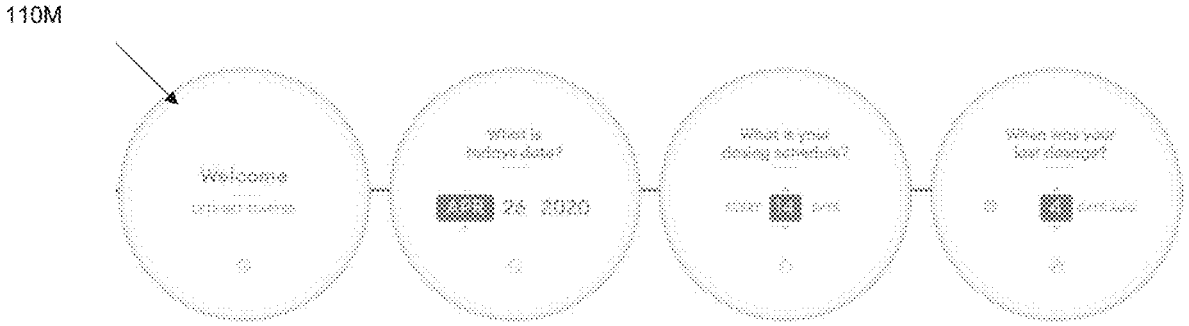
FIG. 36 is an end view of the cooler container during a setup operation.

FIG. 36 shows the visual display 110M of the cooler container 100M during a setup operation. The visual display 110M can provide a welcome screen (e.g., when the cooler container is first turned on, or when reset). In other screens of the setup operation, the visual display 110M can optionally query or guide the user to enter the date (today's date), their dosing schedule (e.g., every 4 hours, every 2 days, every 2 weeks, etc.), and/or when the user took the last dose. Additional or less information can be requested by the cooler container 100M. For example, entering the date can be excluded, or location data (e.g., zip code) can be added.

Figure 37:
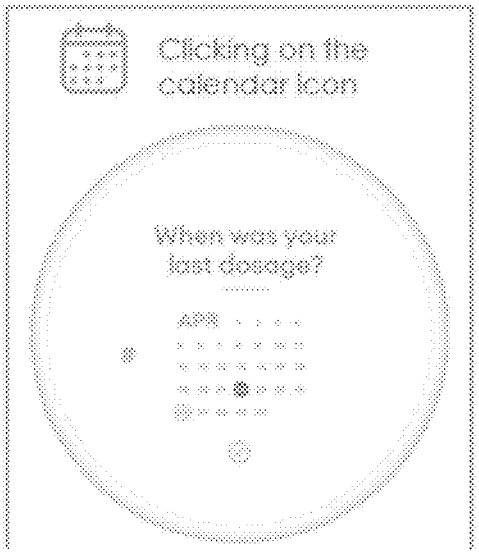
FIG. 37 is an end view of the cooler container with an alternative screen during a setup operation.

FIG. 37 shows an example screen of the visual display 110M for the cooler container 100M that can be displayed to the user to enter date information (e.g., using a calendar format).

Figure 38:
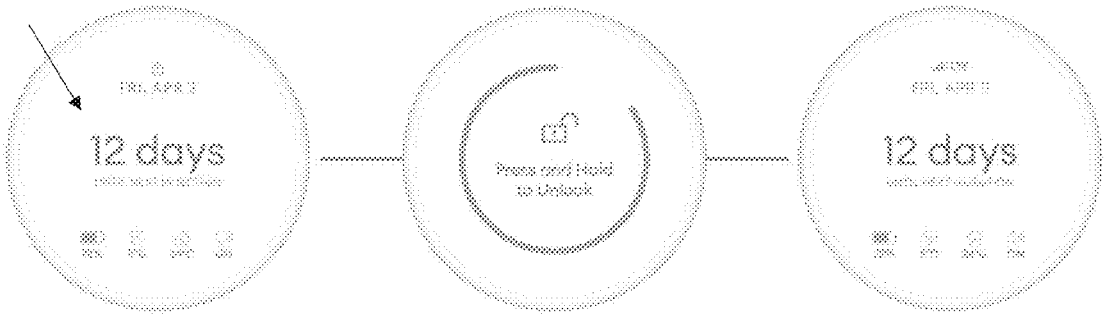
FIG. 38 is an end view of the cooler container with sample display screens.

FIG. 38 shows an example screen (e.g., main screen) of the visual display 110M for the cooler container 100M. Once initial setup (see FIG. 36) is completed, or setup following a reset of the container 100M is completed, the cooler container 100M will lock (e.g., after a predetermined period of time, such as 30 seconds of idle time or nonuse) to prevent inadvertent or unwanted usage of the container 100M. A user can selectively unlock the cooler container 100M, such as by operating a user interface of the container 100M, via an app on a tablet or smartphone paired with the cooler container 100M, by pressing (e.g., pressing and holding) a portion of the cooler container 100M (e.g., pressing and/or holding an outer ring of the lid L, L', L", L'''). Once unlocked, the user can open the lid L, L', L", L''', access the main menu on the visual display 110M, change settings (e.g., operating settings) for the cooler container 100M via the visual display 110M, etc.

Figure 39:
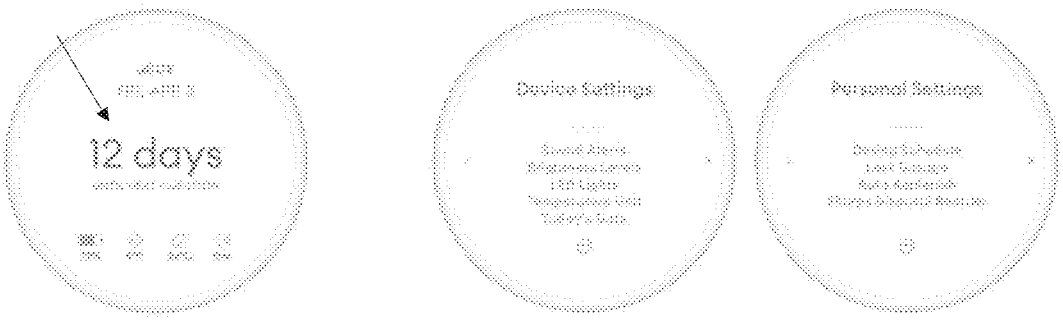
FIG. 39 is an end view of the cooler container with sample display screens.
Figure 40:
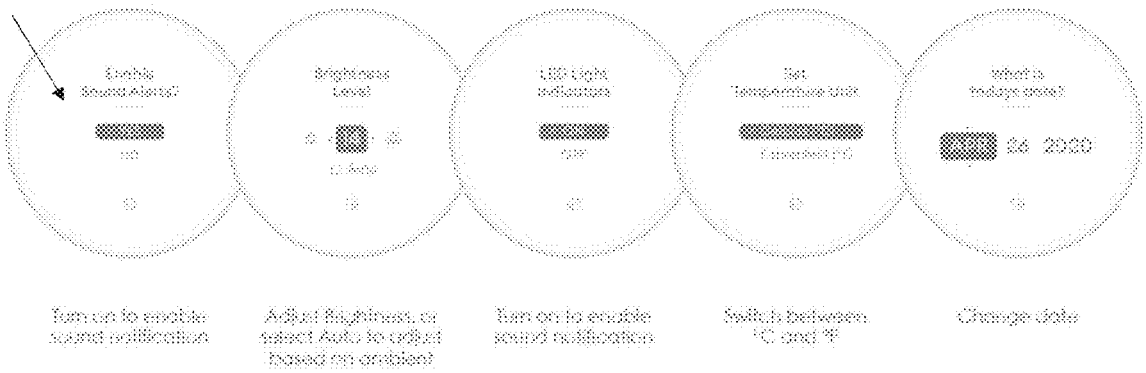
FIG. 40 is an end view of the cooler container with sample display screens for device settings.
Figure 41:
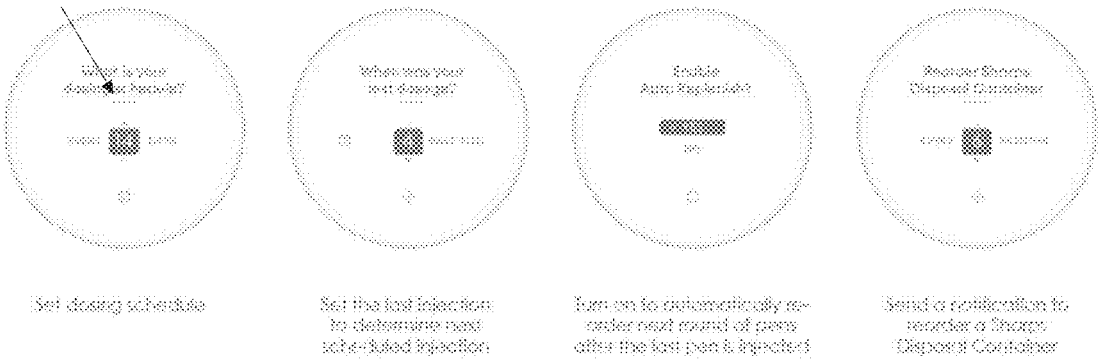
FIG. 41 is an end view of the cooler container with sample display screens for personal settings.

FIG. 39 shows example screens for the visual display 110M for one or more menus of settings (e.g., device settings for the cooler container 100M, personal settings for the user). The user and select and/or adjust or change one or more settings via the user interface(s) UI1, UI1", UI1''' as discussed above. For example, the user can use the rotatable dial UI1' to select/change one or more settings by pressing on the lid L' or outer ring (e.g., press once) and then rotate the dial UI1' left or right to the desired setting parameter. Optionally, the user can press on the lid L' or other interface of the container 100M to select the setting parameter and use the dial (rotate left or right) to adjust the setting value for the setting. Optionally, the user can press on the lid L' again to complete the change to the setting parameter. FIG. 40 shows example screens for different device setting parameters that the user can adjust/change via the user interface UI1, UI1', UI1", UI1''', as discussed above. FIG. 41 shows example screens for different personal setting parameters that the user can adjust/change via the user interface UI1, UI1', UI1", UI1''', as discussed above.

Figure 42:
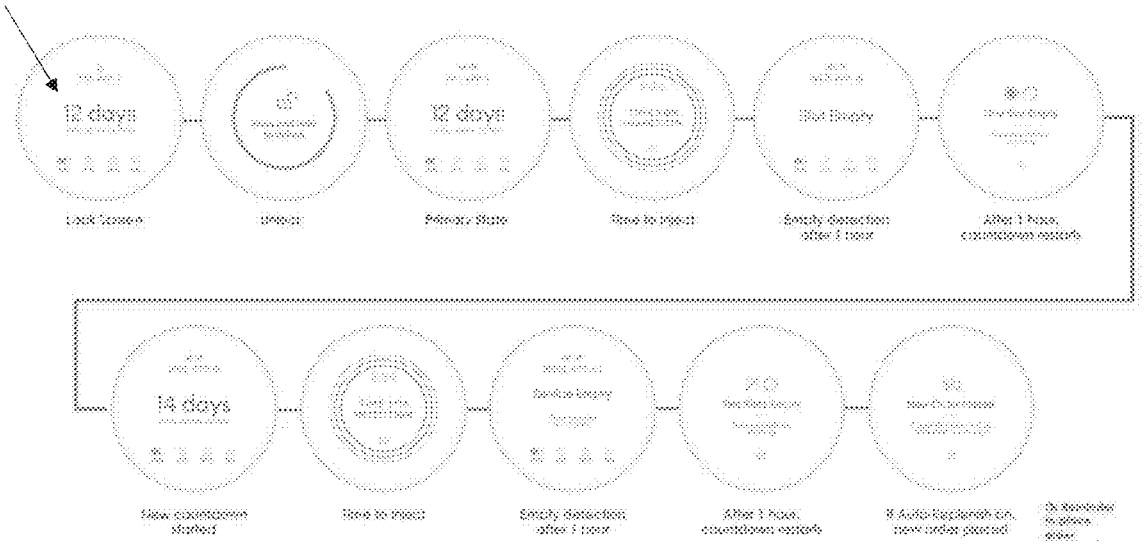
FIG. 42 is a flow chart of an operation of the cooler container.

FIG. 42 shows a schematic flowchart for an operation of the cooler container 100M via the visual display 110M. As discussed above, the cooler container 100M can lock (e.g., automatically lock, such as after a predetermined period of time, such as 30 seconds of inactivity). A user can unlock the cooler container 100M, such as via actuation of a user interface UI1, UI1', UI1", UI1''' of the cooler container 100M (e.g., of the lid L, L', L", L'''), after which the visual display 110M and display a main screen (e.g., in a primary state). Once the time is reached for the user to take a dosage, the cooler container 100M can notify the user as discussed above (e.g., via a visual alert on the visual display 110M, via an audio alert, via a vibration alert, etc.). The cooler container 100M can detect when one or more slots (e.g., that house one or more containers 150 of medicine) are empty, such as because the user has consumed a dose of medication. One or more sensors of the cooler container 100M that detect a presence of the container(s) 150 of medicine in the vessel 120M can communicate with the circuitry EM on a regular basis (e.g., every second, every 30 seconds, every minute, every 10 minutes, every half hour, every hour). Once a slot is detected by the one or more sensors as empty, such as after a predetermined period of time (e.g., one hour), the circuitry EM can start the countdown until the next dosage and the visual display 110M can display said countdown and the cooler container 100M can again remain in a locked state until unlocked by the user and can alert the user when it comes time to take the next dose. Optionally, the visual display 110M can display how many slots in the vessel 120M are occupied and/or how many slots are empty to indicate to the user how many dosages are left and/or how many dosages have been used. Optionally, the cooler container 100M can alert the user (e.g., via the visual display 110M with a visual alert and/or via an audio alert or vibration alert) when it's time to order more medication. For example, the cooler container 100M can alert the user when 2 or less dosages are left, or when only 1 dosage is left. Optionally, the cooler container 100M can prompt the user to order additional medication (e.g., container(s) 150), and the user can place such an order for additional medication (e.g., container(s) 150) via one or more of: actuation of a user interface UI1, UI1', UI1", UI1'" of the cooler container 100M, via an app on a smartphone (e.g., an app paired with the cooler container 100M). Alternatively, the user can program the cooler container 100M (e.g., via a device setting, as discussed above) to automatically order additional medication (e.g., container(s) 150) when fewer than a predetermined number of container(s) 150 are detected by one or more sensors in the vessel 150 (e.g., fewer than 3 dosages, fewer than 2 dosages, etc.). Additionally, or alternatively, the user can order a disposal container (e.g., Sharps container) for disposing of used medication containers (e.g., containers 150).

In one implementation, the cooler container 100M can track when the user takes the dosage and sense via the sensor(s) in the vessel 120M when a container 150 of medicine is removed from the vessel 120M before the dose countdown has completed. The cooler container 100M can query the user (via the visual display 110M with a visual alert or with an audio alert) to confirm if the medication was taken early. If the user confirms the medication was taken early, circuitry EM of the cooler container 100M can automatically cancel the pending dose countdown and start a new dose countdown from the present date/time for the user's next dose. If the user confirms the medication was not taken early, the cooler container 100M can continue to alert the user (via the visual display 110M with a visual alert or with an audio alert) that the slot in the vessel 120M is empty until the user inserts a container 150 of medicine in the empty slot in the vessel 120M, after which the visual display 110M can revert to the main screen.

In one implementation, the cooler container 100M can determine that the container 150 has not been removed from the vessel 120M and the dose countdown has reached zero. The cooler container 100M can alert the user (via the visual display 110M with a visual alert or with an audio alert) to take the medication. If the user then unlocks the cooler container 100M and removes the container 150 to take the medication and closes the lid L, L', L", L'" of the cooler container 100M, the circuitry EM of the cooler container 100M can automatically start a new dose countdown from the present date/time for the user's next dose. If the user selects a snooze function of the cooler container 100M (e.g., via the visual display 110M), the circuitry EM can start a reminder countdown (e.g., one hour, 2 hours, 30 minutes) and alert the user once the reminder countdown has expired (e.g., via the visual display 110M with a visual alert or with an audio alert) to take the medication. The circuitry EM can continue to remind the user to take the medication (e.g., following multiple snooze selections by the user) until the user confirms they have removed a container 150 from the vessel 120M and taken the medication 150.

Figure 43:
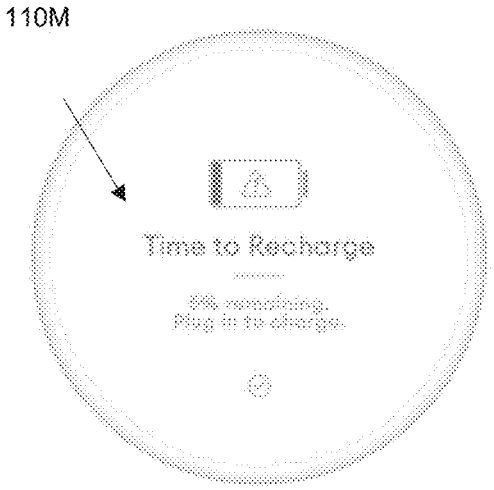
FIG. 43 is an end view of the cooler container with sample warning states.
Figure 43:
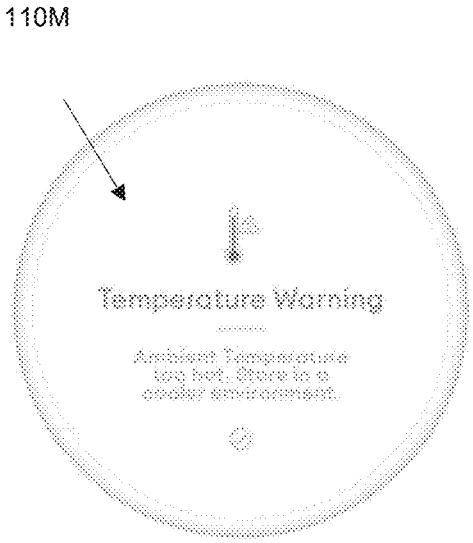

FIG. 43 shows example alert screens for the visual display 110M via which the display 110M can provide warnings to the user. In one example, the visual display 110M can alert the user that power level of the batteries of the cooler container 100M is low and it's time to recharge the batteries (e.g., by placing the cooler container 100M on a power base, by connecting a power cord to the cooler container 100M, such as via a USB port, micro-USB port, etc.). In another example, the visual display 110M can alert the user that the temperature in the vessel 120 is too high or too low for the container(s) 150 of medicine in the container 100M, and that the cooler container 100M needs to be stored in a cooler environment (e.g., if the cooler container 100M is in direct sunlight, such as for a prolonged period of time). Other warning alerts are possible. The LED 140 (e.g., hidden-til-lit LED) of the cooler container 100M and illuminate in a first color (e.g., blue, green, yellow, etc.) when the cooler container 100M is operating normally (e.g., cooling the vessel 120M and container(s) 150 adequately). The LED 140 (e.g., hidden-til-lit LED) can optionally illuminate in a different color (e.g., red) when the cooler container 100M is in a warning state, as discussed above, or there is a malfunction of the device.

Additional Embodiments

In embodiments of the present disclosure, a portable cooler container system may be in accordance with any of the following clauses:

Clause 1. A portable cooler container with active temperature control, comprising:

- a container body having a chamber configured to receive and hold one or more containers of medicine;
- a lid operable to access the chamber; and
- a temperature control system comprising
  - one or more thermoelectric elements configured to actively heat or cool at least a portion of the chamber,
  - circuitry configured to control an operation of the one or more thermoelectric elements to heat or cool at least a portion of the chamber to a predetermined temperature or temperature range; and
  - a display screen disposed on one of the container body and the lid, the display screen configured to selectively display one or more of information associated with the operation of the portable cooler, information associated with the containers of medicine in the portable cooler, information associated with scheduled taking of the containers of medicine, and advertisements.

Clause 2. The container of clause 1, further comprising a speaker via which an audible alert can be provided to a user to take medication.

Clause 3. The container of any preceding clause, further comprising one or more batteries in the container body that provide power to one or more of the circuitry, one or more thermoelectric elements and display screen.

Clause 4. The container of any preceding clause, wherein the container body comprises an outer peripheral wall and a bottom portion attached to the outer peripheral wall, an inner peripheral wall spaced relative to the outer peripheral wall to define a gap between the inner peripheral wall and the outer peripheral wall.

Clause 5. The container of clause 4, wherein the gap is under vacuum.

Clause 6. The container of any preceding clause, wherein the temperature control system further comprises a first heat sink unit in thermal communication with one side of the one or more thermoelectric elements, a second heat sink unit in thermal communication with an opposite side of the one or more thermoelectric elements, and one or more fans operable to flow air past the second heat sink unit and out exhaust openings in the container body.

Clause 7. The container of any preceding clause, wherein the display screen is disposed on the lid and wherein an electrical connection extends between the container body and the lid to provide power to the display screen.

Clause 8. The container of any preceding clause, further comprising one or more sensors configured to sense the one or more parameters of the chamber or temperature control system and to communicate the sensed information to the circuitry.

Clause 9. The container of any preceding clause, further comprising one or more temperature sensors configured to sense a temperature in the chamber and to communicate the sensed temperature to the circuitry, the circuitry configured to communicate the sensed temperature data to the cloud-based data storage system or remote electronic device.

Clause 10. The container of any preceding clause, further comprising a user interface configured to display information indicative of a charge level of one or more batteries of the container body.

Clause 11. The container of any preceding clause, wherein the chamber comprises two spaced a part chambers that each removably receive a container of medicine.

Clause 12. The container of any preceding clause, wherein the circuitry comprises a cell radio configured to communicate with one or more of a smartphone, a smartwatch, a virtual personal assistant and a smart speaker.

Clause 13. The container of any preceding clause, wherein information associated with the operation of the portable cooler comprises one or more of a temperature inside the chamber, an ambient temperature, a power charge level for one or more batteries of the container a strength of a cell radio signal, an operating state of a speaker of the container, and a current date.

Clause 14. The container of any preceding clause, wherein information associated with scheduled taking of the containers of medicine comprises one or more of a visual alert, a vibration and an audible alert via one or more of the container, a smartphone, a smartwatch, a virtual personal assistant and a smart speaker.

Clause 15. The container of any preceding clause, wherein at least a portion of the lid comprises a rotatable dial operable to set or change one or more operating settings of the container.

Clause 16. The container of any preceding clause, wherein at least a side portion of the lid comprises one or more buttons operable to set or change one or more operating settings of the container.

Clause 17. The container of any preceding clause, wherein at least a top surface of the lid comprises one or more buttons operable to set or change one or more operating settings of the container.

Clause 18. The container of any preceding clause, further comprising one or more sensors that sense when the one or more containers of medicine are removed from the chamber to track when a user consumes the medicine.

Clause 19. The container of any preceding clause, wherein the display is configured to provide a visual warning to the user for one or both of a lower battery power condition and a chamber temperature that exceeds a threshold.

Clause 20. The container of any preceding clause, wherein the lid is movably coupleable to the container body.

Clause 21. The container of any preceding clause, wherein the electrical connection extends between the container body and the lid via a hinge between the lid and the container body to provide power to the display screen.

Clause 22. The container of any preceding clause, wherein the display screen is configured to selectively display information associated with the operation of the portable cooler, information associated with the containers of medicine in the portable cooler, information associated with scheduled taking of the containers of medicine, and advertisements.

While certain embodiments of the inventions have been described, these embodiments have been presented by way of example only, and are not intended to limit the scope of the disclosure. Indeed, the novel methods and systems described herein may be embodied in a variety of other forms. For example, though the features disclosed herein are in described for medicine containers, the features are applicable to containers that are not medicine containers (e.g., portable coolers for food, chilled water cooler/bottle, etc.) and the invention is understood to extend to such other containers. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A portable cooler container with active temperature control, comprising:

a container body having a chamber configured to receive and hold at least one container of medicine, the chamber defined by a base and an inner peripheral wall of the container body, the container body further comprising an outer peripheral wall and an intermediate peripheral wall interposed between the outer peripheral wall and the inner peripheral wall, the intermediate peripheral wall spaced apart from the inner peripheral wall to define a gap therebetween;

a lid operable to access the chamber; and a temperature control system housed in the container body, comprising at least one thermoelectric element in thermal communication with the chamber via a first heat sink that extends between and is in thermal communication with the at least one thermoelectric element and with the inner peripheral wall, the first heat sink being at least partially disposed inside the intermediate peripheral wall, the at least one thermoelectric element configured to actively heat or cool at least a portion of the chamber, circuitry configured to control an operation of the at least one thermoelectric element to heat or cool at least a portion of the chamber to a predetermined temperature or temperature range; and a display screen disposed on one of the container body and the lid, the display screen being actuatable to selectively display information associated with the operation of the portable cooler, information associated with the at least one container of medicine in the portable cooler, information associated with a schedule for taking medicine in the at least one container of medicine, and an advertisement.

2. The container of claim 1, further comprising a speaker via which an audible alert can be provided to a user to take medication.

3. The container of claim 1, further comprising at least one battery in the container that provides power to the circuitry, at least one thermoelectric element and the display screen.

4. The container of claim 1, wherein the temperature control system further comprises a second heat sink unit in thermal communication with an opposite side of the at least one thermoelectric element from the first heat sink, and at least one fan in the container body operable to flow air past the second heat sink unit and out exhaust openings in the container body.

5. The container of claim 1, wherein the display screen is disposed on the lid and wherein an electrical connection extends between the container body and the lid to provide power to the display screen.

6. The container of claim 1, further comprising at least one sensor configured to sense at least one parameter of the chamber or temperature control system and to communicate the sensed information to the circuitry.

7. The container of claim 1, further comprising at least one temperature sensor configured to sense a temperature in the chamber and to communicate the sensed temperature to the circuitry, the circuitry configured to communicate the sensed temperature data to the cloud-based data storage system or remote electronic device.

8. The container of claim 1, further comprising a user interface configured to display information indicative of a charge level of at least one battery of the container.

9. The container of claim 1, wherein the chamber comprises two spaced a part chambers that each removably receive a container of medicine.

10. The container of claim 1, wherein the circuitry comprises a cell radio configured to communicate with a smartphone, a smartwatch, a virtual personal assistant or a smart speaker.

11. The container of claim 1, wherein information associated with the operation of the portable cooler comprises a temperature inside the chamber, an ambient temperature, a power charge level for at least one battery of the container, a strength of a cell radio signal, an operating state of a speaker of the container, or a current date.

12. The container of claim 1, wherein information associated with scheduled taking of the containers of medicine comprises a visual alert, a vibration or an audible alert the container, a smartphone, a smartwatch, a virtual personal assistant or a smart speaker.

13. The container of claim 1, wherein at least a portion of the lid comprises a rotatable dial operable to set or change an operating setting of the container.

14. The container of claim 1, wherein at least a side portion of the lid comprises one or more buttons operable to set or change an operating setting of the container.

15. The container of claim 1, wherein at least a top surface of the lid comprises at least one button operable to set or change an operating setting of the container.

16. The container of claim 1, further comprising at least one sensor that senses when the at least one container of medicine is removed from the chamber to track when a user consumes the medicine.

17. The container of claim 1, wherein the display is configured to provide a visual warning to the user for a lower battery power condition or a chamber temperature that exceeds a threshold temperature.

18. A portable cooler container with active temperature control, comprising:

a container body having a chamber configured to receive and hold at least one medicine container, the chamber defined by a base and an inner peripheral wall of the container body, the container body further comprising an outer peripheral wall and an intermediate peripheral wall interposed between the outer peripheral wall and the inner peripheral wall, the intermediate peripheral wall spaced apart from the inner peripheral wall to define a gap therebetween that is under vacuum;

a lid operable to access the chamber; and a temperature control system in the container body, comprising at least one thermoelectric element in thermal communication with at least a portion of the chamber via a first heat sink having a first portion in thermal communication with the at least one thermoelectric element and disposed outside the intermediate peripheral wall, a second portion in thermal communication with the inner peripheral wall and disposed inside the intermediate peripheral wall, and a bridge portion that interconnects the first portion and the second portion of the first heat sink and extends over and across the intermediate peripheral wall, and circuitry configured to control an operation of the at least one thermoelectric element to heat or cool at least a portion of the chamber to a predetermined temperature or temperature range; and a display screen disposed on the lid, the display screen being actuatable to selectively display information associated with the operation of the portable cooler, information associated with the at least one container of medicine in the portable cooler, information associated with a schedule for taking medicine in the at least one medicine container, and an advertisement.

19. The container of claim 18, wherein the chamber comprises two spaced a part chambers that each removably receive a medicine container.

* * * * *